US009142175B2

(12) United States Patent
Hosaka et al.

(10) Patent No.: US 9,142,175 B2
(45) Date of Patent: Sep. 22, 2015

(54) LIQUID CRYSTAL PIXEL CORRECTION USING PIXEL BOUNDARY DETECTION

(75) Inventors: Hiroyuki Hosaka, Matsumoto (JP); Taku Kitagawa, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 290 days.

(21) Appl. No.: 13/315,697

(22) Filed: Dec. 9, 2011

(65) Prior Publication Data

US 2012/0147272 A1 Jun. 14, 2012

(30) Foreign Application Priority Data

Dec. 13, 2010 (JP) ..... 2010-276676

(51) Int. Cl.
*G09G 3/36* (2006.01)

(52) U.S. Cl.
CPC ..... *G09G 3/3648* (2013.01); *G09G 2320/0209* (2013.01); *G09G 2320/10* (2013.01); *G09G 2340/16* (2013.01)
USPC ..... 345/87; 345/88

(58) Field of Classification Search
CPC ..... G09G 3/36; G09G 3/364; G09G 3/3648; G09G 3/3655; G09G 3/3659; G09G 3/3696
USPC ..... 345/87–104
See application file for complete search history.

(56) References Cited

U.S. PATENT DOCUMENTS 6,226,058 B1 5/2001 Ohi
6,476,590 B2 11/2002 Chou
7,446,824 B2 11/2008 Kobayashi et al.
7,952,556 B2 5/2011 Honbo
8,081,284 B2 12/2011 Hosaka et al.
8,411,004 B2 * 4/2013 Iisaka et al. ..... 345/87
8,466,866 B2 * 6/2013 Iisaka et al. ..... 345/89
8,497,829 B2 * 7/2013 Hosaka et al. ..... 345/89
2008/0018630 A1 1/2008 Fujino
2008/0180385 A1 7/2008 Yoshida et al.
2009/0243983 A1 * 10/2009 Ohashi et al. ..... 345/89
2011/0051006 A1 3/2011 Iisaka et al.
2011/0051007 A1 3/2011 Hosaka et al.
2011/0058111 A1 3/2011 Hosaka et al.
2011/0109815 A1 5/2011 Hosaka et al.
2011/0181795 A1 * 7/2011 Hosaka et al. ..... 348/790

(Continued)

FOREIGN PATENT DOCUMENTS

CN 102169679 A 8/2011
JP 06-034965 A 2/1994

(Continued)

*Primary Examiner* — Alexander Eisen
*Assistant Examiner* — Nelson Lam
(74) *Attorney, Agent, or Firm* — Maschoff Brennan

(57) ABSTRACT

A video processing circuit detects a risk boundary that is a part of a boundary between a dark pixel and a bright pixel, and is determined in accordance with the tilt azimuth of liquid crystal molecules from a boundary changed over the previous frame to the current frame and, for at least one side of dark pixels and bright pixels brought into contact with the detected risk boundary, corrects a video signal designating the application voltage of a liquid crystal element corresponding to the pixel of the frame brought into contact with the risk boundary out of a plurality of frames from the current frame to k frames (here, k is a natural number) following the current frame such that a lateral direction electric field generated between the dark pixel and the bright pixel decreases.

15 Claims, 33 Drawing Sheets

(56) References Cited

U.S. PATENT DOCUMENTS

| | | | | |
|---|---|---|---|---|
| 2011/0205207 | A1* | 8/2011 | Hosaka et al. | 345/211 |
| 2011/0205208 | A1* | 8/2011 | Iisaka et al. | 345/211 |
| 2011/0205440 | A1* | 8/2011 | Hosaka et al. | 348/607 |
| 2011/0205452 | A1 | 8/2011 | Hosaka et al. | |
| 2011/0205479 | A1 | 8/2011 | Hosaka et al. | |
| 2012/0147272 | A1 | 6/2012 | Hosaka et al. | |
| 2013/0241914 | A1 | 9/2013 | Kitagawa et al. | |

FOREIGN PATENT DOCUMENTS

| | | | |
|---|---|---|---|
| JP | 2009-069608 | A | 4/2009 |
| JP | 2009-237366 | A | 10/2009 |
| JP | 2011-053390 | A | 3/2011 |
| JP | 2011-053417 | A | 3/2011 |
| JP | 2011-059160 | A | 3/2011 |
| JP | 2011-107174 | A | 6/2011 |
| JP | 2011-145501 | A | 7/2011 |
| JP | 2011-150223 | A | 8/2011 |

* cited by examiner

SCANNING LINE DRIVING CIRCUIT

VIDEO PROCESSING CIRCUIT

FIG. 13A DETECTION OF APPLIED BOUNDARY
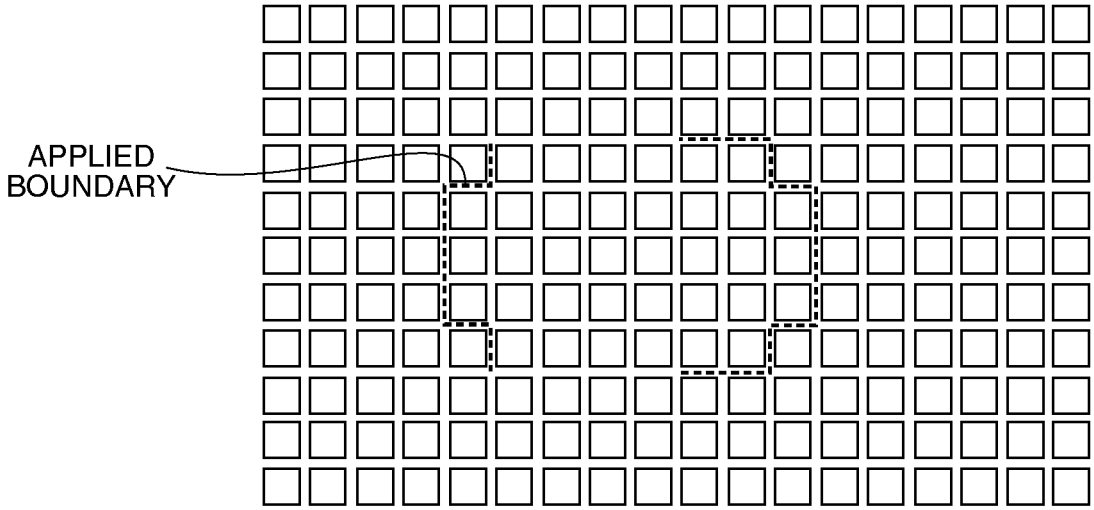
FIG. 13B DETECTION OF RISK BOUNDARY
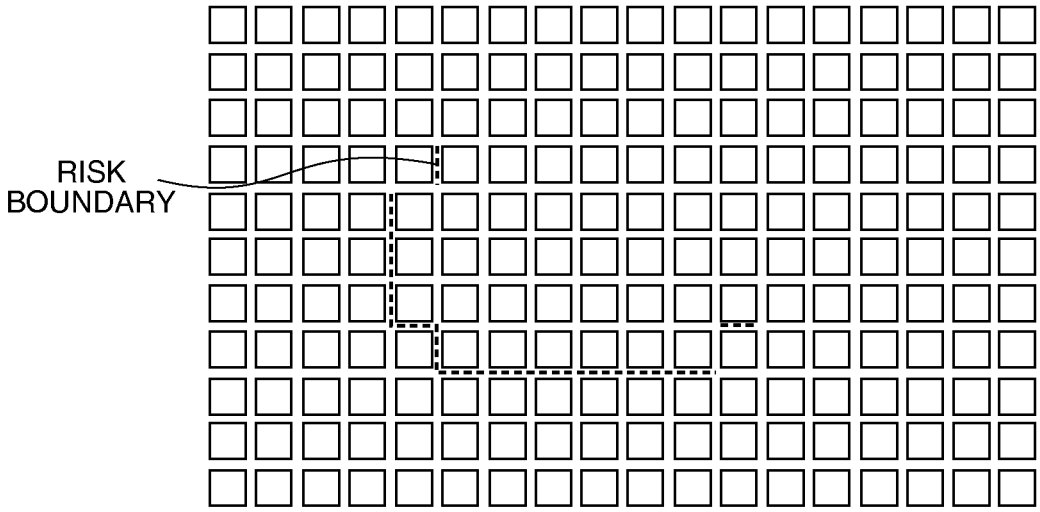
FIG. 13C DETECTION OF APPLIED BOUNDARY + RISK BOUNDARY
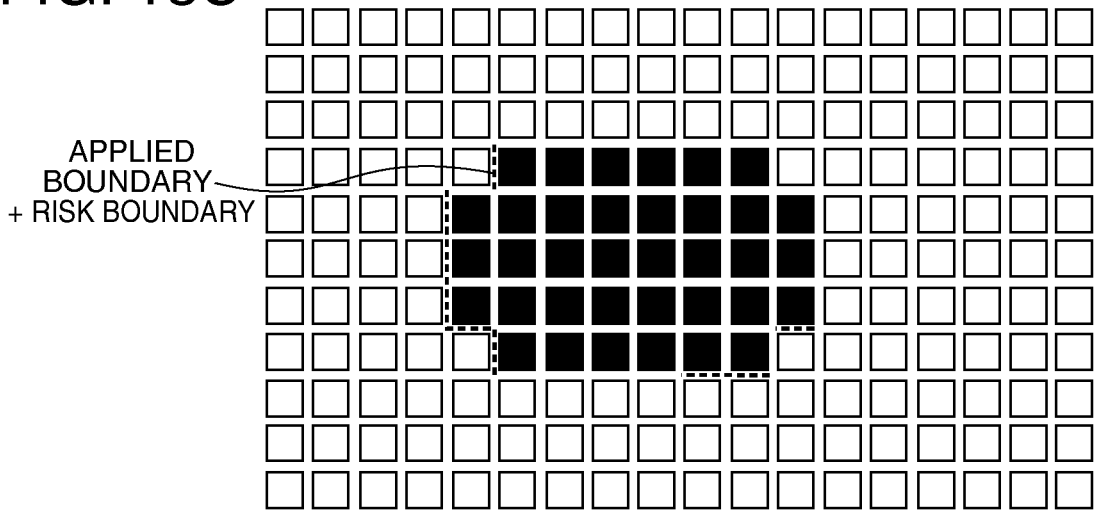

FIG. 14A CORRECTION PROCESS (LOW ELECTRIC POTENTIAL, ONE TARGET PIXEL, $\theta$b = 45 DEGREES)
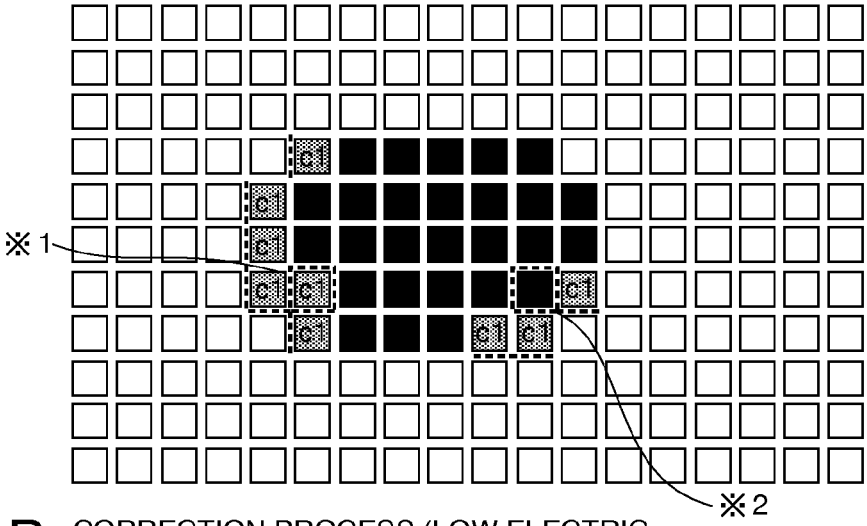
FIG. 14B CORRECTION PROCESS (LOW ELECTRIC POTENTIAL, ONE TARGET PIXEL, $\theta$b = 90 DEGREES)
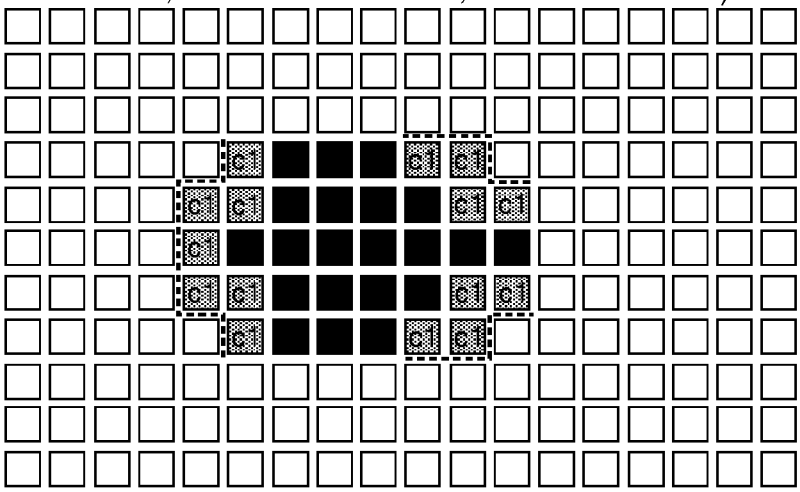
FIG. 14C CORRECTION PROCESS (LOW ELECTRIC POTENTIAL, ONE TARGET PIXEL, $\theta$b = 225 DEGREES)
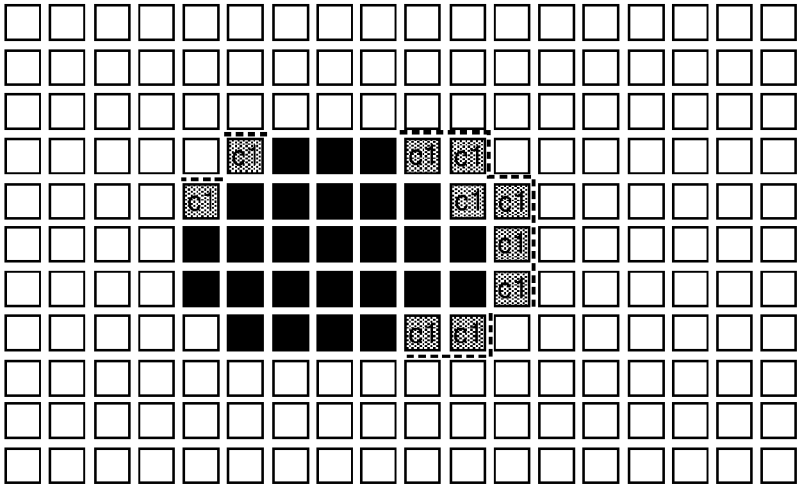

FIG. 15A CORRECTION PROCESS (FRAME n+1)
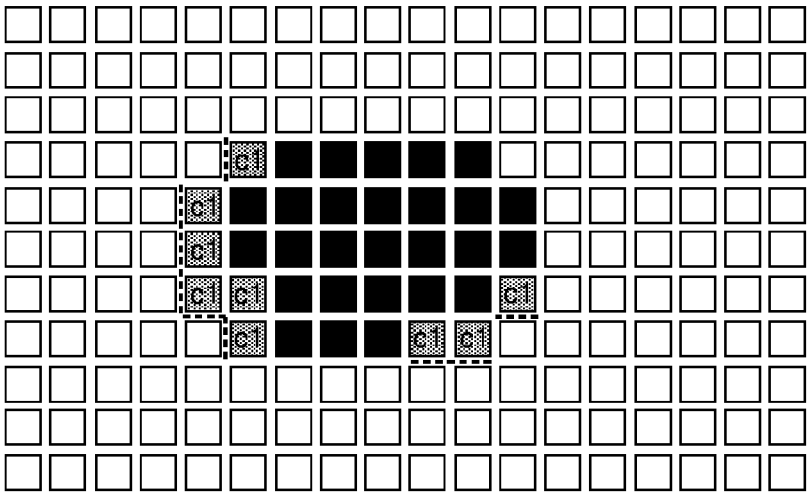
FIG. 15B NO CORRECTION (FRAME n+2)
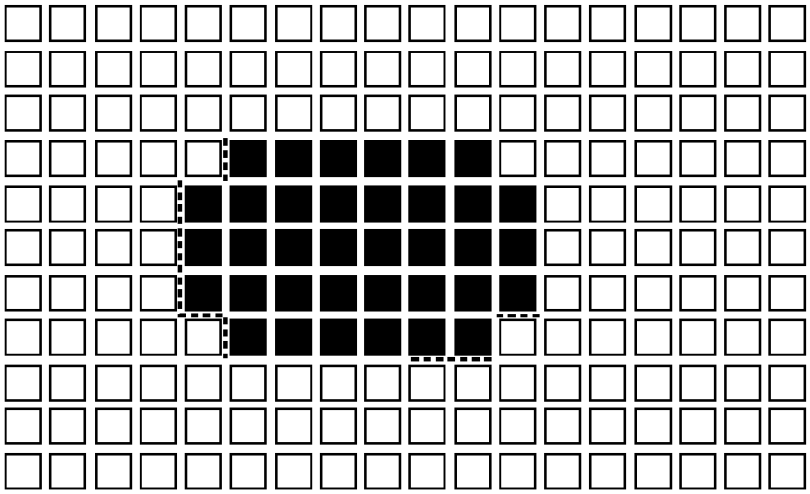
FIG. 15C NO CORRECTION (FRAME n+3)
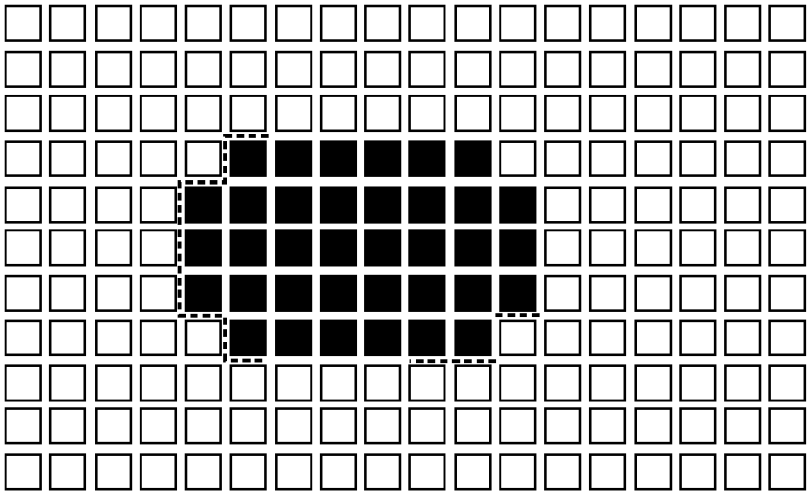

FIG. 16A CORRECTION PROCESS (FRAME n+4)
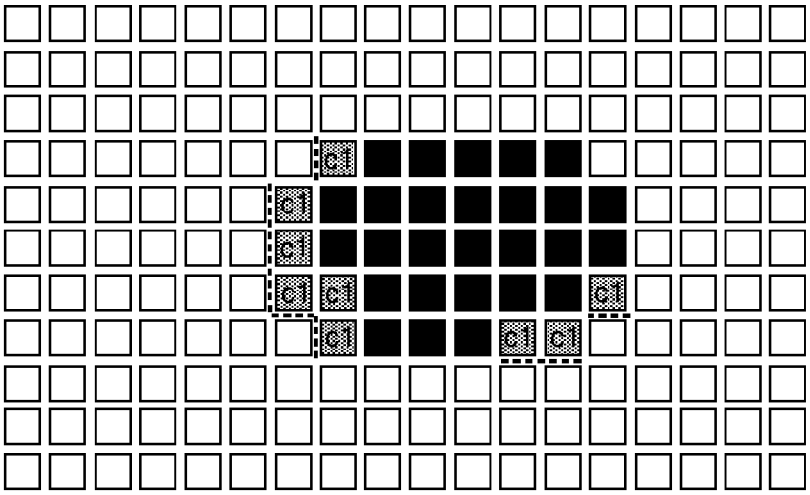
FIG. 16B NO CORRECTION (FRAME n+5)
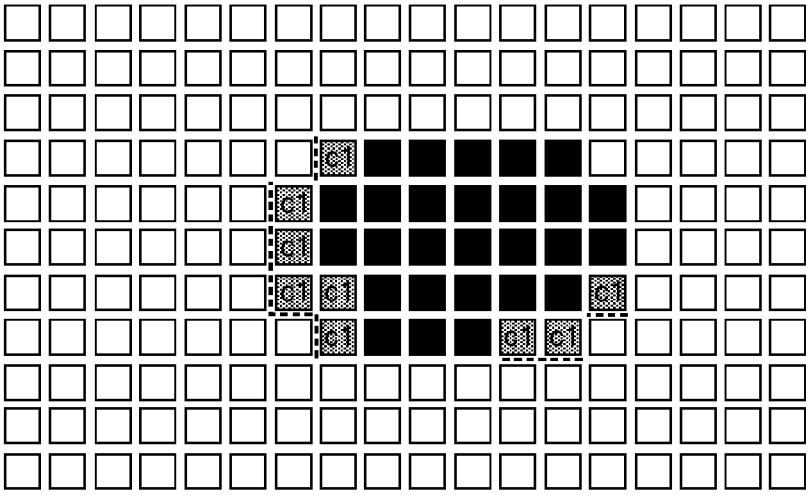
FIG. 16C NO CORRECTION (FRAME n+6)
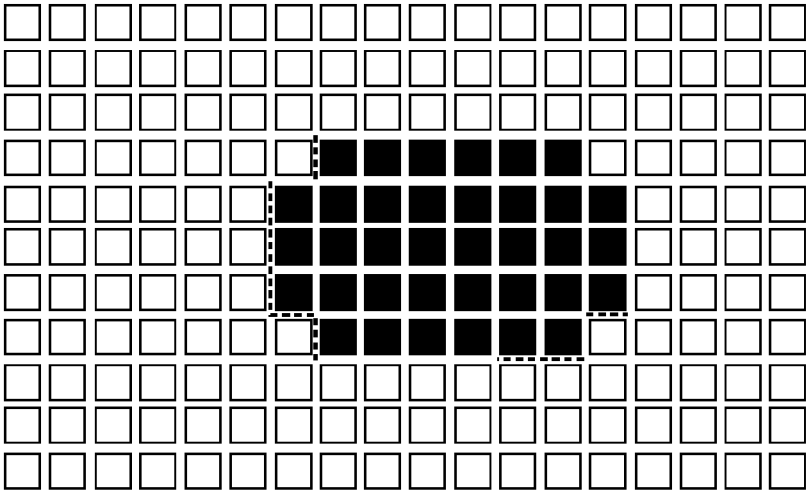

FIG. 19A CORRECTION PROCESS (LOW ELECTRIC POTENTIAL, ONE TARGET PIXEL, $\theta b$ = 45 DEGREES)
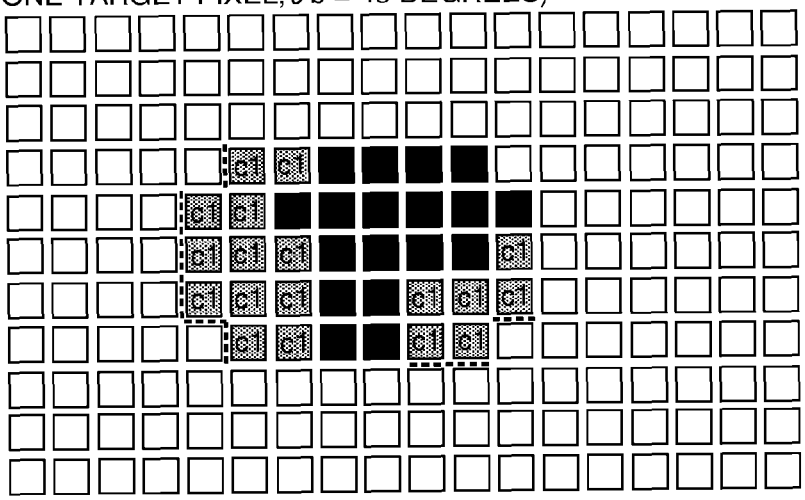
FIG. 19B CORRECTION PROCESS (LOW ELECTRIC POTENTIAL, ONE TARGET PIXEL, $\theta b$ = 90 DEGREES)
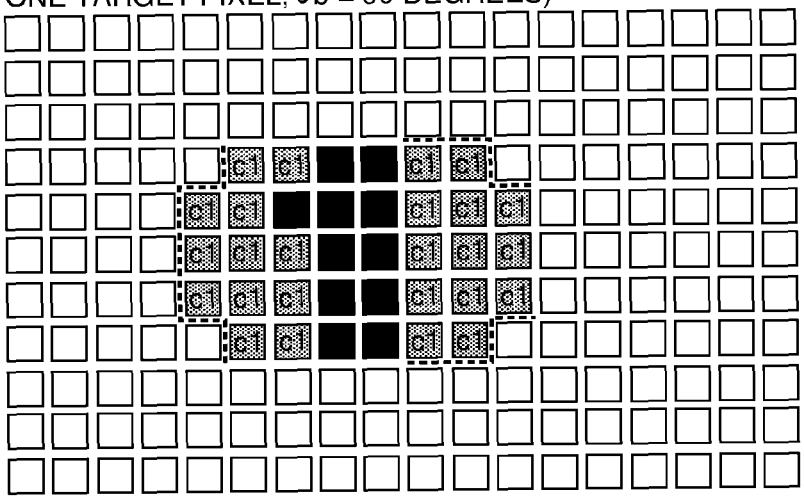
FIG. 19C CORRECTION PROCESS (LOW ELECTRIC POTENTIAL, ONE TARGET PIXEL, $\theta b$ = 225 DEGREES)
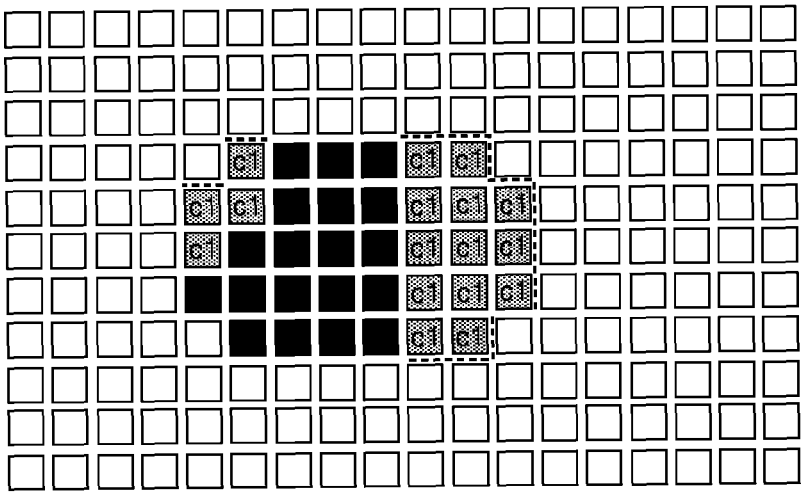

FIG. 20A CORRECTION PROCESS (FRAME n+1)
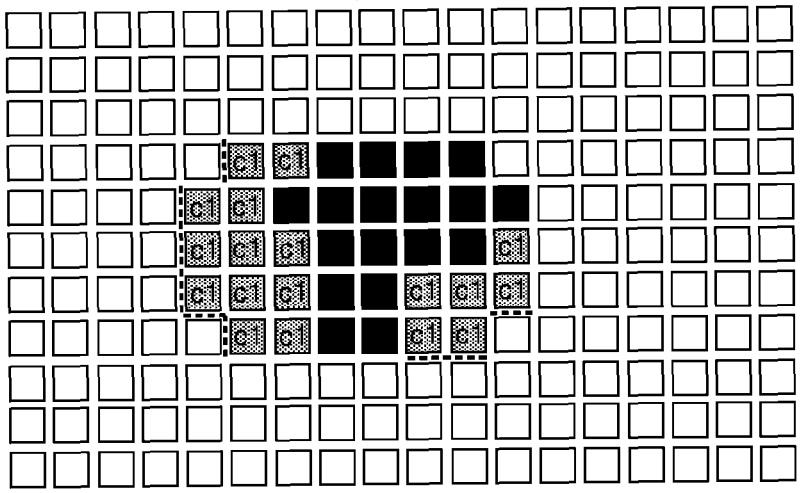
FIG. 20B NO CORRECTION (FRAME n+2)
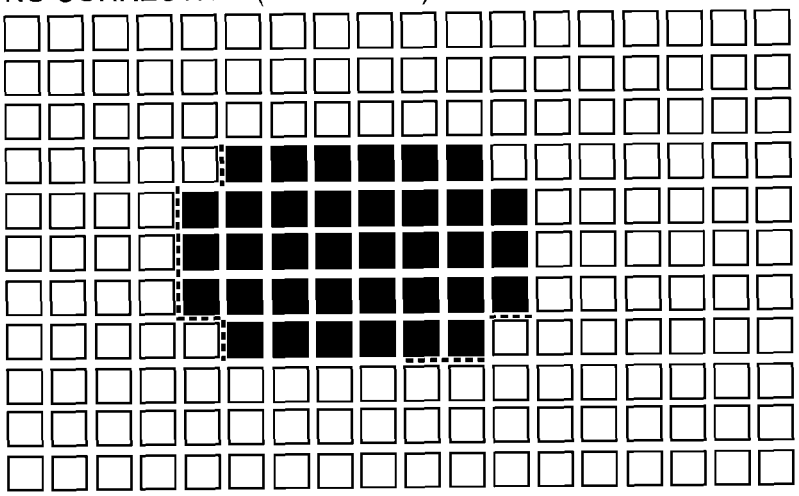
FIG. 20C NO CORRECTION (FRAME n+3)
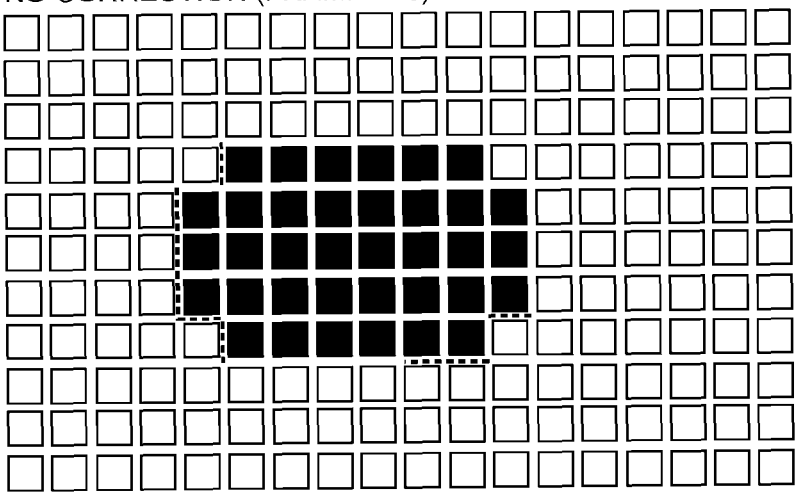

FIG. 21A CORRECTION PROCESS (HIGH ELECTRIC POTENTIAL, ONE TARGET PIXEL, $\theta b = 45$ DEGREES)
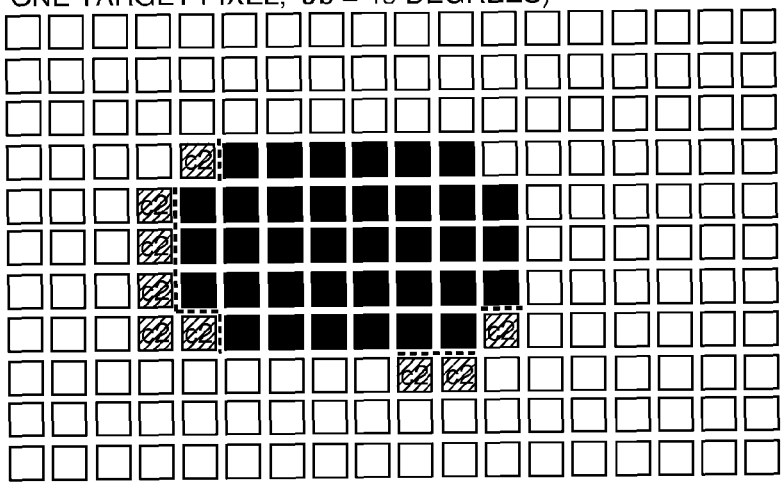
FIG. 21B CORRECTION PROCESS (HIGH ELECTRIC POTENTIAL, ONE TARGET PIXEL, $\theta b = 90$ DEGREES)
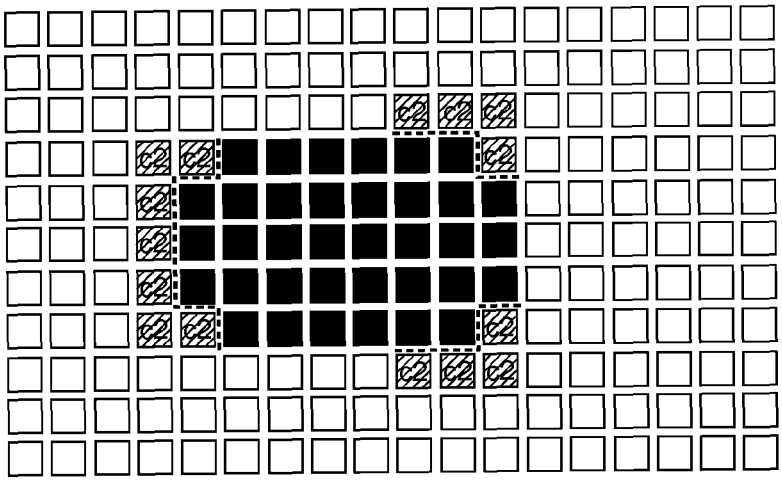
FIG. 21C CORRECTION PROCESS (HIGH ELECTRIC POTENTIAL, ONE TARGET PIXEL, $\theta b = 225$ DEGREES)
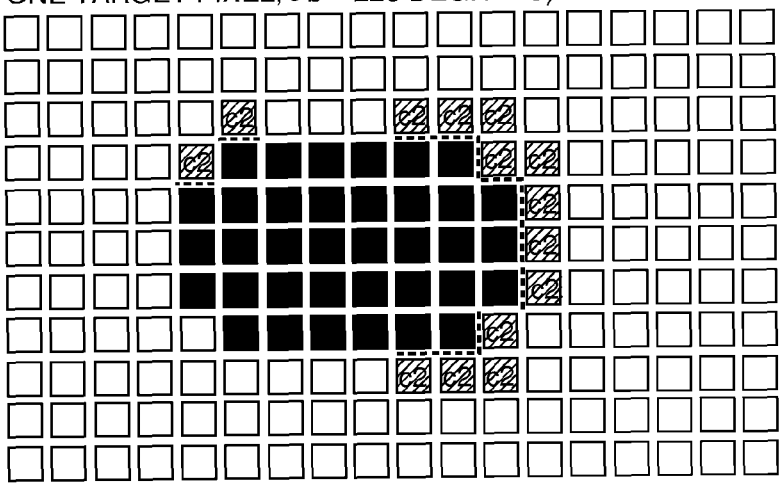

FIG. 22A CORRECTION PROCESS (FRAME n+1)
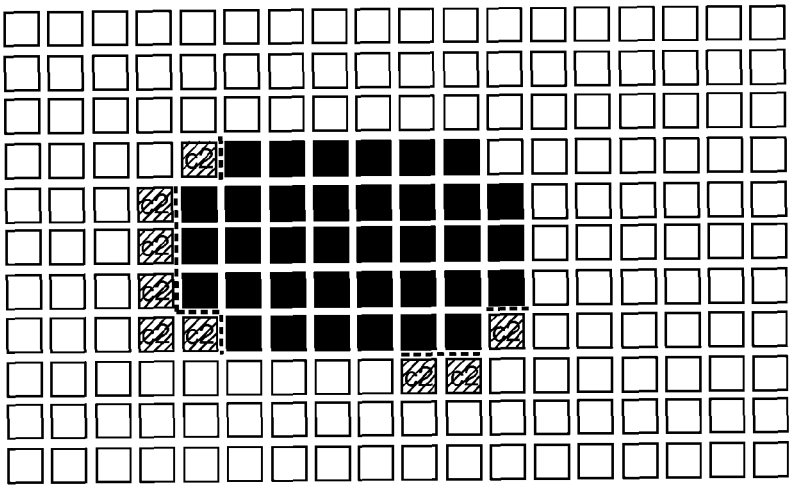
FIG. 22B NO CORRECTION (FRAME n+2)
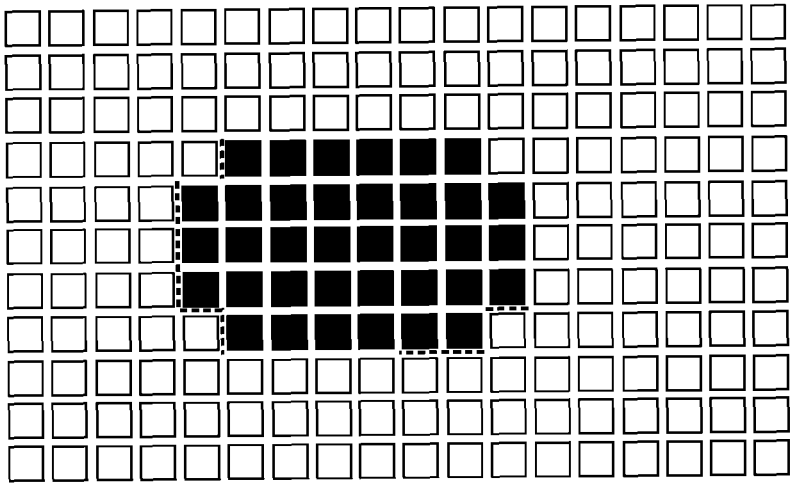
FIG. 22C NO CORRECTION (FRAME n+3)
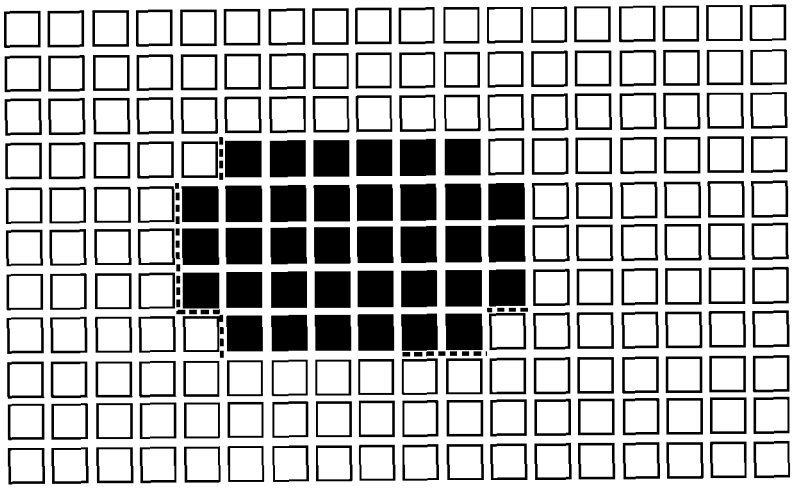

FIG. 23A CORRECTION PROCESS (HIGH ELECTRIC POTENTIAL, TWO TARGET PIXELS, $\theta b$ = 45 DEGREES)
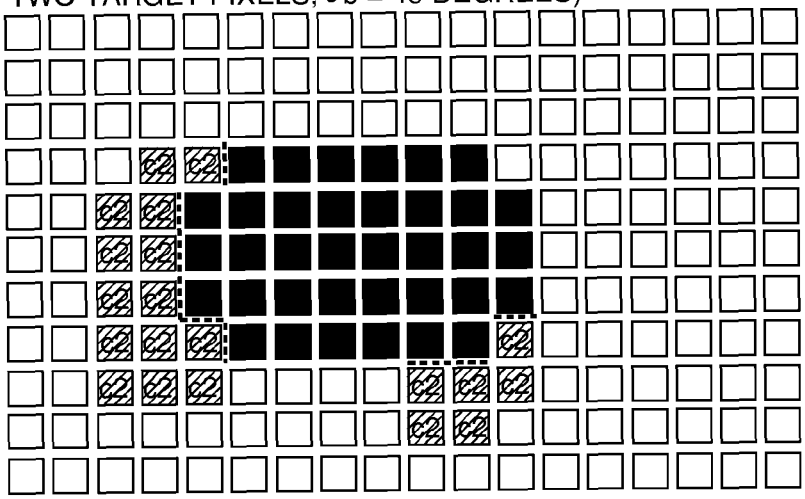
FIG. 23B CORRECTION PROCESS (HIGH ELECTRIC POTENTIAL, TWO TARGET PIXELS, $\theta b$ = 90 DEGREES)
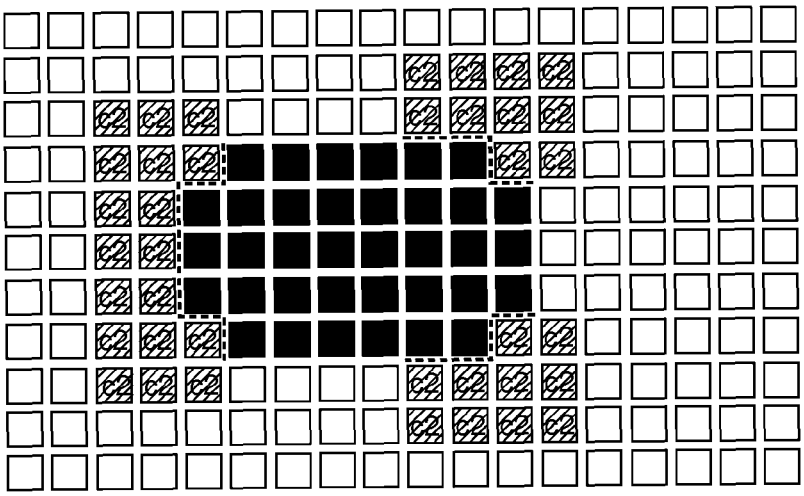
FIG. 23C CORRECTION PROCESS (HIGH ELECTRIC POTENTIAL, TWO TARGET PIXELS, $\theta b$ = 225 DEGREES)
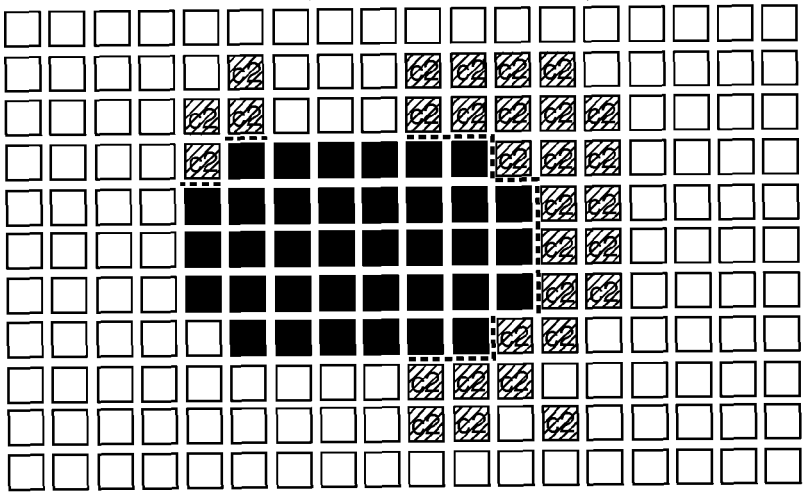

FIG. 24A CORRECTION PROCESS (FRAME n+1)
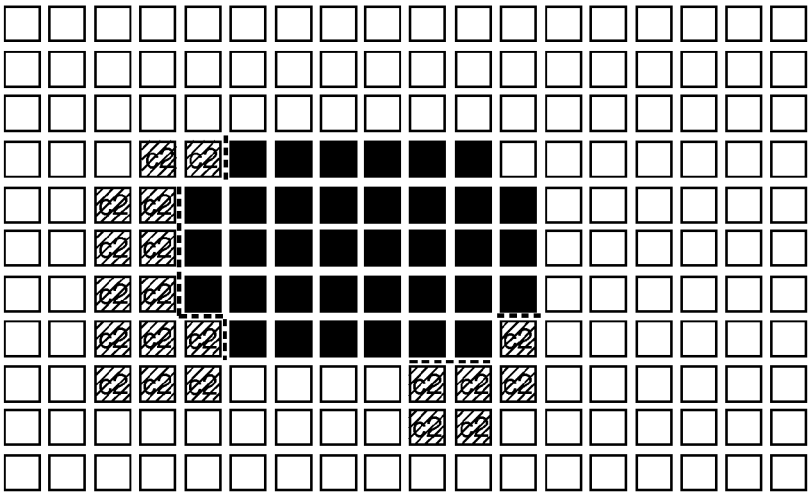
FIG. 24B NO CORRECTION (FRAME n+2)
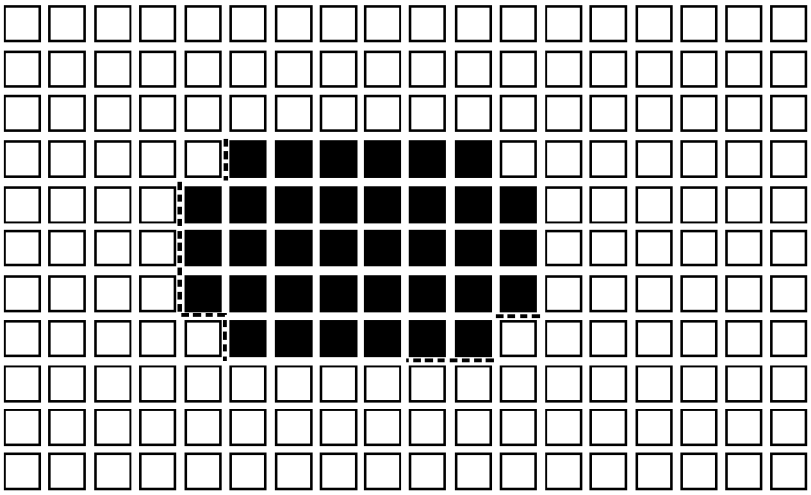
FIG. 24C NO CORRECTION (FRAME n+3)
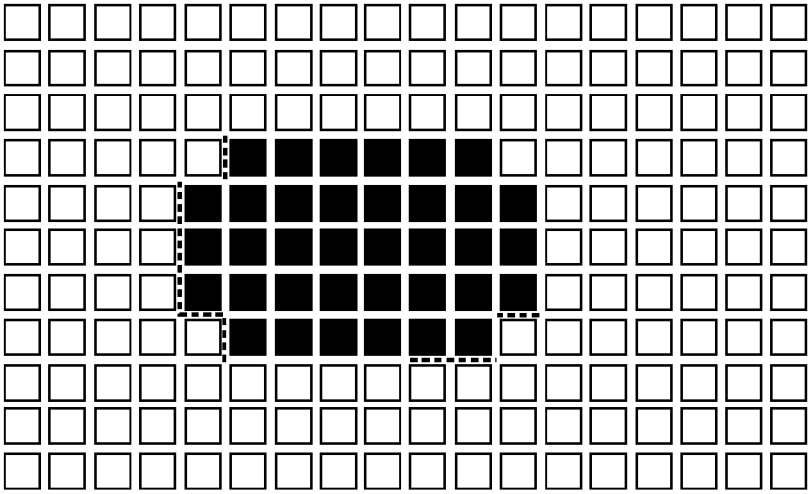

FIG. 26A

CORRECTION PROCESS (LOW ELECTRIC POTENTIAL · ONE TARGET PIXEL + HIGH ELECTRIC POTENTIAL · ONE TARGET PIXEL, $\theta b = 45$ DEGREES)

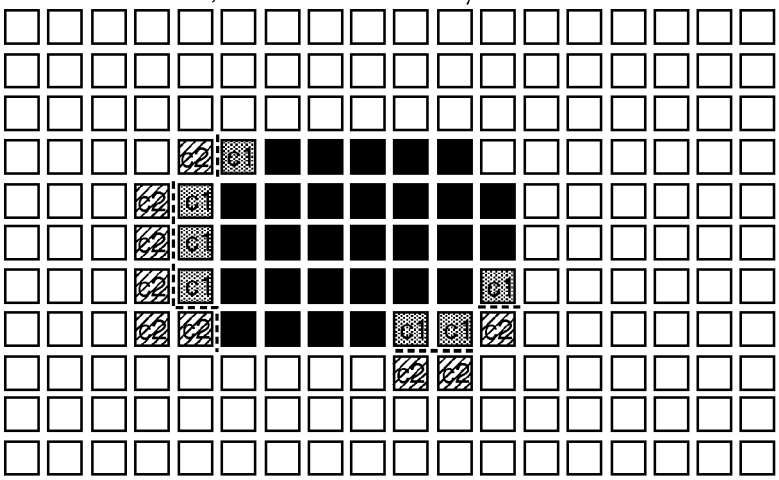

FIG. 26B

CORRECTION PROCESS (LOW ELECTRIC POTENTIAL · ONE TARGET PIXEL + HIGH ELECTRIC POTENTIAL · ONE TARGET PIXEL, $\theta b = 90$ DEGREES)

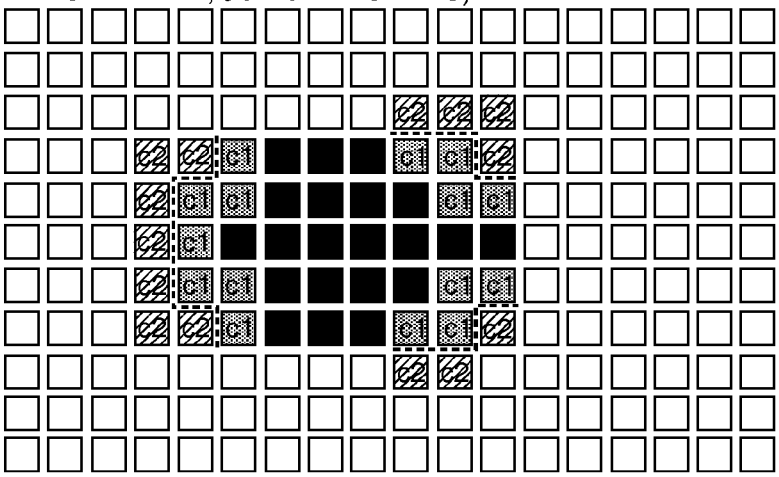

FIG. 26C

CORRECTION PROCESS (LOW ELECTRIC POTENTIAL · ONE TARGET PIXEL + HIGH ELECTRIC POTENTIAL · ONE TARGET PIXEL, $\theta b = 225$ DEGREES)

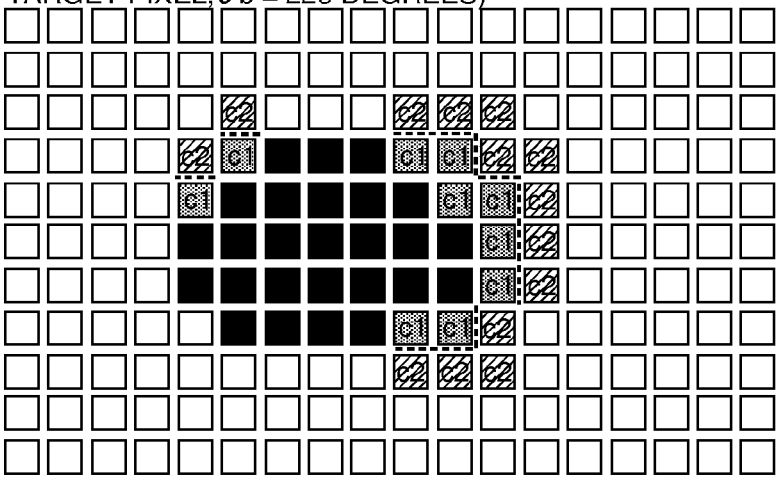

FIG. 27A CORRECTION PROCESS (FRAME n+1)
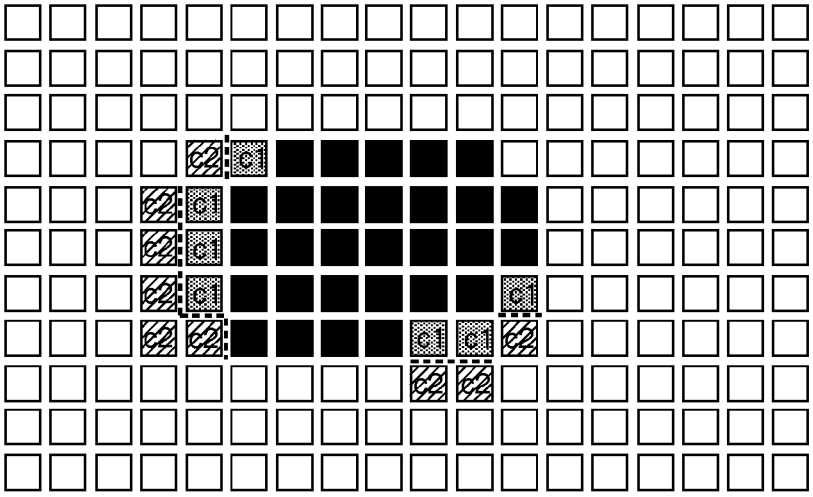
FIG. 27B NO CORRECTION (FRAME n+2)
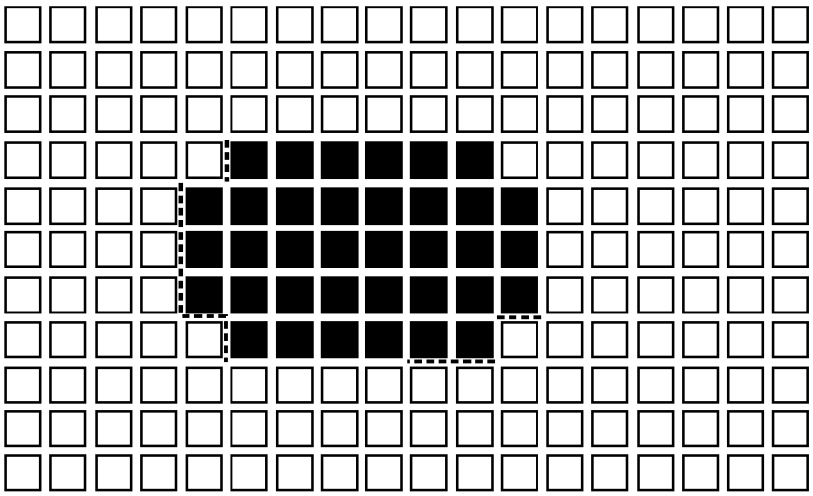
FIG. 27C NO CORRECTION (FRAME n+3)
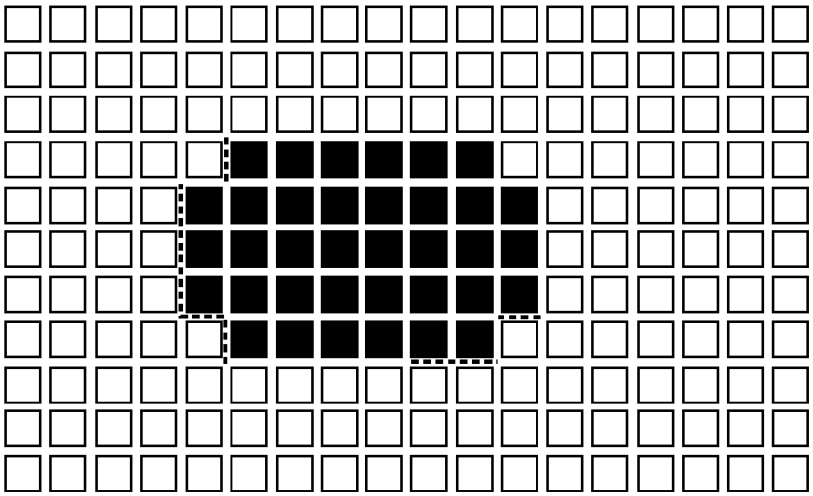

FIG. 28A

CORRECTION PROCESS (LOW ELECTRIC POTENTIAL· TWO TARGET PIXEL + HIGH ELECTRIC POTENTIAL· TWO TARGET PIXEL, $\theta$b = 45 DEGREES)

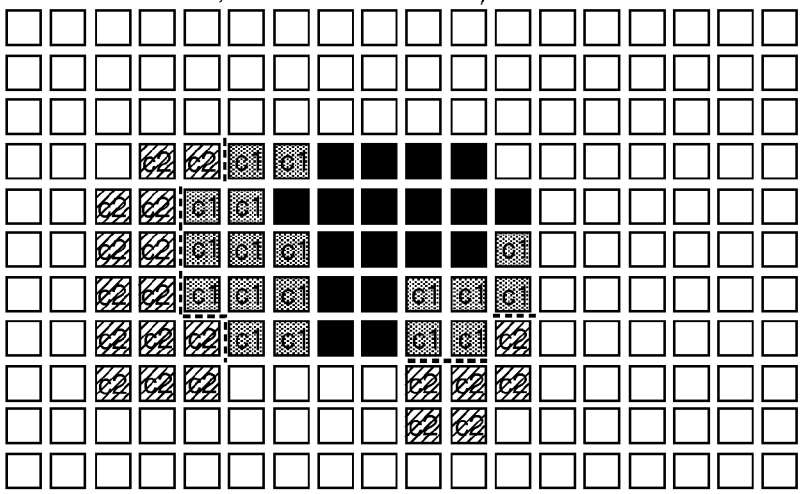

FIG. 28B

CORRECTION PROCESS (LOW ELECTRIC POTENTIAL· TWO TARGET PIXEL + HIGH ELECTRIC POTENTIAL · TWO TARGET PIXEL, $\theta$b = 90 DEGREES)

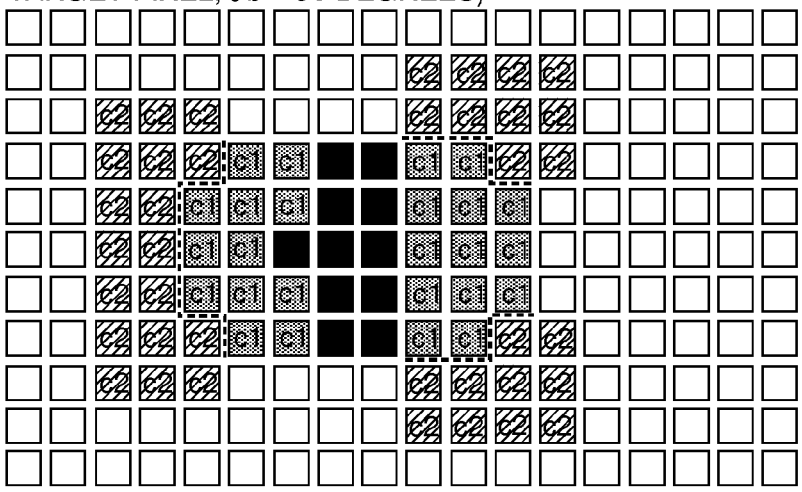

FIG. 28C

CORRECTION PROCESS (LOW ELECTRIC POTENTIAL· TWO TARGET PIXEL + HIGH ELECTRIC POTENTIAL· TWO TARGET PIXEL, $\theta$b = 225 DEGREES)

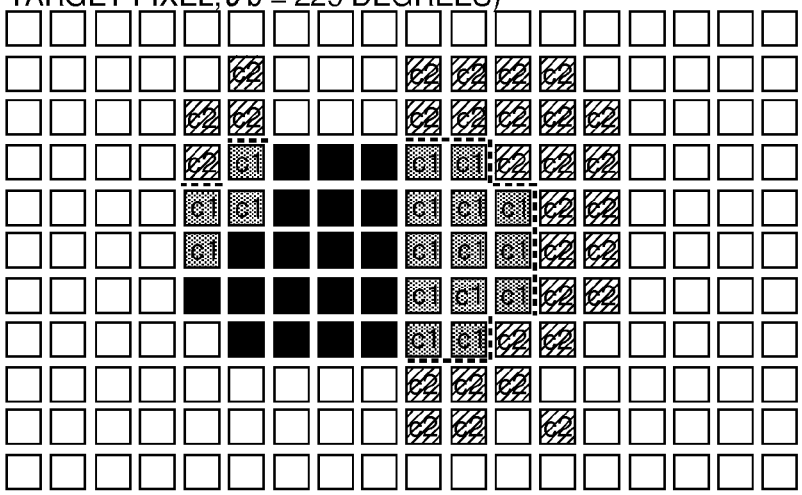

FIG. 29A CORRECTION PROCESS (FRAME n+1)
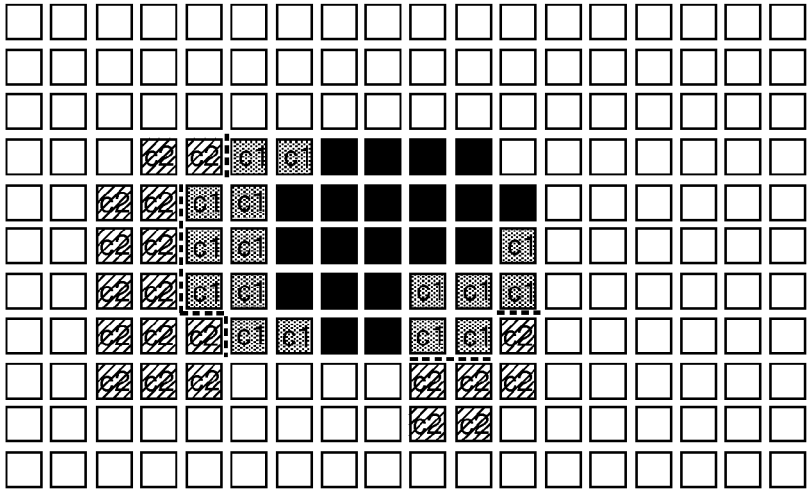
FIG. 29B NO CORRECTION (FRAME n+2)
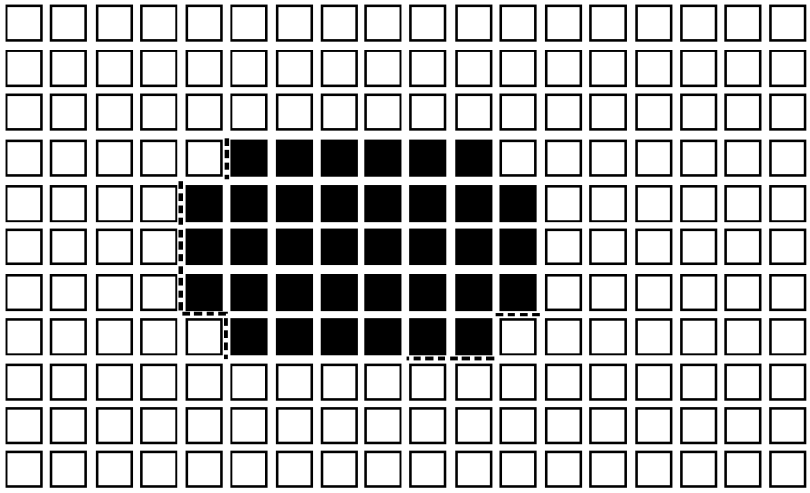
FIG. 29C NO CORRECTION (FRAME n+3)
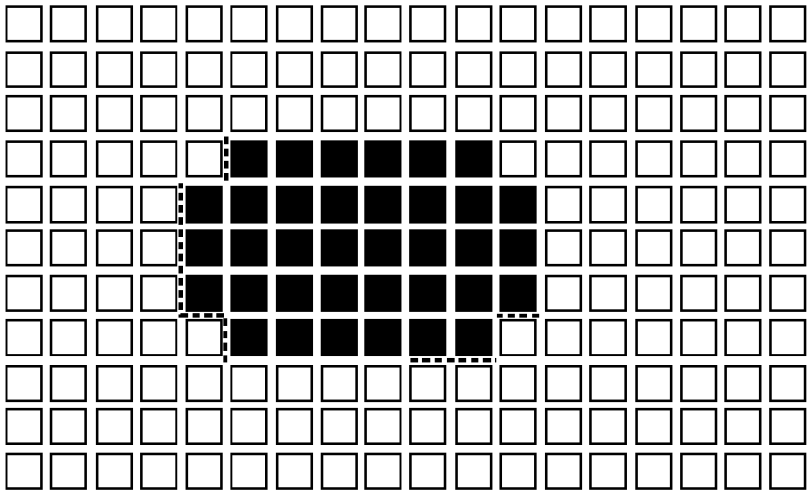

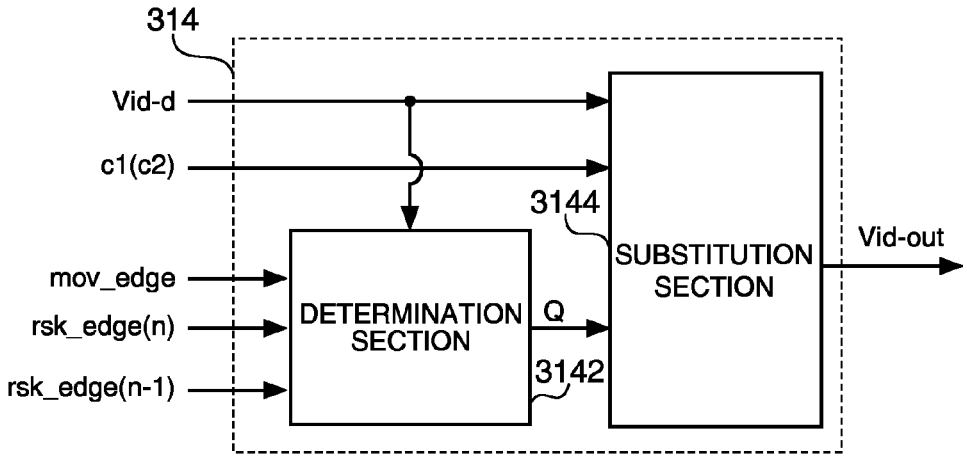
FIG. 31
FIG. 32A
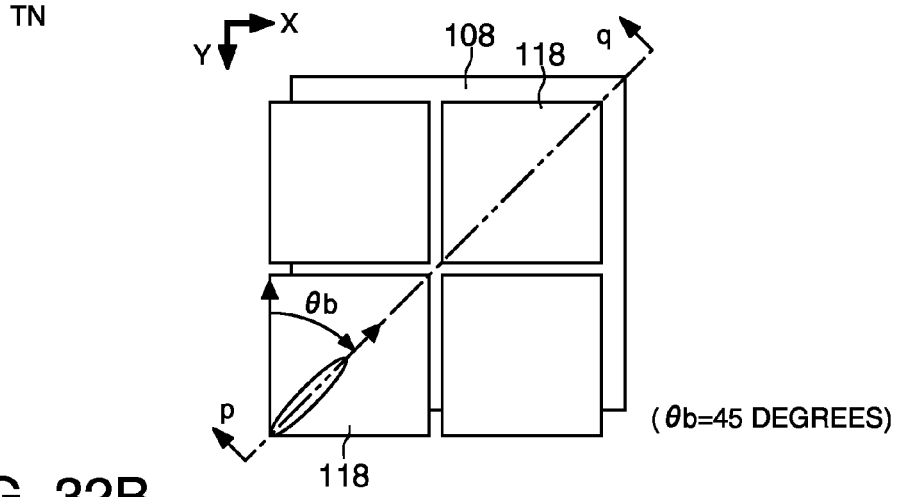
FIG. 32B
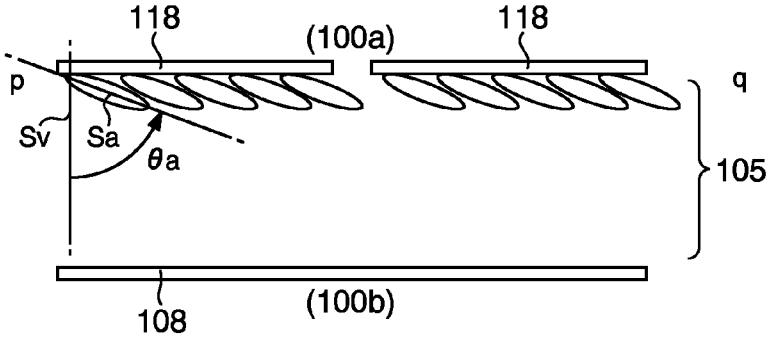

LIQUID CRYSTAL PIXEL CORRECTION USING PIXEL BOUNDARY DETECTION

BACKGROUND

1. Technical Field

The present invention relates to a technique for reducing display defects on a liquid crystal panel.

2. Related Art

A liquid crystal panel has a configuration in which a liquid crystal is interposed between one pair of substrates maintained so as to be separated from each other by a constant gap. Described in detail, the liquid crystal panel has a configuration in which pixel electrodes for pixels are arranged in a matrix pattern on one substrate, a common electrode is disposed so as to be common to the pixels on the other substrate, and a liquid crystal is interposed between the pixel electrodes and the common electrode. When a voltage according to a gray scale level is applied and maintained between the pixel electrode and the common electrode, the alignment state of the liquid crystal is defined for each pixel, and thereby the transmittance or the reflectance is controlled. Thus, in the above-described configuration, only a component of an electric field applied to liquid crystal molecules in a direction from the pixel electrodes to the common electrode (or in the opposite direction), that is, in a direction perpendicular to a substrate surface (vertical direction) contributes to display control.

However, in a case where the pixel pitch has become narrow due to a recent trend of reduction in size and higher precision, an electric field that is generated between pixel electrodes adjacent to each other, that is, an electric field is generated in a direction parallel to the substrate surface (lateral direction), and the effect thereof is becoming such that it is no longer negligible. For example, if a lateral direction electric field is applied to a liquid crystal to be driven by a vertical electric field, such as a VA (Vertical Alignment) type or a TN (Twisted Nematic) type, a defect in the alignment of the liquid crystal (that is, reverse tilt domain) occurs, thereby causing a display defect.

In order to reduce the effect of the reverse tilt domain, a technique of contriving the structure of a liquid crystal panel, for example, by defining the shape of a light shielding layer (opening portion) in accordance with the pixel electrodes (for example, see JP-A-6-34965 (FIG. 1)), a technique of clipping a video signal having a set value or more based on a determination that the reverse tilt domain occurs in a case where the average luminance value calculated from video signals is equal to or less than a threshold value (for example, see JP-A-2009-69608 (FIG. 2)), and the like are proposed.

However, according to the technique of reducing the reverse tilt domain by means of the structure of the liquid crystal panel, the aperture ratio can be easily decreased. Furthermore, there is a problem in that it is difficult to apply the technique to a liquid crystal panel that has already been manufactured without taking the structure thereof into account. On the other hand, according to the technique of clipping a video signal having a set value or more, there is a problem in that the brightness of a displayed image is limited to the set value.

SUMMARY

An advantage of some aspects of the invention is that it provides a technique that reduces the reverse tilt domain while resolving the above-described problems.

An aspect of the invention is directed to a method of processing a video in which an input video signal designating an application voltage of a liquid crystal element for each pixel is corrected, and the application voltage of the liquid crystal element is defined based on the corrected video signal in a video processing circuit. The method includes: detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage; detecting a risk boundary that is a part of the boundaries between the first pixel and the second pixel designated by the input video signal and is determined based on a tilt azimuth of the liquid crystal for each of a plurality of frames including the current frame to k frames (here, k is a natural number) following the current frame; and correcting the video signal designating the application voltage of the liquid crystal element corresponding to the pixel of a frame that is brought into contact with the risk boundary detected in the detecting of a risk boundary out of a plurality of frames such that a lateral direction electric field generated by the first pixel and the second pixel decreases for at least one of the first pixel and the second pixel that are brought into contact with the risk boundary detected in accordance with the video signal of the current frame in the detecting of a boundary out of the boundary detected in the detecting of a boundary. According to the above-described aspect, the structure of the liquid crystal panel does not need to be changed. Accordingly, the aperture ratio does not decrease, and the aspect can be applied to a liquid crystal panel that has already been manufactured without taking the structure into consideration. In addition, the application voltages of liquid crystal elements corresponding to at least one side of the first pixel and the second pixels out of pixels brought into contact with the risk boundary changing over the frame that is one frame before the current frame and the current frame are corrected so as to decrease a lateral direction electric field from the value corresponding to the gray scale level designated by the video signal. Accordingly, the brightness of the displayed image is not limited to a set value. Furthermore, according to the above-described aspect, the application voltages used for decreasing the lateral direction electric field are corrected for the pixels brought into contact with the risk boundary of the video signals of a plurality of frames from the current frame to k frames following the current frame. Therefore, even in a case where the time interval for updating the display of the liquid crystal panel is shortened with respect to the response time of the liquid crystal due to an increase in the driving speed of the liquid crystal panel such as double speed or quadruple speed, an advantage of decreasing the reverse tilt domain is acquired.

In the above-described aspect, it is preferable that, in a case where a response time of the liquid crystal is T, and a time interval for updating a display of the liquid crystal panel including the liquid crystal element is S, a relationship of $T \leq S \times k$ is satisfied. In such a case, an advantage of decreasing the reverse tilt domain is acquired, and a change in the input video signal can be suppressed.

In addition, in the above-described aspect, in the correcting of the video signal, in a case where the application voltage of the liquid crystal element corresponding to the first pixel brought into contact with the risk boundary detected in accordance with the video signal of the frame that is brought into contact with the risk boundary is lower than a third voltage which is lower than the first voltage, the application voltage may be corrected to be equal to or higher than the third voltage. In such a case, out of pixels brought into contact with the risk boundary, the application voltage of the liquid crystal element corresponding to the first pixel is corrected to a voltage equal to or higher than the third voltage from a voltage corresponding to the gray scale level designated by the video signal. Accordingly, the brightness of a displayed image is not limited to a set value.

Furthermore, in the correcting of the video signal, out of two or more of the first pixels corresponding to a number defined in advance that are consecutive on a side opposite to the risk boundary from the first pixel that is brought into contact with the risk boundary detected in accordance with the video signal of the frame brought into contact with the risk boundary, the first pixel of which the application voltage is lower than a third voltage which is lower than the first voltage may be corrected such that the application voltage is equal to or higher than the third voltage. In such a case, a change in the application voltage due to the correction of the video signal may not visually noticeable. In addition, the continuation of the unstable state of the liquid crystal molecules in the next updating process (rewriting) can be suppressed.

In addition, in the correcting of the video signal, the application voltage of the liquid crystal element corresponding to the second pixel that is brought into contact with the risk boundary detected in accordance with the video signal of the frame brought into contact with the risk boundary may be corrected to a fourth voltage that is higher than the first voltage and is lower than the second voltage. In such a case, out of pixels brought into contact with the boundary, the application voltage of the liquid crystal element corresponding to the second pixel is corrected to be lower than the second voltage from a value corresponding to the gray scale level designated by the video signal. Accordingly, the brightness of a displayed image is not limited to a set value.

Furthermore, in the correcting of the video signal, the application voltages of the liquid crystal elements corresponding to two or more of the second pixels corresponding to a number defined in advance that are consecutive on a side opposite to the risk boundary from the second pixel that is brought into contact with the risk boundary detected in accordance with the video signal of the frame brought into contact with the risk boundary may be corrected to a fourth voltage that is higher than the first voltage and is lower than the second voltage. In such a case, a change in the application voltage due to the correction of the video signal may be visually unnoticeable.

In addition, in the correcting of the video signal, it is preferable that, out of the boundary detected in the detecting of a boundary, the pixel that is brought into contact with the risk boundary that moves by one pixel is set as a correction target for decreasing a lateral direction electric field. In such a case, the influence of the reverse tilt domain may be easily received. Furthermore, since the trailing phenomenon is intensively corrected for a visually-noticeable position, the change in the input video signal can be suppressed.

Furthermore, other than the method of processing a video, an aspect of the invention can be conceived as a video processing circuit, a liquid crystal display device, and an electronic apparatus that includes the liquid crystal display device.

BRIEF DESCRIPTION OF THE DRAWINGS

The invention will be described with reference to the accompanying drawings, wherein like numbers reference like elements.

FIGS. 13A to 13C are diagrams showing the sequence of detection of a risk boundary in the video processing circuit.

FIGS. 14A to 14C are diagrams showing a correction process of the video processing circuit.

FIGS. 15A to 15C are diagrams showing the correction process of the video processing circuit.

FIGS. 16A to 16C are diagrams showing the correction process of the video processing circuit.

FIGS. 19A to 19C are diagrams showing a correction process in a video processing circuit according to a second embodiment of the invention.

FIGS. 20A to 20C are diagrams showing the correction process in the video processing circuit according to the second embodiment.

FIGS. 21A to 21C are diagrams showing the configuration of a video processing circuit according to a third embodiment of the invention.

FIGS. 22A to 22C are diagrams showing a correction process in the video processing circuit according to the third embodiment.

FIGS. 23A to 23C are diagrams showing a correction process in a video processing circuit according to the fourth embodiment of the invention.

FIGS. 24A to 24C are diagrams showing the correction process in the video processing circuit according to the fourth embodiment.

FIGS. 26A to 26C are diagrams showing a correction process in the video processing circuit according to the fifth embodiment.

FIGS. 27A to 27C are diagrams showing the correction process in the video processing circuit according to the fifth embodiment.

FIGS. 28A to 28C are diagrams showing a correction process in a video processing circuit according to a sixth embodiment of the invention.

FIGS. 29A to 29C are diagrams showing the correction process in the video processing circuit according to the sixth embodiment.

FIG. 31 is a diagram showing the configuration of a correction unit of the video processing circuit according to the seventh embodiment.

FIGS. 32A and 32B are diagrams illustrating the initial alignment in a case where the liquid crystal panel is configured as a TN type.

DESCRIPTION OF EXEMPLARY EMBODIMENTS

First Embodiment

Hereinafter, embodiments of the invention will be described with reference to the accompanying drawings.

First, a first embodiment of the invention will be described.

Figure 1:
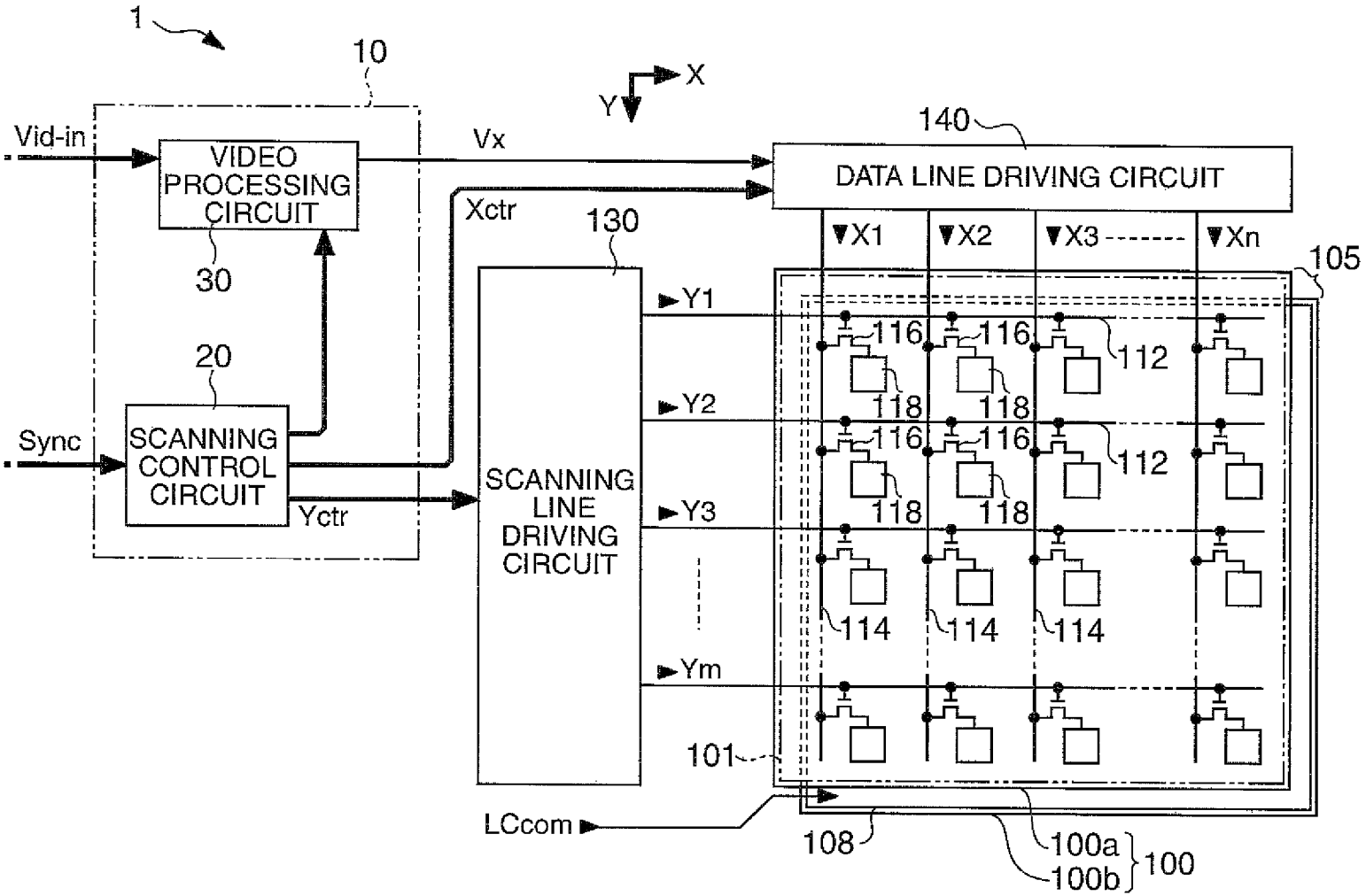
FIG. 1 is a diagram showing a liquid crystal display device to which a video processing circuit according to an embodiment of the invention is applied.

FIG. 1 is a block diagram showing the entire configuration of a liquid crystal display device 1 to which a video processing circuit according to this embodiment of the invention is applied.

As shown in FIG. 1, a liquid crystal display device 1 includes a control circuit 10, a liquid crystal panel 100, a scanning line driving circuit 130, and a data line driving circuit 140. A video signal Vid-in is supplied to the control circuit 10 from a higher-level device in synchronization with a synchronization signal Sync. The video signal Vid-in is digital data that designates a gray scale level of each pixel in the liquid crystal panel 100 and is supplied in the scanning order based on a vertical scanning signal, a horizontal scanning signal and a dot clock signal (not shown in the figure) that are included in the synchronization signal Sync. In this embodiment, the frequency of the supplied video signal Vid-in is 60 Hz, and the video signal Vid-in that represents an image of one frame is supplied at the period of 16.67 milliseconds, which is the reciprocal of the frequency of the video signal. The video signal Vid-in designates a gray scale level of a pixel. However, since a voltage applied to a liquid crystal element is determined in accordance with the gray scale level, the voltage applied to the liquid crystal element may be regarded as designated by the video signal Vid-in.

The control circuit 10 includes a scan control circuit 20 and a video processing circuit 30. Here, the scan control circuit 20 generates a variety of control signals and controls each unit in synchronization with the synchronization signal Sync. The video processing circuit 30, to be described later in detail, processes the digital video signal Vid-in and outputs an analog data signal Vx.

The liquid crystal panel 100 is configured such that a component substrate (first substrate) 100*a* and an opposing substrate (second substrate) 100*b* are bonded to each other with a constant gap maintained therebetween and a liquid crystal 105 driven in accordance with a vertically-directed electric field is interposed in the gap. On a face of the component substrate 100*a* that faces the opposing substrate 100*b*, a plurality of scanning lines 112 of m rows is disposed in the X (lateral) direction in the figure, and a plurality of data lines 114 of n columns is disposed in the Y (vertical) direction so as to be electrically insulated from the scanning lines 112. In this embodiment, in order to identify the scanning lines 112, the scanning lines 112 may be referred to as the first, second, third, . . . , (m−1)-th, and m-th scanning lines, in the order from the upper side in the figure. Similarly, in order to identify the data lines 114, the data lines 114 may be referred to as the first, second, third, . . . , (n−1)-th, and n-th data lines, in the order from the left side in the figure.

In the component substrate 100*a*, a set of an n-channel TFT 116 and a transparent pixel electrode 118 having a rectangular shape is disposed in correspondence with each of intersections between the scanning lines 112 and the data lines 114. A gate electrode of the TFT 116 is connected to the scanning line 112, a source electrode thereof is connected to the data line 114, and a drain electrode thereof is connected to the pixel electrode 118. On the other hand, over the entire face of the opposing substrate 100*b* that faces the component substrate 100*a*, a transparent common electrode 108 is disposed. A voltage LCcom is applied to the common electrode 108 by a circuit not shown in the figure.

In FIG. 1, the opposing face of the component substrate 100*a* is the rear side of the sheet. Thus, the scanning lines 112, the data lines 114, the TFTs 116 and the pixel electrodes 118 disposed on the opposing face are supposed to be denoted by broken lines, but are denoted by solid lines for ease of viewing.

Figure 2:
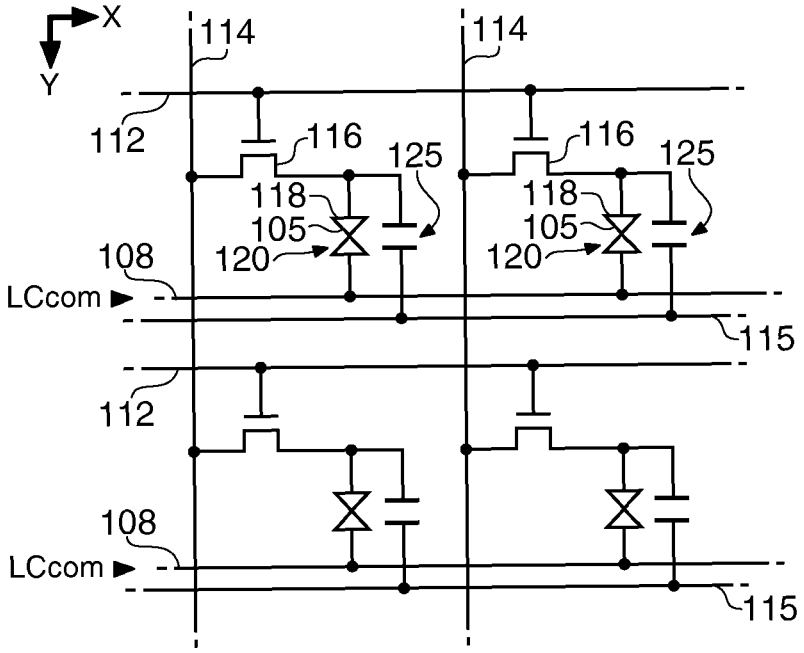
FIG. 2 is a diagram showing an equivalent circuit of a liquid crystal element of the liquid crystal display device.

FIG. 2 is a diagram showing an equivalent circuit of the liquid crystal panel 100.

As shown in FIG. 2, the liquid crystal panel 100 is configured such that liquid crystal elements 120 each acquired by interposing a liquid crystal 105 between the pixel electrode 118 and the common electrode 108 are arranged in correspondence with the intersections of the scanning lines 112 and the data line 114. Although not shown in FIG. 1, in the equivalent circuit of the liquid crystal panel 100, as shown in FIG. 2, auxiliary capacitors (storage capacitors) 125 are actually disposed in parallel with the liquid crystal elements 120. The auxiliary capacitor 125 has one end connected to the pixel electrode 118 and the other end commonly connected to a capacitor line 115. The capacitor line 115 is maintained at a voltage that is constant in time.

Here, when the scanning line 112 is at a level H, the TFT 116 having the gate electrode being connected to the scanning line 112 is turned on, and the pixel electrode 118 is connected to the data line 114. Thus, when the scanning line 112 is at the level H, in a case where a data signal of a voltage according to a gray scale is supplied to the data line 114, the data signal is applied to the pixel electrode 118 through the TFT 116 that is turned on. When the scanning line 112 is at a level L, the TFT 116 is turned off. However, the voltage applied to the pixel electrode 118 is stored and maintained in the capacitance of the liquid crystal element 120 and the auxiliary capacitor 125. In the liquid crystal element 120, the molecular alignment state of the liquid crystal 105 changes according to an electric field generated by the pixel electrode 118 and the common electrode 108. Accordingly, in a case where the liquid crystal element 120 is a transmissive type, the transmittance of the liquid crystal element 120 is in accordance with the applied voltage that is stored and maintained. In the liquid crystal panel 100, since the transmittance changes for each liquid crystal element 120, the liquid crystal element 120 corresponds to the pixel. In addition, the arrangement area of this pixel corresponds to a display area 101. In this embodiment, the liquid crystal 105 is operated in the VA type, and the liquid crystal element 120 is configured to be in a normally black mode in which a black state is formed without the application of a voltage.

Figure 6A:
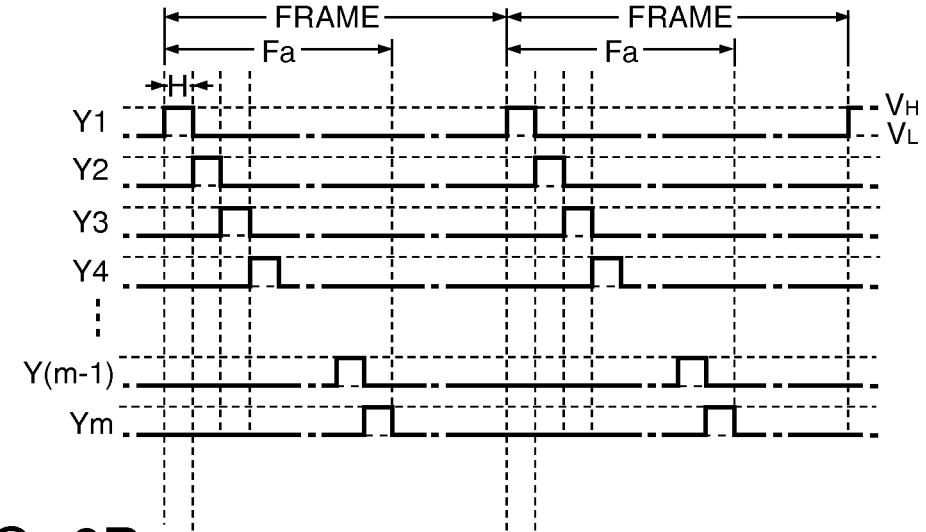
FIGS. 6A and 6B are diagrams showing the display operation of the liquid crystal panel.

The scanning line driving circuit 130 supplies scanning signals Y1, Y2, Y3, . . . , and Ym to the first, second, third, . . . , and m-th scanning lines 112 in accordance with a control signal Yctr transmitted from the scan control circuit 20. More specifically, as shown in FIG. 6A, the scanning line driving circuit 130 sequentially selects the first, second, third, . . . , (m−1)-th and m-th scanning lines 112 over a frame, and sets a scanning signal for a selected scanning line to a selection voltage $V_H$ (level H), and sets scanning signals for the other scanning lines to a non-selection voltage $V_L$ (level L).

Here, the frame is a period required for displaying an image corresponding to one frame on the liquid crystal panel 100 by driving the liquid crystal panel 100. In this embodiment, the frequency of the vertical scanning signal that is controlled in accordance with the synchronization signal Sync is 120 Hz, and one frame period is 8.33 milliseconds that is the reciprocal thereof. More specifically, in this embodiment, the liquid crystal panel 100 is driven by the liquid crystal display device 1 at the driving speed of 120 Hz in accordance with the video signal Vid-in that is supplied at the supply speed of 60 Hz from the higher-level device, and, by repeatedly displaying the image of one frame represented by the video signal Vid-in twice, so-called double-speed driving is realized. By performing such double-speed driving, for example, an advantage of reducing the afterimage effect of an image is acquired.

The data line driving circuit 140 samples a data signal Vx supplied from the video processing circuit 30 as data signals X1 to Xn at the first to n-th data lines 114 in accordance with a control signal Xctr transmitted from the scan control circuit 20.

Here, in the description of a voltage, except for an application voltage that is applied to the liquid crystal element 120, a ground electric potential not shown in the figure is the reference of a zero voltage unless otherwise noted. The application voltage applied to the liquid crystal element 120 is an electric potential difference between the voltage LCcom of the common electrode 108 and the voltage of the pixel electrode 118, which is distinguished from the other voltages.

Figure 5A:
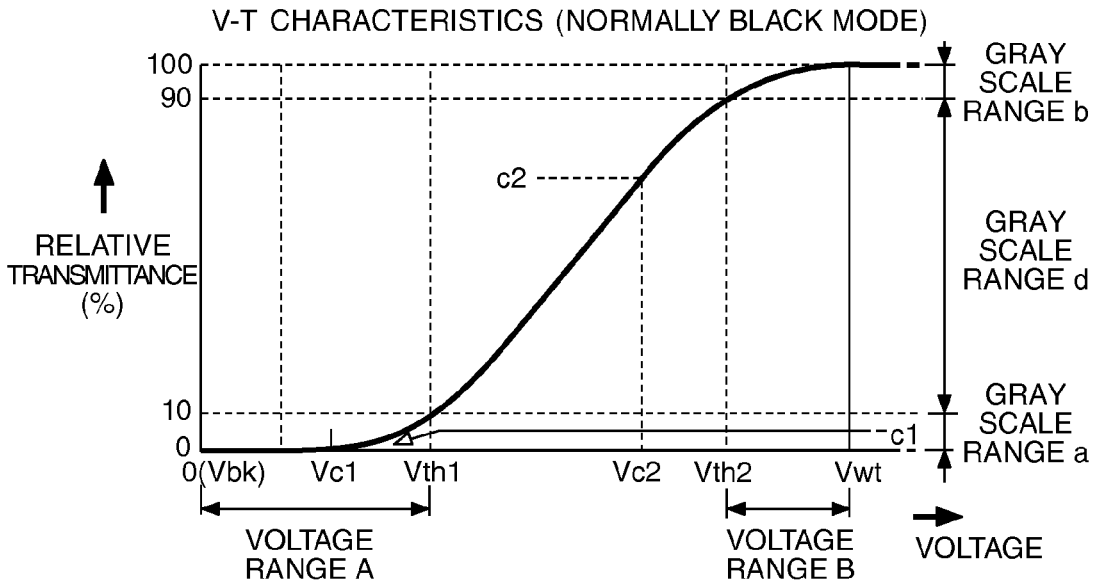
FIGS. 5A and 5B are diagrams showing the V-T characteristics of a liquid crystal panel that configures the liquid crystal display device.

Further, the relationship between the application voltage applied to the liquid crystal element 120 and the transmittance, for example, is represented as V-T characteristics as shown in FIG. 5A in the case of the normally black mode. Accordingly, in order to allow the liquid crystal element 120 to have the transmittance according to a gray scale level designated by the video signal Vid-in, a voltage according to the gray scale level may be applied to the liquid crystal element 120. However, by simply defining the application voltage applied to the liquid crystal element 120 in accordance with the gray scale level designated by the video signal Vid-in, there are cases where a defective display due to the reverse tilt domain may be generated.

Here, an example of the defective display due to the reverse tilt domain will be described. For example, as shown in FIG. 36, in a case where, in an image displayed in accordance with the video signal Vid-in, a black pattern in which black pixels are consecutive on the background of white pixels moves to the right side by one pixel for each frame, on the left-end edge of the black pattern, a pixel to be changed from a black pixel to a white pixel is not changed to the white pixel due to the occurrence of the reverse tilt domain, thereby being actualized as a type of a trail phenomenon.

Here, when an area of black pixels on the background of white pixels moves by two or more pixels for each frame, in a case where the response time of the liquid crystal 105 is shorter than a time interval (one frame period) at which the display screen is updated, such a trail phenomenon is not actualized (or is difficult to visually recognize) in the liquid crystal panel 100. The reason for this is as follows. When a white pixel and a black pixel are adjacent to each other in a certain frame, the reverse tilt domain may occur in the white pixel. However, pixels in which the reverse tilt domain occurs are discrete when the movement of the image is taken into consideration, and accordingly, it is understood that the reverse tilt domain is not visually noticeable.

Figure 36:
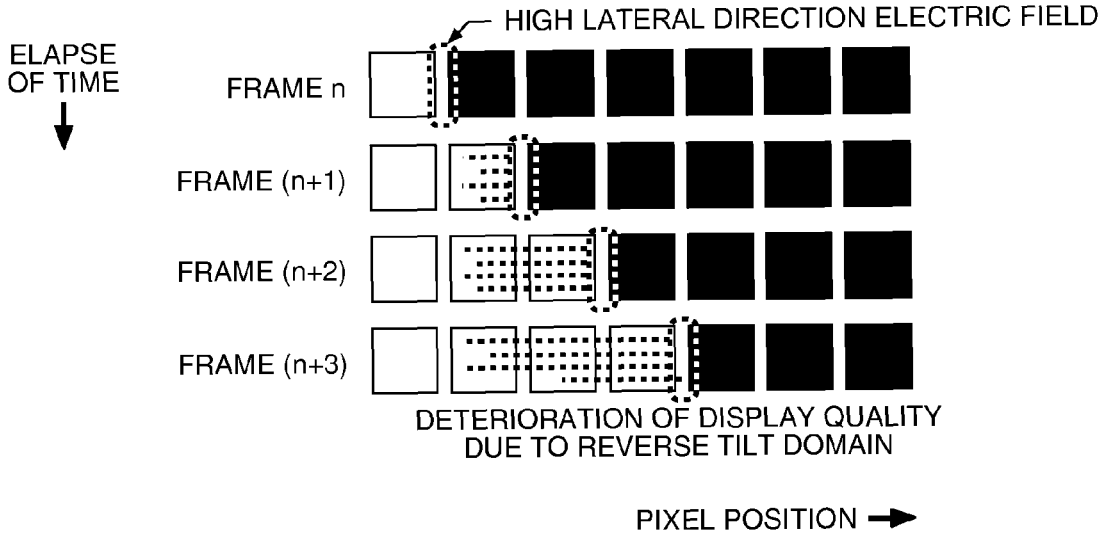
FIG. 36 is a diagram showing a defective display and the like due to the effect of a lateral direction electric field.

On the other hand, in a case where the perspective is changed in FIG. 36, in a case where a white pattern in which white pixels are consecutive on the background of black pixels is moved to the right side by one pixel in each frame, on the right-end edge (the front end portion of the movement) of the white pattern, a pixel to be changed from the black pixel to the white pixel may not be changed to the white pixel due to the occurrence of the reverse tilt domain.

In FIG. 36, for convenience of the description, a boundary area of one line within the image is extracted.

One reason for the defective display that is caused by the reverse tilt domain is that, when the liquid crystal molecules pinched in the liquid crystal element 120 are in an unstable state, they are disturbed by the influence of the lateral direction electric field, and accordingly, it is difficult for the liquid crystal molecules to be in an alignment state according to an applied voltage.

Here, a case where the liquid crystal molecules are influenced by the lateral direction electric field is a case where an electric potential difference between pixel electrodes that are adjacent to each other is large, and this is a case where a dark pixel of a black level (or a level close to a black level) and a bright pixel of a white level (or a level close to the white level) are adjacent to each other in an image to be displayed.

Of these, the dark pixel refers to a pixel of the liquid crystal element 120 to which the applied voltage is in a voltage range A that is equal to or higher than the voltage Vbk of the black level in the normally black mode and lower than a threshold value Vth1 (first voltage). In addition, for convenience of the description, the range (gray scale range) of the transmittance of the liquid crystal element to which the voltage is applied is in the voltage range A is assumed to be "a".

In addition, the bright pixel refers to a liquid crystal element 120 to which the voltage is applied is in a voltage range B that is equal to or higher than a threshold value Vth2 (second voltage) and is equal to or lower than the white level voltage Vwt in the normally black mode. For convenience of the description, the range (gray scale range) of the transmittance of the liquid crystal element to which the voltage is applied is in the voltage range B is assumed to be "b".

A case where the liquid crystal molecules are in the unstable state indicates a case where the voltage applied to the liquid crystal element is lower than Vc1 in the voltage range A. In the case where the voltage applied to the liquid crystal element is lower than Vc1, the regulating force of the vertical electric field is weaker than that of the alignment film, and accordingly, the alignment state of liquid crystal molecules may be easily disturbed by a few external factors. In addition, thereafter, even in a case where the liquid crystal molecules tilt in accordance with an applied voltage when the applied voltage is equal to or higher than Vc1, such a response usually takes time. In other words, when the applied voltage is equal to or higher than Vc1, the liquid crystal molecules start to tilt in accordance with the applied voltage (the transmittance thereof starts to change), and accordingly, the alignment state of the liquid crystal molecules can be considered as being in a stable state. Accordingly, the voltage Vc1 is lower than a threshold value Vth1 that is defined in accordance with the transmittance.

When considered in such a way, the pixel of which the liquid crystal molecules are in the unstable state before change are in a situation in which the reverse tilt domain can easily occur due to the influence of a lateral direction electric field generated when a dark pixel and a bright pixel are adjacent to each other in accordance with the movement of an image. However, when the initial alignment state of the liquid crystal molecules is taken into consideration, there is a case where the reverse tilt domain does not occur or a case where the reverse tilt domain occurs, depending on the positional relationship between the dark pixel and the bright pixel.

Next, such cases will be reviewed.

Figure 7A:
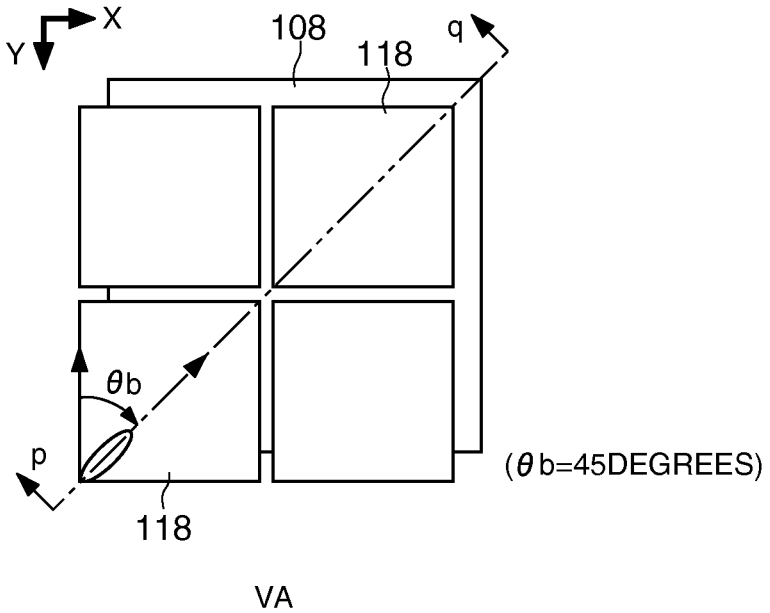
FIGS. 7A and 7B are diagrams illustrating the initial alignment in a case where the liquid crystal panel is configured as a VA type.
Figure 7B:
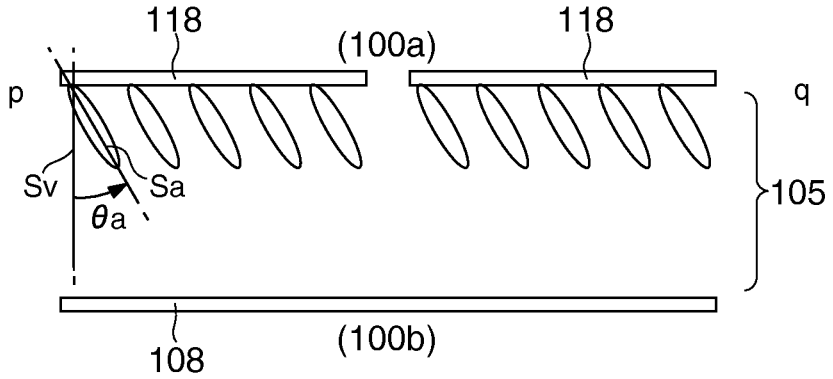

FIG. 7A is a diagram showing 2×2 pixels adjacent to each other in the vertical direction and the lateral direction on the liquid crystal panel 100, and FIG. 7B is a schematic cross-sectional view of the liquid crystal panel 100 taken along a vertical plane including line p-q shown in FIG. 7A.

As shown in FIGS. 7A and 7B, it is assumed that liquid crystal molecules of the VA type are initially aligned at a tilt angle of θa and a tilt azimuth angle of θb (=45 degrees) in a state in which an electric potential difference (the voltage applied to the liquid crystal element) between the pixel electrode 118 and the common electrode 108 is zero. Here, since the reverse tilt domain occurs due to the lateral direction electric field between pixel electrodes 118 as described above, the behavior of the liquid crystal molecules on the side of the component substrate 100*a* on which the pixel electrodes 118 are disposed becomes problematic. Accordingly, the tilt azimuth angle and the tilt angle of the liquid crystal molecules are defined by using the side of the pixel electrodes 118 (the component substrate 100*a*) as a reference.

Described in detail, the tilt angle θa, as shown in FIG. 7B, is an angle formed by the major axis Sa of the oval of the liquid crystal molecule and a substrate normal line Sv as a reference when one end of the major axis Sa of the oval of the liquid crystal molecular on the pixel electrode 118 side is set as a fixed point, and the other end thereof on the common electrode 108 side tilts.

On the other hand, the tilt azimuth angle θb is an angle that is formed by a substrate vertical plane that is formed along the Y direction as the alignment direction of the data line 114 as a reference and a substrate vertical plane (a vertical plane including line p-q) that includes the major axis Sa of the oval of the liquid crystal molecule and the substrate normal line Sv. In addition, the tilt azimuth angle θb is an angle, which is defined in a clockwise direction, from the upward direction of the screen (a direction opposite to the Y direction) to a direction from one end of the major axis of the oval of the liquid crystal molecule as a start point toward the other end (the upward and rightward direction in FIG. 7A) when seen in the plan view from the pixel electrode 118 side toward the common electrode 108.

In addition, similarly, when seen in the plan view from the pixel electrode 118 side, a direction from one end of the liquid crystal molecule on the pixel electrode side toward the other end will be referred to as a downstream side of the tilt azimuth for convenience of the description, and an opposite direction from the other end toward the one end (downward and leftward direction in FIG. 7A) will be referred to as an upstream side of the tilt azimuth for convenience of the description.

Figures 8A, 8B, 8C:
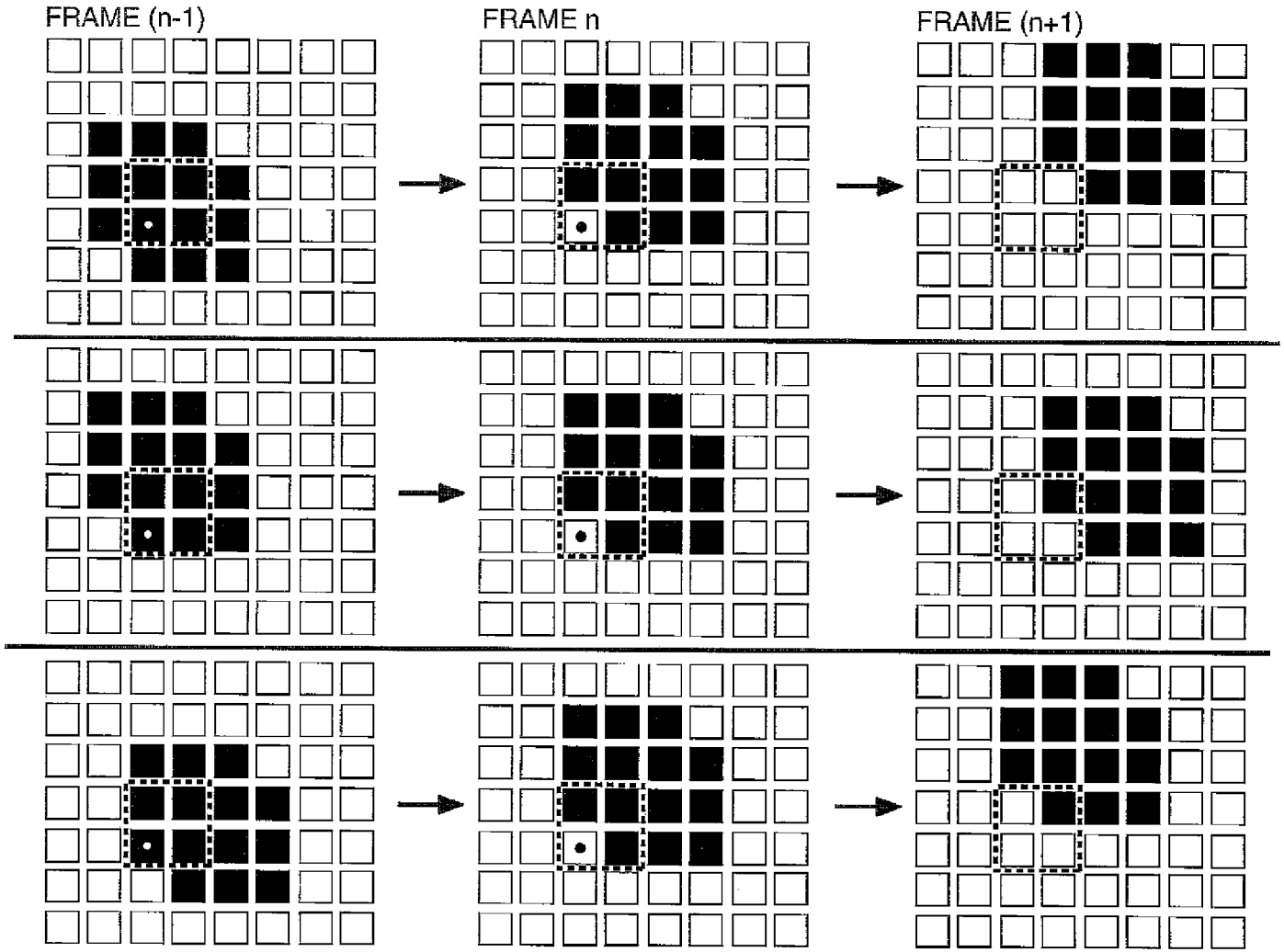
FIGS. 8A to 8C are diagrams showing the movement of an image on the liquid crystal panel.

In the liquid crystal panel 100 using the liquid crystal 105 having the initial alignment, for example, as shown in FIG. 8A, four pixels of 2×2 that are surrounded by broken lines will be focused on. FIG. 8A shows a case where a pattern formed by pixels (black pixels) of a black level on the background of an area formed by pixels (white pixels) of a white level moves in the upward and rightward direction by one pixel for each frame. In the description presented below, a frame that is t frames (here, t is a natural number) before frame n is denoted by "frame n−t" and a frame after t frames from frame n is denoted by "frame n+t".

Figure 9A:
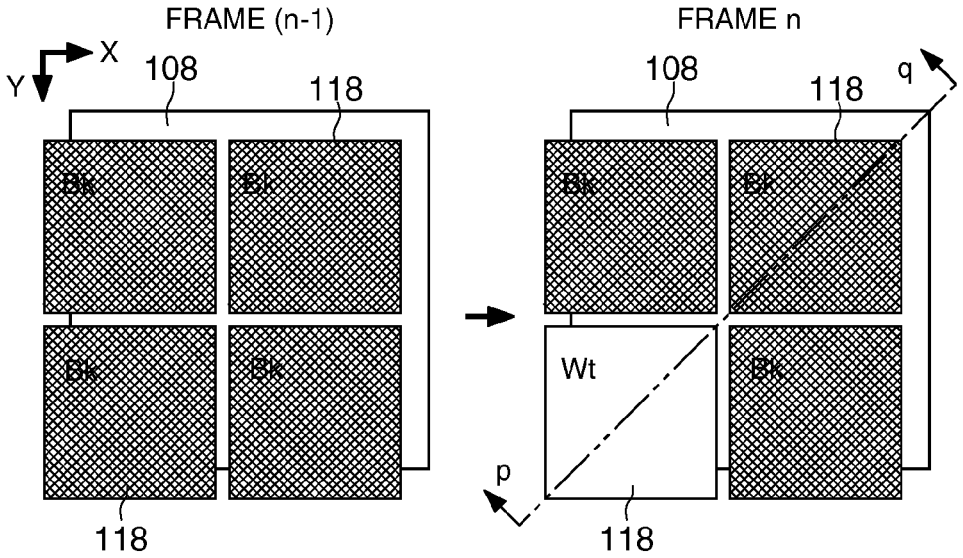
FIGS. 9A to 9C are diagrams illustrating a reverse tilt that is generated in the liquid crystal panel.
Figure 9B:
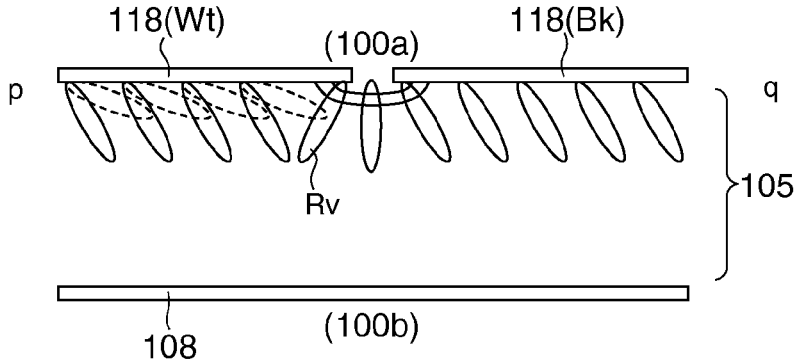

As shown in FIG. 9A, it is assumed that, from a state in which all the four pixels of 2×2 are black pixels in frame (n−1), only one pixel located on the lower left side changes to a white pixel in frame n. As described above, in the normally black mode, an applied voltage that is an electric potential difference between the pixel electrode 118 and the common electrode 108 is higher in the white pixel than that in the black pixel. Accordingly, in the pixel located on the lower left side that changes from black to white, as shown in FIG. 9B, the liquid crystal molecules tend to tilt in a direction (the lateral direction of the substrate face) vertical to the electric field direction from a state denoted by solid lines to a state denoted by broken lines.

However, an electric potential difference generated in a gap between the pixel electrode 118 (Wt) of a white pixel and the pixel electrode 118 (Bk) of a black pixel is the same degree as the electric potential difference generated between the pixel electrode 118 (Wt) of the white pixel and the common electrode 108, and a gap between the pixel electrodes is smaller than a gap between the pixel electrode 118 and the common electrode 108. Thus, when the intensities of the electric fields are compared, the lateral direction electric field generated in the gap between the pixel electrode 118 (Wt) and the pixel electrode 118 (Bk) is stronger than the vertical electric field that is generated in the gap between the pixel electrode 118 (Wt) and the common electrode 108.

Since the pixel located on the lower left side is a black pixel in which the liquid crystal molecules are unstable in frame (n−1), it takes time for the liquid crystal molecules to tilt in accordance with the intensity of the vertical electric field. On the other hand, a lateral direction electric field from adjacent pixel electrodes 118 (Bk) is stronger than a vertical electric field according to the application of a voltage of the white level to the pixel electrode 118 (Wt). Accordingly, in the pixel to be white, as shown in FIG. 9B, a liquid crystal molecule Rv located on a side adjacent to the black pixel is in the reverse tilt state before the other liquid crystal molecules set to tilt in accordance with the vertical electric field.

The liquid crystal molecule Rv that is in the reverse tilt state first has a negative influence on the movement of the other liquid crystal molecules set to tilt in the substrate horizontal direction as denoted by broken lines in accordance with the vertical electric field. Accordingly, an area in which the reverse tilt occurs in the pixel to be changed to white, as shown in FIG. 9C, is not restricted to gaps between the pixel to be changed to white and black pixels and broadly spreads in a form eroding the pixel to be changed to white from the gap therebetween.

Figure 9C:
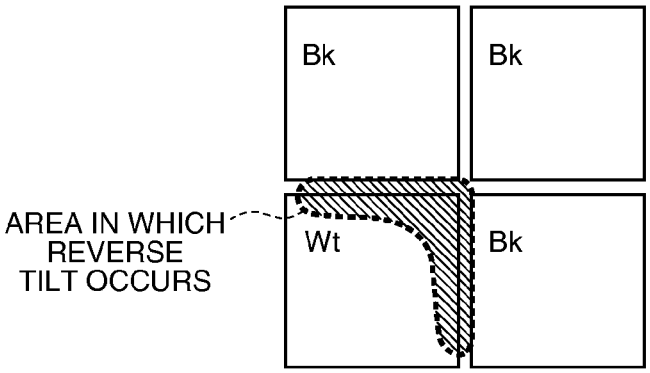

Accordingly, as shown in FIGS. 9A to 9C, in a case where there are black pixels on the periphery of a pixel of interest, which is to be changed to white, when the black pixels are adjacent to the pixel of interest on the upper right side, the right side, and the upper side, it can be determined that the reverse tilt occurs in an inner periphery area along the right side and the upper side for the pixel of interest.

In addition, a change in the pattern that is shown in FIG. 9A occurs not only in the example shown in FIG. 8A but also in a case where the pattern formed from black pixels moves to the right side by one pixel for each frame as shown in FIG. 8B, a case where the pattern moves to the upper side by one pixel for each frame as shown in FIG. 8C, or the like. In addition, like a case where the perspective is changed for the description presented with reference to FIG. 36, the change in a pattern occurs in a case where the pattern formed from white pixels on the background of an area formed from black pixels moves to the upper right side, the right side or the upper side by one pixel for each frame.

Figures 10A, 10B, 10C:
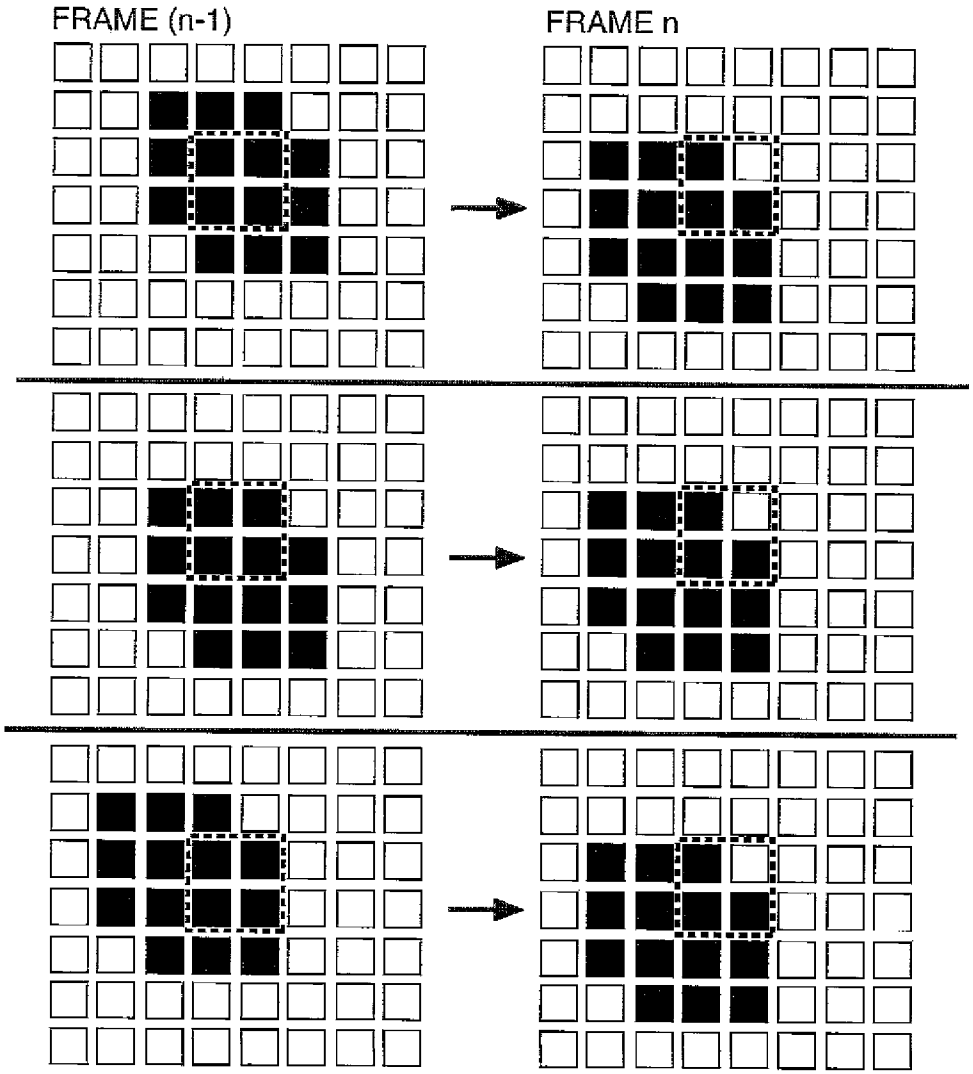
FIGS. 10A to 10C are diagrams showing the movement of an image on the liquid crystal panel.

Next, in the liquid crystal panel 100, as shown in FIG. 10A, when a pattern formed from black pixels on the background of an area formed from white pixels moves to the lower left side by one pixel for each frame, four pixels of 2×2 surrounded by broken lines will be focused on.

Figure 11A:
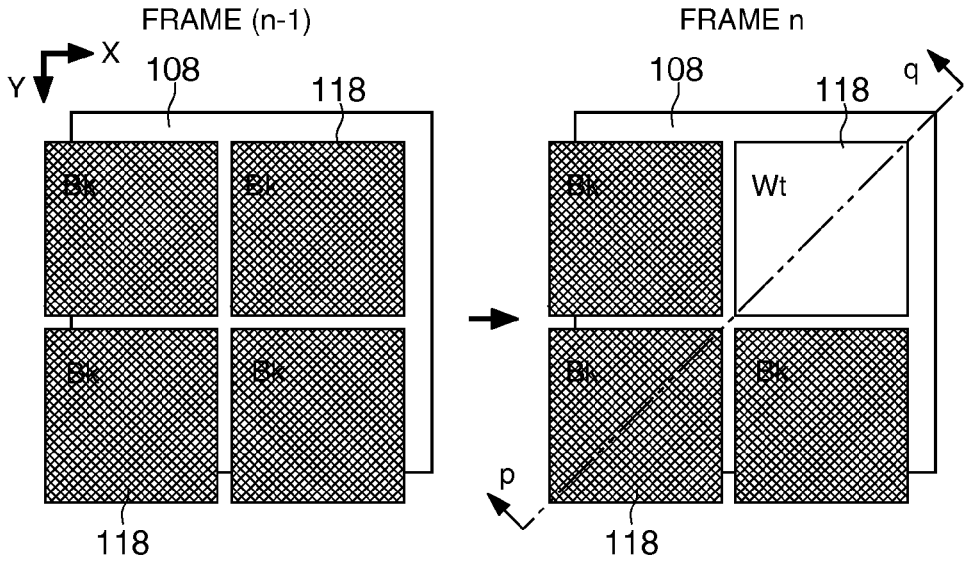
FIGS. 11A to 11C are diagrams illustrating a reverse tilt that is generated in the liquid crystal panel.

In other words, as shown in FIG. 11A, a time will be considered when, from a state in which all the four pixels of 2×2 are in the black pixel state in frame (n−1), only one pixel located on the upper right side is changed to white in frame n.

Figure 11B:
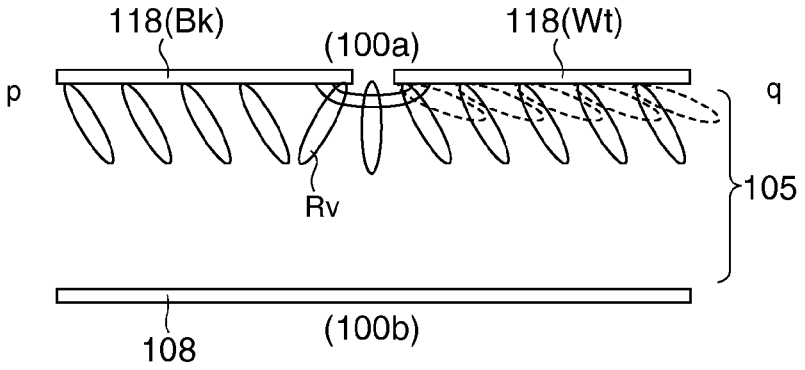
Figure 11C:
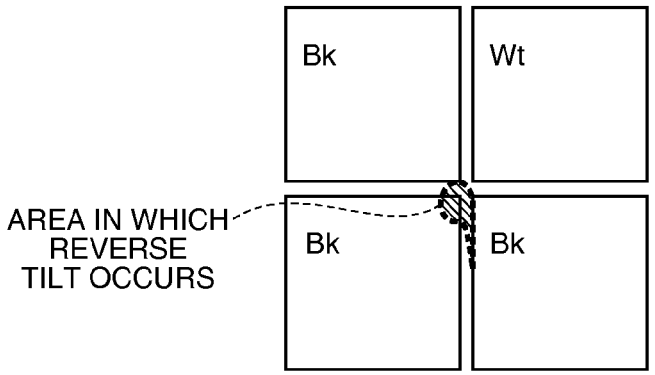

After this change, in a gap between the pixel electrode 118 (Bk) of a black pixel and the pixel electrode 118 (Wt) of a white pixel, a lateral direction electric field that is stronger than the vertical electric field generated between the pixel electrode 118 (Wt) and the common electrode 108 is generated. In accordance with the lateral direction electric field, as shown in FIG. 11B, the alignment of the liquid crystal molecule Rv in the black pixel that is located on a side adjacent to the white pixel changes before the other liquid crystal molecules set to tilt in accordance with the vertical electric field so as to be in the reverse tilt state. However, since the vertical electric field does not change from frame (n−1) in the black pixel, the vertical electric field scarcely has an influence on the other liquid crystal molecules. Accordingly, an area in which the reverse tilt occurs in the pixel that is not changed from the black pixel, as shown in FIG. 11C, is so narrow as to be negligible relative to that of the example shown in FIG. 9C.

On the other hand, out of the four pixels of 2×2, in the pixel that is changed from black to white on the upper right side, the initial alignment direction of the liquid crystal molecules is a direction for which the liquid crystal molecules are not easily influenced by a lateral direction electric field. Accordingly, even in a case where a vertical electric field is added, there is scarcely a liquid crystal molecule that is in the reverse tilt state. Thus, in the upper right pixel, as the intensity of the vertical electric field increases, the liquid crystal molecules correctly tilt, as denoted by broken lines in FIG. 11B, in the horizontal direction of the substrate face, and as a result, due to change in the targeted white pixel the deterioration of the display quality does not occur.

In addition, a change in the pattern that is shown in FIG. 11A occurs not only in the example shown in FIG. 10A but also in a case where the pattern formed from black pixels moves to the left side by one pixel for each frame as shown in FIG. 10B, a case where the pattern moves to the lower side by one pixel for each frame as shown in FIG. 10C, or the like. In addition, like a case where the perspective is changed for the description presented with reference to FIG. 36, there is also a case where the pattern formed from white pixels on the background of an area formed from black pixels moves to the lower left side, the left side or the lower side by one pixel for each frame.

In the liquid crystal of the VA type (the normally black mode) assumed in the description presented with reference to FIGS. 7A to 11C, when a specific frame n is considered, it can be determined that the following pixel is influenced by the reverse tilt domain in frame n in a case where the following conditions are satisfied.

(1) When frame n is considered, in a case where a dark pixel and a bright pixel are adjacent to each other, in other words, a pixel to which the voltage is applied is in the low state and a pixel to which the voltage is applied is in the high state are adjacent to each other so as to strengthen the lateral direction electric field, and, in addition, (2) in a case where the bright pixel (the voltage applied thereto is high) is located to the lower left side, the left side, or the lower side, which correspond to the upstream side of the tilt azimuth of the liquid crystal molecules, of the dark pixel (the voltage applied thereto is low) adjacent thereto, (3) when the liquid crystal molecules of a pixel that is changed to the bright pixel in frame n are in the unstable state in frame (n−1) that is one frame before, the reverse tilt occurs in the bright pixel in frame n.

Although the reason has been described, in (2), when a boundary representing a portion at which the dark pixel and the bright pixel are adjacent to each other moves by one pixel from the previous frame, it is understood that the influence of the reverse tilt domain can be easily received.

In FIGS. 8A to 8C, a case is shown as an example in which four pixels of 2×2 are black pixels in frame (n−1), and only the lower left side is a white pixel in the next frame n. However, generally, the same movement is accompanied not only in frame (n−1) and frame n but also over a plurality of consecutive frames including the frames as a usual case. Accordingly, as shown in FIGS. 8A to 8C, it is understood that there are many cases in which a bright pixel is adjacent to a dark pixel (a pixel to which a white circular point is attached), in which the liquid crystal molecules are in the unstable state in frame (n−1), to the lower left side, the left side, or the lower side thereof, based on the movement of an image pattern.

Accordingly, in frame (n−1) in advance, when a dark pixel and a bright pixel are adjacent to each other in an image represented by a video signal Vid-in, and the dark pixel is located to the upper right side, the right side, or the upper side of the bright pixel, a voltage is applied to a liquid crystal element corresponding to the dark pixel such that the liquid crystal molecules are not in an unstable state. Accordingly, even in a case where condition (1) and condition (2) are satisfied in frame n in accordance with the movement of the image pattern, condition (3) is not satisfied, whereby the reverse tilt domain does not occur in frame n.

On this premise, frame n to frame (n+1) will be considered. In frame n, in a case where a dark pixel and a bright pixel are adjacent to each other in an image represented by the video signal Vid-in and in a case where the dark pixel is located to the upper right side, the right side, or the upper side of the bright pixel, an arrangement is made such that the liquid crystal molecules of the liquid crystal element corresponding to the dark pixel are not in an unstable state. Then, as a result of the movement of the image pattern by one pixel, even in a case where condition (1) and condition (2) are satisfied in frame (n+1), condition (3) cannot be satisfied. Accordingly, from the viewpoint of frame n, the occurrence of the reverse tilt domain in frame (n+1) in the future can be controlled in advance.

Next, in frame n, in a case where a dark pixel and a bright pixel are adjacent to each other in an image represented by the video signal Vid-in and a case where the dark pixel has the positional relationship with respect to the bright pixel, a method of preventing the liquid crystal molecules in the dark pixel from being in an unstable state will be reviewed. As described above, a case where the liquid crystal molecules are in an unstable state indicates a case where the voltage applied to the liquid crystal element is lower than Vc1 (third voltage). Accordingly, in a case where the voltage applied to the liquid crystal element in the dark pixel satisfying the above-described positional relationship, which is designed by the video signal Vid-in, is lower than Vc1, the voltage applied to the liquid crystal element may be forcibly corrected to a voltage equal to or higher than Vc1.

Further, a desired value of the corrected voltage will be reviewed. In a case where the applied voltage that is designated by the video signal Vid-in is lower than Vc1, if high priority is given to a point at which the liquid crystal molecules are in a more stable state or the occurrence of the reverse tilt domain is suppressed more reliably when the applied voltage is corrected to be equal to or higher than Vc1 and is applied to the liquid crystal element, a higher voltage is preferable. However, in the normally black mode, as the voltage applied to the liquid crystal element increases, the transmittance becomes higher. The gray scale level that is designated by the original video signal Vid-in is the transmittance of the dark pixel, that is, the lower side, and accordingly, setting the correction voltage to be high leads to displaying of an image that is not based on the video signal Vid-in.

On the other hand, if high priority is given to a point at which a change in the transmittance due to correction is not recognized when the voltage corrected to be equal to or higher than Vc1 is applied to the liquid crystal element, a voltage Vc1 that is the lower limit is preferable. As above, a desired value of the corrected voltage is determined based on the point to which the priority is given. In this embodiment, as the corrected voltage, although Vc1 is used, a higher voltage may be used.

In addition, in the VA type, liquid crystal molecules are in a state closest to the substrate face in the vertical direction when the voltage applied to the liquid crystal element is zero. The voltage Vc1 is a voltage of a degree that allows the liquid crystal molecules to have the initial inclination angle, and the liquid crystal molecules start to incline in accordance with the application of this voltage. Generally, various parameters of the liquid crystal panel are involved in the voltage Vc1 at which the liquid crystal molecules are in the stable state, and the voltage Vc1 cannot be unconditionally determined. However, as in this embodiment, in a liquid crystal panel in which a gap between pixel electrodes 118 is smaller than a gap (cell gap) between the pixel electrode 118 and the common electrode 108, the voltage Vc1 is 1.5 volts on the whole.

Accordingly, 1.5 volts are the lower limit as the corrected voltage, and thus a voltage equal to or higher than this voltage may be used. Conversely, in a case where the voltage applied to the liquid crystal element is lower than 1.5 volts, the liquid crystal molecules are in the unstable state.

In the case of an image accompanying movement, in an image of the current frame that is represented by the video signal Vid-in, even for a pixel that is brought into contact with the risk boundary, there are a case where the video signal needs to be corrected and a case where the video signal does not need to be corrected when the movement including a frame (hereinafter, referred to as a "previous frame") which is one frame before the current frame is considered. According to the embodiment of the invention, when the video signal of the current frame is corrected, the occurrence of the reverse tilt domain is suppressed by taking the state of the previous frame into consideration.

Figure 3:
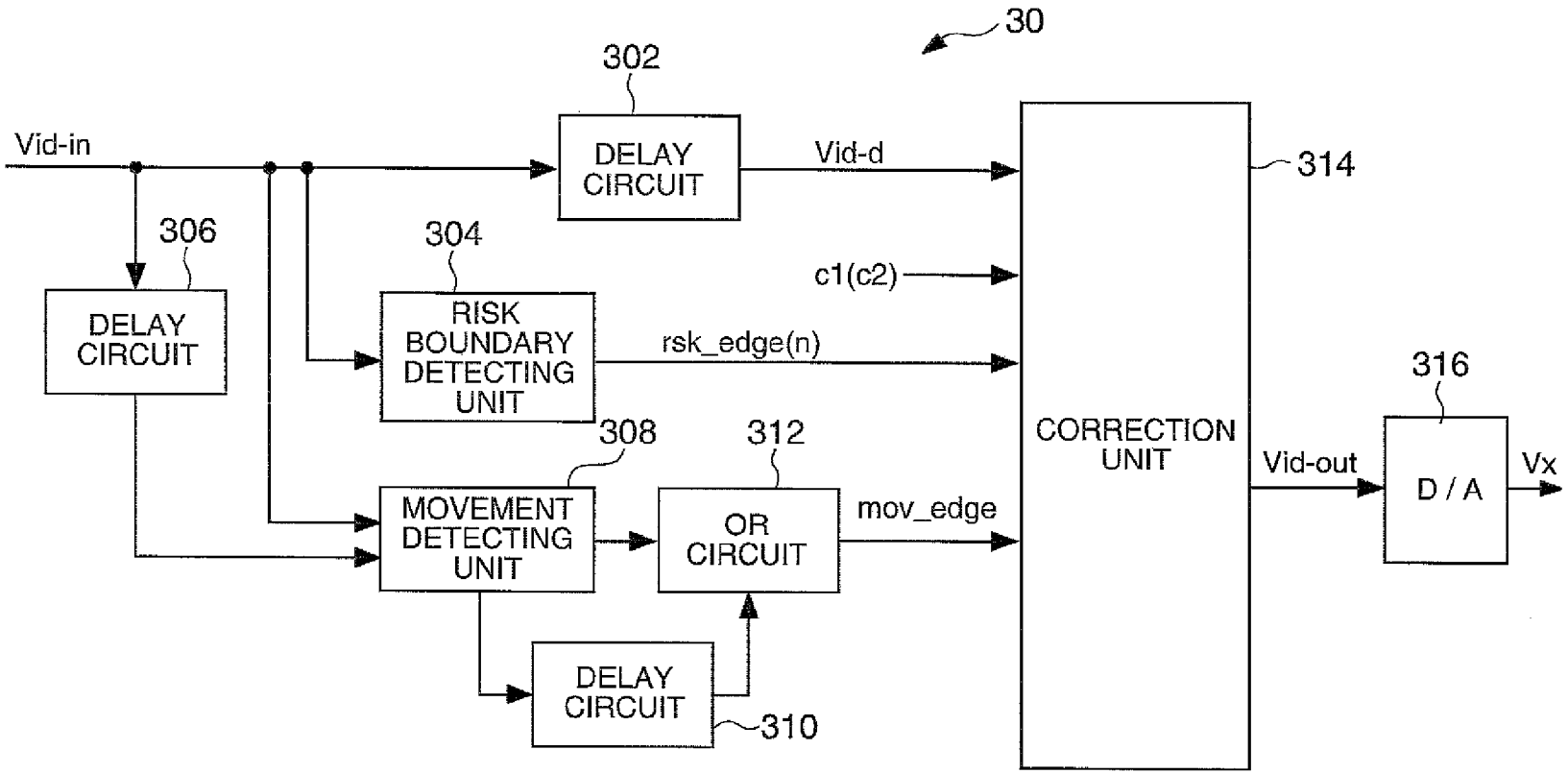
FIG. 3 is a diagram showing the configuration of the video processing circuit.

A circuit that is used for preventing the occurrence of the reverse tilt domain in the liquid crystal panel 100 in advance by processing the video signal Vid-in based on such consideration is the video processing circuit 30 having the configuration shown in FIG. 3. The video processing circuit 30 is used for correcting an input video signal and defining voltages applied to the liquid crystal elements 120 based on the corrected video signal. Hereinafter, it is assumed that frame n is the current frame, and frame (n−1) is the previous frame in the description.

Next, the video processing circuit 30 will be described in detail with reference to FIG. 3.

As shown in FIG. 3, the video processing circuit 30 includes: a delay circuit 302; a risk boundary detecting unit 304; a delay circuit 306; a movement detecting unit 308; a delay circuit 310; an OR circuit 312; a correction unit 314; and a D/A (Digital-to-Analog) converter 316.

In addition, the delay timing of each of the delay circuits 302, 306, and 310, the accumulation of the video signal Vid-in in the risk boundary detecting unit 304 or the movement detecting unit 308, and the like are controlled by the scan control circuit 20.

The delay circuit 302 is configured by a FIFO (First In First Out) memory, a multi-stage latch circuit, or the like. The delay circuit 302 accumulates a certain video signal Vid-in as an input video signal supplied from a higher-level device, reads out the video signal after the elapse of a predetermined time, and outputs the video signal as a video signal Vid-d to the correction unit 314.

The risk boundary detecting unit 304 detects a risk boundary that is a part of the boundary between a dark pixel and a bright pixel that are designated by an input video signal Vid-in of frame n and is determined based on the tilt azimuth of the liquid crystal 105. More specifically, the risk boundary detecting unit 304 analyzes an image that is displayed in accordance with the video signal Vid-in representing an image of one frame and determines whether or not there is a portion at which a dark pixel having a gray scale in a gray scale range a and a bright pixel having a gray scale in a gray scale range b are adjacent to each other in the vertical direction or the horizontal direction. Then, the risk boundary detecting unit 304 extracts a portion in which a dark pixel is located on the upper side thereof and a bright pixel is located on the lower side thereof and a portion in which a dark pixel is located on the right side and a bright pixel is located on the left side as parts of the boundary between the dark pixel and the bright pixel and detects the extracted portions as a risk boundary. The above-described risk boundary detecting unit 304 outputs boundary information rsk_edge that represents the position of the risk boundary for each frame (second boundary detecting step). In other words, the risk boundary detecting unit 304 serves as a second boundary detecting unit.

The delay circuit 306 is configured by a FIFO (First In First Out) memory, a multi-stage latch circuit, or the like. The delay circuit 306 accumulates a video signal Vid-in supplied from a higher-level device and outputs the video signal to the movement detecting unit 308 while delaying the video signal by one frame period.

The movement detecting unit 308 acquires video signals Vid-in of frame n and frame (n−1) and determines whether or not there is a boundary (hereinafter, referred to as an "applied boundary") that changes over frame (n−1) to frame n out of boundaries at which a dark pixel having a gray scale in the gray scale range a and a bright pixel having a gray scale in the gray scale range b are adjacent to each other. In other words, the applied boundary is a boundary between pixels that is not present in frame (n−1) and is present in frame n. When it is determined that there is an applied boundary, the movement detecting unit 308 detects the applied boundary and outputs boundary information that represents the position thereof (first boundary detecting step). In other words, the movement detecting unit 308 serves as a first boundary detecting unit.

Unless video signals of some degree (at least three or more rows) are accumulated, the movement detecting unit 308 cannot detect a boundary in an image to be displayed over the vertical direction and the horizontal direction. Accordingly, in order to adjust the timing of supplying the video signal Vid-d, the delay circuit 302 that delays the video signal Vid-in is disposed.

Figure 4A:
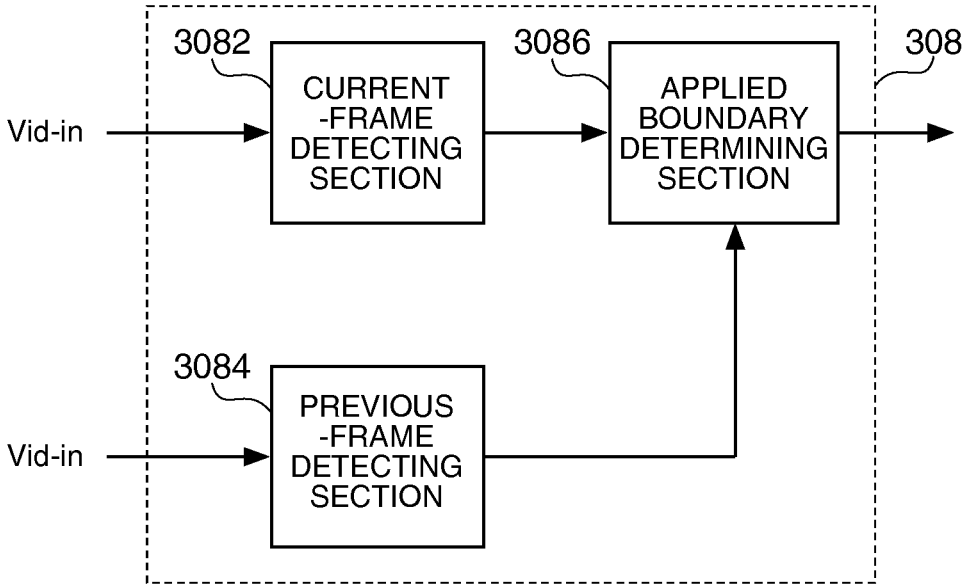
FIGS. 4A and 4B are diagrams showing the configuration of a movement detecting unit and a correction unit of the video processing circuit.

The configuration of the movement detecting unit 308 will be described in detail with reference to FIG. 4A.

In this embodiment, the movement detecting unit 308 includes: a current-frame detecting section 3082; a previous-frame detecting section 3084; and an applied boundary determining section 3086.

The current-frame detecting section 3082 analyzes an image that is represented in a video signal Vid-in of the current frame (frame n) and determines whether there is a portion at which a dark pixel having a gray scale in the gray scale range a and a bright pixel having a gray scale in the gray scale range b are adjacent to each other. Then, when determining that there is an adjacent portion, the current-frame detecting section 3082 detects the adjacent portion as a boundary and outputs boundary information.

The boundary described here represents a portion at which a dark pixel having a gray scale in the gray scale range a and a bright pixel having a gray scale in the gray scale range b are adjacent to each other, that is, a portion at which a strong lateral direction electric field is generated.

Accordingly, for example, a portion at which a pixel having a gray scale in the gray scale range a and a pixel having a gray scale in the gray scale range d (see FIG. 5A) other than the gray scale range a and the gray scale range b are adjacent to each other or a portion at which a pixel having a gray scale in a gray scale range b and a pixel having a gray scale in a gray scale range d are adjacent to each other is not treated as a boundary.

The previous-frame detecting section 3084 analyzes an image that is represented in a video signal Vid-in of the previous frame (frame (n−1)) supplied from the delay circuit 306 and detects a portion at which a pixel having a gray scale in the gray scale range a and a pixel having a gray scale in the gray scale range b are adjacent to each other as a boundary.

Here, the definition of the boundary detected by the previous-frame detecting section 3084 is the same as that of the current-frame detecting section 3082.

The applied boundary determining section 3086 determines an applied boundary acquired by excluding the same portion as the boundary of the previous frame image that is detected by the previous-frame detecting section 3084 from the boundaries of the current frame image that are detected by the current-frame detecting section 3082. The applied boundary determining section 3086 outputs the boundary information that represents the position of the applied boundary.

The delay circuit 310 is configured by a FIFO memory, a multi-stage latch circuit, or the like. The delay circuit 310 accumulates a video signal Vid-in supplied from a higher-level device and outputs a video signal read out after the elapse of a predetermined time to the OR circuit 312. Here, the delay circuit 310 delays the boundary information by one frame period and outputs the delayed boundary information. The delay circuit 310 serves as a history storing unit storing information that indicates that there is a movement in the image represented in the video signal Vid-in a predetermined time before as a history. The delay circuit 310 outputs the delayed boundary information as history information that indicates that there is a boundary changing from frame (n−1) to frame n.

The OR circuit 312 adds the boundary information of frame n that is supplied from the movement detecting unit 308 and the boundary information of frame (n−1) that is supplied from the delay circuit 310 and outputs resultant information to the correction unit 314 as boundary information mov_edge. In other words, the OR circuit 312 outputs the boundary information mov_edge that represents the position located at an applied boundary of at least one of frame n and frame (n−1).

In the video signal Vid-d of frame n that is output from the delay circuit 302, the correction unit 314 corrects the video signal Vid-d of at least one of the dark pixel and the bright pixel that are brought into contact with the risk boundary detected by the risk boundary detecting unit 304 out of the applied boundary detected by the movement detecting unit 308 such that the lateral direction electric field generated between the dark pixel and the bright pixel is decreased (correction step). More specifically, the correction unit 314, for a dark pixel that is brought into contact with the risk boundary corresponding to the applied boundary in the video signal Vid-d of frame n, in a case where the gray scale level designated by the dark pixel is a level that is darker than c1, corrects the video signal Vid-d to a video signal of the gray scale level c1 and outputs the corrected video signal as a video signal Vid-out. In addition, for a dark pixel that satisfies the correction condition in frame n, out of a plurality of frames (that is, frame n to frame (n+k)) up to k frames (here, k is a natural number) that follow frame n, the correction unit 314 corrects the video signal Vid-d of the dark pixel of the frame that is brought into contact with the risk boundary detected by the risk boundary detecting unit 304 to a video signal of the gray scale level c1. On the other hand, for the other pixels, the correction unit 314 directly outputs the video signal Vid-d as the video signal Vid-out without correcting the video signal Vid-d.

In this embodiment, k=1, and there is a case where the correction unit 314 corrects a pixel that satisfies the correction condition in frame n also in frame (n+1) based on the output result of the OR circuit 312. The reason for setting k=1 will be described later.

Figure 4B:
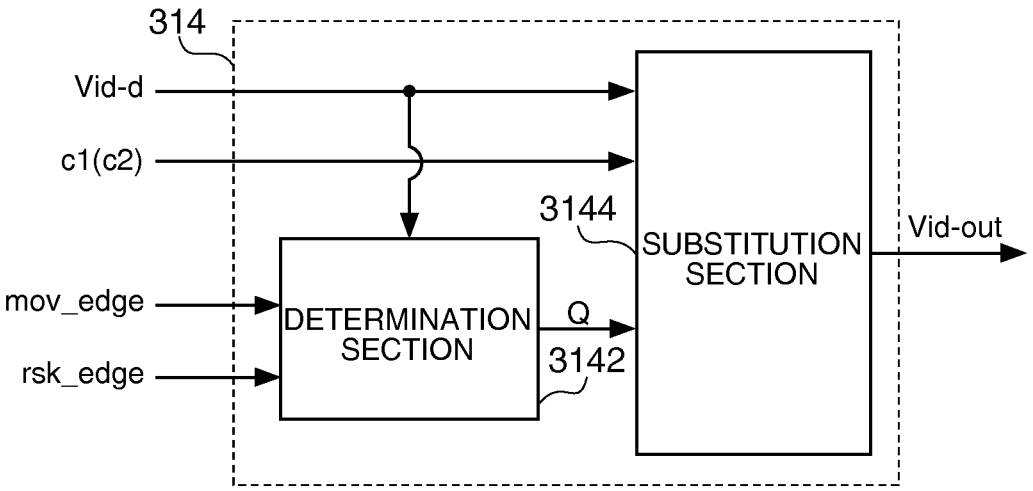

Next, the detailed configuration of the correction unit 314 will be described with reference to FIG. 4B.

In this embodiment, the correction unit 314 includes a determination section 3142 and a substitution section 3144.

The determination section 3142 determines whether or not a pixel represented in the video signal Vid-d of frame n that is output from the delay circuit 302 satisfies the correction condition. In a case where the determination result is "Yes", for example, the determination section 3142 sets the flag Q of the output signal to "1". On the other hand, in a case where the determination result is "No", the determination section 3142 outputs the flag Q as "0". More specifically, the determination section 3142 determines that a pixel of interest satisfies the correction condition for a video signal Vid-d of frame n in a case where (I) the pixel represented by the video signal Vid-d is a dark pixel, (II) the boundary information mov_edge output from the OR circuit 312 indicates an applied boundary, and (III) the boundary information rsk_edge output from the risk boundary detecting unit 304 indicates a risk boundary. However, as can be understood by substituting frame "n" with frame "(n+1)" and frame "(n−1)" with frame "n" in the description relating to the above-described video processing circuit 30, the condition (II) indicates that, in a case where a pixel satisfying the correction condition in frame n satisfies the conditions of (I) and (III) in frame (n+1), the determination section 3142 determines that the pixel also satisfies the correction condition in frame (n+1).

In a case where the flag Q supplied from the determination section 3142 is "1", when the gray scale level designated in the dark pixel represented by the video signal Vid-d is a level that is darker than c1, the substitution section 3144 substitutes the gray scale level with c1 and then outputs the gray scale level as a video signal Vid-out.

On the other hand, in a case where the pixel represented by the video signal Vid-d is not a dark pixel that is brought into contact with the risk boundary, the flag Q is "0", and accordingly, the substitution section 3144 does not substitute the gray scale level with c1. Even in a case where the flag Q is "1", when the gray scale level designates a bright level that is equal to or higher than c1, the substitution section 3144 does not substitute the gray scale level with c1 and outputs the video signal Vid-d as the video signal Vid-out.

The D/A converter 316 converts the video signal Vid-out as digital data into an analog data signal Vx. In addition, in this embodiment, the polarity of the data signal Vx is switched each time when one frame is rewritten in the liquid crystal panel 100 (in units of one frame).

Next, the display operation of the liquid crystal display device 1 will be described. Video signals Vid-in are sequentially supplied from a higher-level device in the order of pixels of the first row and the first column to the first row to the n-th column, the second row and the first column to the second row and the n-th column, and the third row and the first column to the third row and the n-th column, . . . , the m-th row and the first column to the m-th row and the n-th column over frames. The video processing circuit 30 performs a process such as delay processing and correction processing for the video signal Vid-in and outputs the processed signal as a video signal Vid-out.

Figure 6B:
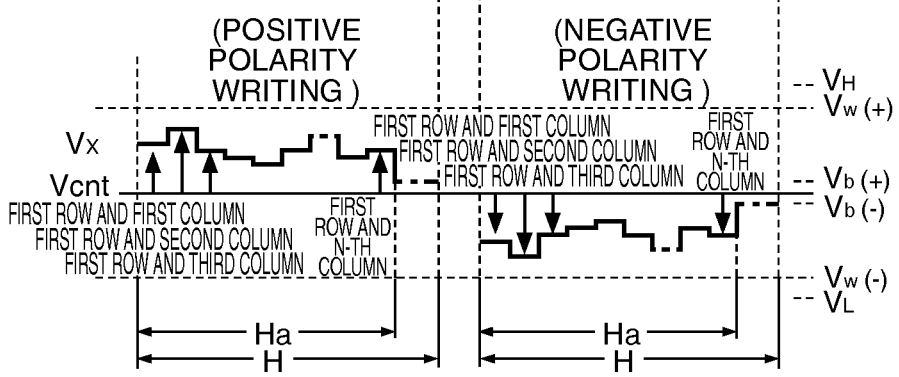

Here, when viewed in a horizontal effective scanning period (Ha) in which the video signals Vid-out of the first row and the first column to the first row and the n-th column are output, the processed video signal Vid-out is converted into a data signal Vx having a positive polarity or a negative polarity as shown in FIG. 6B by the D/A converter 316. Here, for example, the video signal is converted into a data signal having the positive polarity. This data signal Vx is sampled in the first to n-th data lines 114 by the data line driving circuit 140 as data signals X1 to Xn.

On the other hand, in a horizontal scanning period in which the video signals Vid-out of the first row and the first column to the first row and the n-th column are output, the scanning control circuit 20 controls the scanning line driving circuit 130 such that only a scanning signal Y1 is in the level H. When the scanning signal Y1 is in the level H, the TFTs 116 positioned in the first row are in the On state, and accordingly, the data signals sampled in the data lines 114 are applied to the pixel electrodes 118 through the TFTs 116 that are in the On state. Accordingly, positive-polarity voltages according to the gray scale level designated by the video signal Vid-out are written in the liquid crystal elements of the first row and the first column to the first row and the n-th column.

Subsequently, video signals Vid-in of the second row and the first column and the second row and the n-th column are similarly processed by the video processing circuit 30 and are output as the video signals Vid-out. In addition, after the video signals are converted into data signals having the positive polarity by the D/A converter 316, the video signals are sampled in the first to the n-th data lines 114 by the data line driving circuit 140.

In a horizontal scanning period in which the video signals Vid-out of the second row and the first column to the second row and the n-th column are output, only a scanning signal Y2 is in the level H by the scanning line driving circuit 130. Accordingly, the data signals sampled in the data lines 114 are applied to the pixel electrodes 118 through the TFTs 116 that are in the On state positioned in the second row. Therefore, positive-polarity voltages according to the gray scale level designated by the video signal Vid-out are written in the liquid crystal elements of the second row and the first column to the second row and the n-th column.

Subsequently, similar write operations are performed for the third, the fourth, . . . , the m-th rows. Accordingly, a voltage according to the gray scale level designated by the video signal Vid-out is written into each liquid crystal element, whereby a transmissive image that is defined by the video signal Vid-in is generated.

In the next frame, a similar write operation is performed while the video signal Vid-out is converted into a data signal having the negative polarity due to the polarity inversion of a data signal.

FIG. 6B is a diagram of a voltage waveform that shows an example of a data signal Vx when video signals Vid-out of the first row and the first column to the first row and the n-th column are output over the horizontal scanning period (H) from the video processing circuit 30. In this embodiment, due to the normally black mode, in the case of the positive polarity, the data signal Vx has a voltage (denoted by ↑ in the figure) positioned on a side higher than the reference voltage Vcnt by a value corresponding to the gray scale level processed by the video processing circuit 30. On the other hand, in the case of the negative polarity, the data signal Vx has a voltage (denoted by ↓) positioned on a side lower than the reference voltage Vcnt by a value corresponding to the gray scale level.

Described in more detail, in the case of the positive polarity, the voltage of the data signal Vx is a voltage deviated from the reference voltage Vcnt in correspondence with the gray scale in a range from a voltage Vw(+) corresponding to white to a voltage Vb(+) corresponding to black. On the other hand, in the case of the negative polarity, the voltage of the data signal Vx is a voltage deviated from the reference voltage Vcnt in correspondence with the gray scale in a range from a voltage Vw(−) corresponding to white to a voltage Vb(−) corresponding to black.

The voltage Vw(+) and the voltage Vw(−) are symmetrical with respect to the voltage Vcnt as the center. In addition, the voltage Vb(+) and the voltage Vb(−) are symmetrical with respect to the voltage Vcnt as the center.

FIG. 6B shows the voltage waveform of the data signal Vx, which is different from the voltage (an electric potential difference between the pixel electrode 118 and the common electrode 108) applied to the liquid crystal element 120. The vertical scale of the voltage of the data signal in FIG. 6B is relatively enlarged, compared to the voltage waveform of the scanning signal and the like in FIG. 6A.

A specific example of the correction process of the video processing circuit 30 will be described.

Figure 12A:
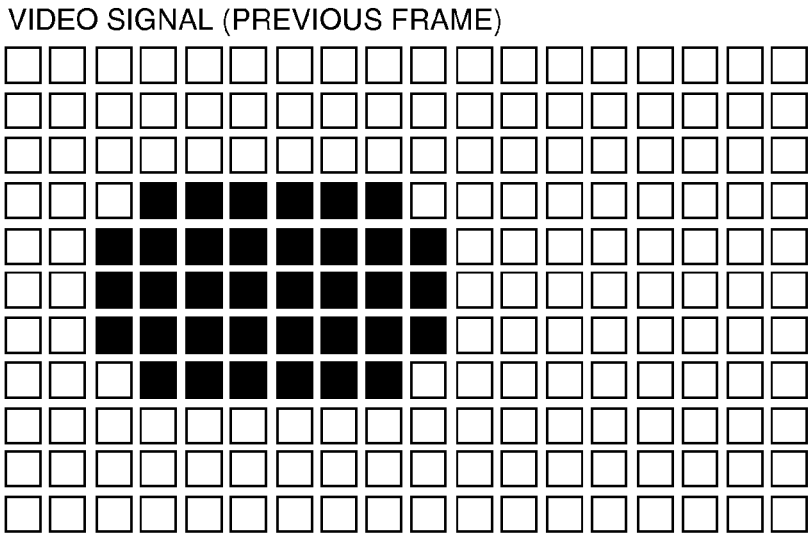
FIGS. 12A to 12C are diagrams showing the sequence of movement detection in the video processing circuit.
Figure 12B:
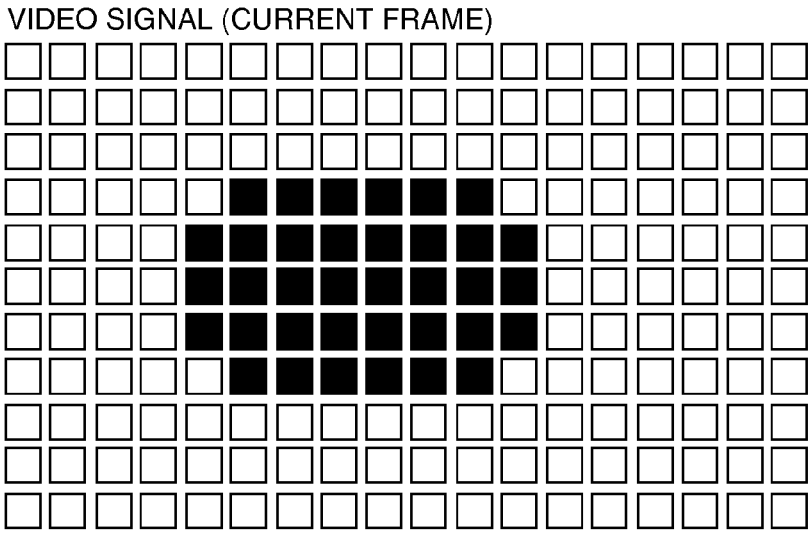
Figure 12C:
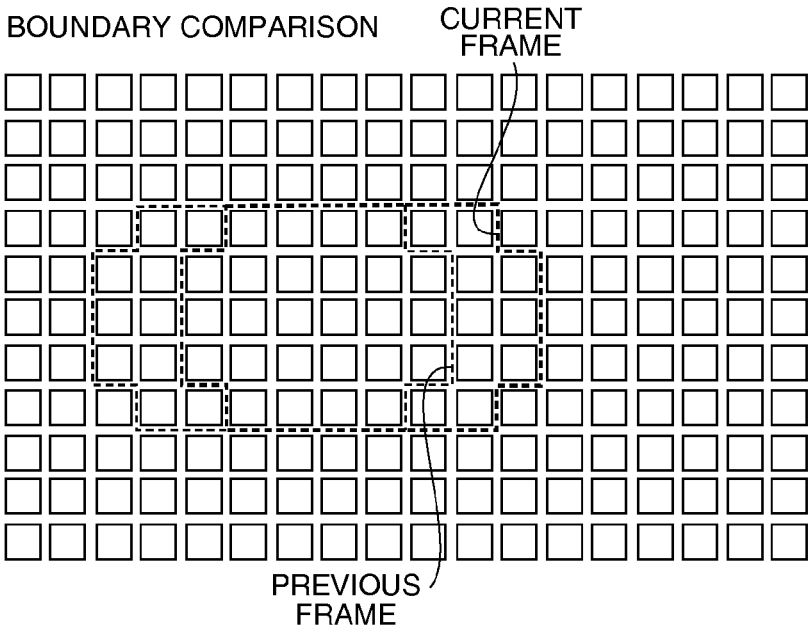

For example, in a case where an image represented by a video signal Vid-in of frame (n−1) is as shown in FIG. 12A, and an image represented by a video signal Vid-in of frame n is as shown in FIG. 12B, in other words, in a case where a pattern formed from dark pixels having gray scales in the gray scale range a moves to the right side on the background of bright pixels having gray scales in the gray scale range b (here, a low-speed scroll movement is considered), a boundary of the image of the previous frame (frame (n−1)) detected by the previous-frame detecting section 3084 and a boundary of the image of the current frame (frame n) detected by the current-frame detecting section 3082 are as shown in FIG. 12C.

Accordingly, the applied boundary that is determined by the movement detecting unit 308 is as shown in FIG. 13A. On the other hand, the risk boundary that is detected based on the video signal Vid-in of frame n by the risk boundary detecting unit 304 is as shown in FIG. 13B. Thus, as shown in FIG. 13C, of the applied boundary detected by the movement detecting unit 308, a dark pixel adjacent to a portion corresponding to a risk boundary located in a portion, in which a dark pixel is located on the upper side and a bright pixel is located on the lower side, and a portion, in which a dark pixel is located on the right side and a bright pixel is located on the left side is a pixel that satisfies the correction condition according to this embodiment in the video signal Vid-d of frame n.

For dark pixels that satisfy the correction condition, the correction unit 314 corrects the video signal Vid-d of frame n to the video signal Vid-out having a gray scale level c1 as shown in FIG. 14A. Accordingly, even in a case where there is a portion in the image represented by the video signal Vid-in that changes from a black pixel to a white pixel as an area formed from black pixels moves to any of the upper right side, the right side, or the upper side, in the liquid crystal panel 100, liquid crystal molecules are not directly changed from an unstable state to a white pixel but forcibly pass through a state in which the liquid crystal molecules are stable by applying the voltage Vc1 corresponding to the gray scale level c1 and then are changed to a white pixel.

In FIG. 14A, since a dark pixel denoted by *1 has a risk boundary, which is continuous in the vertical and horizontal directions, positioned on one corner located on the lower left side, the dark pixel is regarded to be brought into contact with the risk boundary and is a target of the correction unit 314 for determining whether a level darker than the gray scale level c1 is designated thereto. This is for handling a case where a pattern corresponding to bright pixels that is located on the lower left side of the dark pixel denoted by *1 moves in the diagonally upward direction by one pixel. In contrast to this, a dark pixel denoted by *2 has a risk boundary, which is fractured in only the horizontal direction (the same applies in the case of the vertical direction), located on one corner thereof, and a risk boundary that is continuous in the vertical and horizontal directions is not located. Accordingly, the dark pixel denoted by *2 is not the target of the correction unit 314 for determining the gray scale level. In addition, this reasoning may be employed regardless of the tilt azimuth angle θb. Thus, hereinafter, the description thereof will be omitted.

In a case where the movement of an image is detected in the video signal Vid-in over frame (n−1) to frame n, the correction unit 314, for a dark pixel satisfying the correction condition in frame n, in a case where the dark pixel is also brought into contact with the risk boundary in video signals Vid-in of k frame following them, the dark pixel is set as a correction target in the frames as well. Accordingly, when the pattern formed from the dark pixels having gray scales in the above-described gray scale range a stops without changing the image from frame n to frame (n+1), the correction unit 314, as shown in FIG. 15A, in the video signal Vid-d of frame (n+1), dark pixels satisfying the correction condition are corrected to the video signal Vid-out having a gray scale level c1 as shown in FIG. 14A. On the other hand, in a case where the image is not changed over frame (n+1) to frame (n+2) and frame (n+2) to (n+3), and the pattern formed from dark pixels having the above-described gray scale range a stops, as shown in FIGS. 15B and 15C, the correction unit 314 directly outputs the video signals Vid-d of frame (n+2) and frame (n+3) as the video signals Vid-out without correcting the video signals Vid-d. As above, in this embodiment, in order to suppress the reverse tilt domain, the correction unit 314 performs correction over consecutive two frames from time a when there is movement of the image.

The reason for employing such a configuration is based on the following.

Since alleviating the reverse tilt state means returning the vertical alignment of liquid crystal molecules having different tilt angle directions to the original vertical alignment, it is understood that there is a correlation between the response time of the liquid crystal 105 and a time (alleviation time) necessary for the alleviation. Although the different states of the tilt angle directions may variously change based on the intensity of the formation of the reverse tilt, the inventors understood that the reverse tilt is reliably alleviated by performing correction for decreasing the lateral direction electric field such that at least a response to black is delayed the most, and the response time of the liquid crystal 105 for the transition from white to black is satisfied. Accordingly, in order to satisfy the response time of the liquid crystal 105 of the liquid crystal panel 100 from the horizontal alignment to the vertical alignment, the correction unit 314 corrects the video signals Vid-d over a plurality of frames for performing the correction for decreasing the lateral direction electric field. In a case where the response time of the liquid crystal 105 is T (here, the response time from the horizontal alignment to the vertical alignment is considered), it is preferable that correction for suppressing the lateral direction electric field is performed for a period that is equal to or longer than T. However, when the time interval (one frame period) for updating the display of the liquid crystal panel 100 having the liquid crystal element 120 is S, and S<T, the correction is not performed for this response time, and there is a concern that the reverse tilt may occur between adjacent pixels before the liquid crystal 105 is alleviated. In contrast to this, in this embodiment, a configuration is employed in which the response time T of the liquid crystal 105 is 16.6 milliseconds, and the time interval S for updating the display of the liquid crystal panel 100 is 8.33 milliseconds, correction for decreasing the lateral direction electric field is performed over two frames from when there is movement in the image. In such a case, S×k=8.33 milliseconds×2=16.66 milliseconds, and the relationship of T=S×k is satisfied. In other words, in a case where the correction unit 314 performs correction for decreasing the lateral direction electric field over (k+1) frames so as to satisfy the relationship of T≤S×k, the correction corresponding to the response time of the liquid crystal 105 is made, whereby the advantage of suppressing the reverse tilt domain can be sufficiently acquired.

For example, in a case where a pattern (the above-described pattern formed from dark pixels having a gray scale range a) that generates a strong lateral direction electric field is scrolled at low speed at which an image represented by the video signal Vid-in is scrolled once for two frames, for 8.3 ms (120 Hz) immediately after the movement, the response time of the liquid crystal 105 for which the correction is not performed is insufficient for 16.6 ms. Accordingly, in such a case, the advantage of alleviating the reverse tilt state cannot be sufficiently acquired. Therefore, by including the frame period (8.3 ms) as a history that indicates the movement by using the delay circuit 310, correction can be performed over a total of two frames. As a result, the advantage of suppressing the reverse tilt domain can be sufficiently acquired.

From the above-described reason, the correction unit 314, as shown in FIG. 15A, the pixel as a correction target in frame n is set also as a correction target in frame (n+1). On the contrary, based on the viewpoint that correction corresponding to the response time of the liquid crystal 105 is sufficient, as shown in FIGS. 15B and 15C, the correction unit 314 does not correct the video signal Vid-d for frames (n+2) and (n+3).

Accordingly, a change in the effect relating to the suppressing of the reverse tilt domain can be suppressed. Furthermore, as shown in FIG. 16A, when the pattern moves again to frame (n+4), the correction unit 314 corrects the video signals Vid-d in frame (n+4) and the next frame (n+5). To the contrary, since correction corresponding to the response time of the liquid crystal 105 is sufficient, as shown in FIG. 16C, the correction unit 314 does not correct the video signal Vid-d of frame (n+6). The same applies to the frames after that.

As above, the video processing circuit 30 corrects the video signal so as to decrease the lateral direction electric field for pixels that are brought into contact with the risk boundary in the video signal of a plurality of frames from the current frame in which there is a change in the image to the following k frames. Accordingly, even in a case where the time interval for updating the display of the liquid crystal panel 100 is shorter than the response time of the liquid crystal 105 due to an increase in the driving speed of the liquid crystal panel 100 or the like, the advantage of decreasing the reverse tilt domain is acquired.

In addition, in this embodiment, a process is not performed for the entire image of one frame that is represented by the video signal, but only a process of detecting the boundary between pixels and the risk boundary is performed. Accordingly, compared to a configuration in which the movement is detected by analyzing an image of two or more frames, an increase in the scale or the complication of the video processing circuit can be suppressed. In addition, it is possible to prevent areas in which the reverse tilt domain can easily occur from being continuous in accordance with the movement of the black pixel.

Furthermore, in this embodiment, the pixels in which the video signals are corrected in the image defined by the video signal Vid-d are only pixels located on the downstream side of the tilt azimuth with respect to a dark pixel out of dark pixels, to which gray scale levels darker than the gray scale level c1 are designated, located adjacent to a bright pixel. Accordingly, a portion in which a display that is not based on the video signal Vid-d is generated is a dark pixel adjacent to a bright pixel regardless of the tilt azimuth angle, and suppression can be performed less than that of a configuration in which all the dark pixels to which gray scale levels darker than the gray scale level c1 are designated are uniformly corrected.

In addition, in this embodiment, since video signals having values that are equal to or greater than a set value are not uniformly clipped, by arranging an unused voltage range, there is no adverse influence on the contrast ratio. Furthermore, since a modification or the like of the structure of the liquid crystal panel 100 is not necessary, a decrease in the aperture ratio does not occur, and this embodiment can be applied to a liquid crystal panel that has been manufactured in advance without taking the structure into consideration.

Another Example of Tilt Azimuth Angle

In the above-described embodiment, a case has been described as an example in which the tilt azimuth angle θb is 45 degrees in the VA type. Next, an example will be described in which the tilt azimuth angle θb is other than 45 degrees.

Figure 17A:
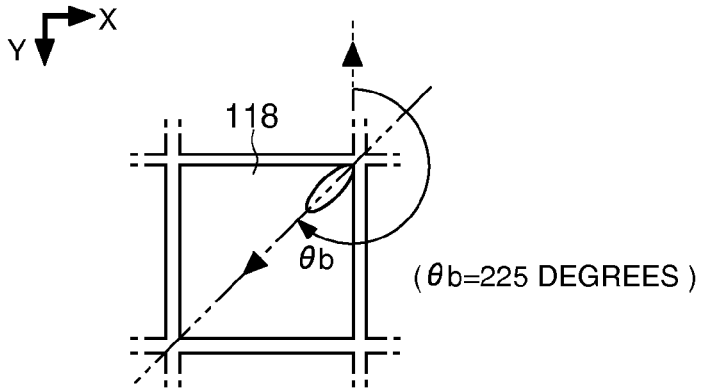
FIGS. 17A and 17B are diagrams in a case where a different tilt azimuth angle is set in the liquid crystal panel.
Figure 17B:
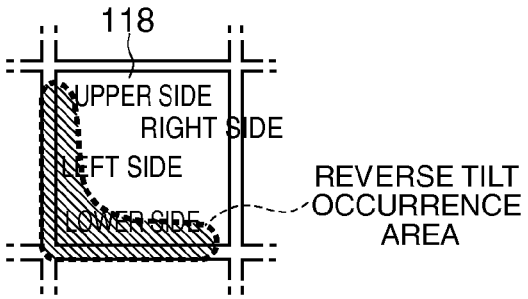

First, as shown in FIG. 17A, an example will be described in which the tilt azimuth angle θb is 225 degrees. In this example, when only a pixel of interest is changed to a bright pixel from a state in which liquid crystal molecules in the pixel and the peripheral pixels thereof are unstable, the reverse tilt occurs in the pixel, as shown in FIG. 17B, in the inner peripheral area disposed along the left side and the lower side.

This example is equivalent to a case where the example, in which the tilt azimuth angle θb is 45 degrees, shown in FIGS. 7A and 7B is rotated by 180 degrees.

In a case where the tilt azimuth angle θb is 225 degrees, of conditions (1) to (3) for the occurrence of the reverse tilt domain in a case where the tilt azimuth angle θb is 45 degrees, condition (2) is modified as follows. The condition is modified as (2) the bright pixel (to which a high voltage is applied) is located to the upper right side, the right side, or the upper side of the adjacent dark pixel (to which a low voltage is applied) that corresponds to the upstream side of liquid crystal molecules in the tilt azimuth in frame n. There is no change in condition (1) and condition (3). Accordingly, in a case where the tilt azimuth angle θb is 225 degrees, in frame n, in a case where a dark pixel and a bright pixel are adjacent to each other, and the dark pixel is located to the lower left side, the left side, or the lower side of the bright pixel, a countermeasure may be taken such that the liquid crystal molecules are not in an unstable state with respect to the liquid crystal element corresponding to the dark pixel.

Accordingly, the correction unit 314 of the video processing circuit 30 may correct a video signal based on the risk boundary of a portion in which a dark pixel is located on the lower side and a bright pixel is located on the upper side and a portion in which a dark pixel is located on the left side and a bright pixel is located on the right side out of the applied boundary detected by the movement detecting unit 308.

In a case where the tilt azimuth angle θb is 225 degrees, when the image shown in FIG. 12B satisfies the correction condition, the gray scale level of the black pixel that is brought into contact with the risk boundary shown in FIG. 14C is corrected to the gray scale level c1.

In such a configuration, in a case where the tilt azimuth angle θb is 225 degrees, even in a case where there is a portion that changes from a black pixel to a white pixel as an area formed from black pixels in the image defined by the video signal Vid-in moves to any of the lower left side, the left side, or the lower side by one pixel, in the liquid crystal panel 100, liquid crystal molecules are not directly changed from an unstable state to a white pixel but forcibly pass through a state in which the liquid crystal molecules are stable by applying the voltage Vc1 corresponding to the gray scale level c1 and then are changed to a white pixel. Accordingly, the occurrence of the reverse tilt domain can be suppressed.

Figure 18A:
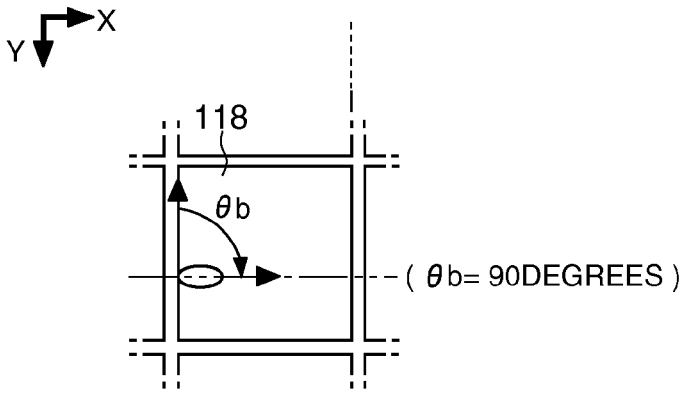
FIGS. 18A and 18B are diagrams in a case where a different tilt azimuth angle is set in the liquid crystal panel.
Figure 18B:
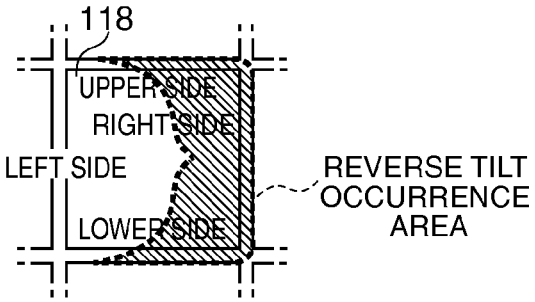

Next, as shown in FIG. 18A, an example will be described in which the tilt azimuth angle θb is 90 degrees. In this example, when only a pixel of interest is changed to a bright pixel from a state in which liquid crystal molecules in the pixel and the peripheral pixels thereof are unstable, the reverse tilt intensively occurs in the pixel, as shown in FIG. 18B, in an area disposed along the right side. Accordingly, it may be thought that the reverse tilt domain corresponding to the width occurring on the right side occurs also for the right side of the upper side and the right side of the lower side.

Accordingly, in a case where a tilt azimuth angle θb is 90 degrees, from among conditions (1) to (3) for the occurrence of the reverse tilt domain in a case where the tilt azimuth angle θb is 45 degrees, condition (2) is modified as follows. The condition is modified as (2) the bright pixel (to which a high voltage is applied) is located not only to the left side of the adjacent dark pixel (to which a low voltage is applied) that corresponds to the upstream side of liquid crystal molecules in the tilt azimuth in frame n but also to the upper side or the lower side that is influenced by the area generated on the left side. There is no change in condition (1) and condition (3).

Accordingly, in a case where the tilt azimuth angle θb is 90 degrees, in frame n, in a case where a dark pixel and a bright pixel are adjacent to each other, and the dark pixel is located to the right side, the lower side, or the upper side of the bright pixel, a countermeasure may be taken such that the liquid crystal molecules are not in an unstable state with respect to the liquid crystal element corresponding to the dark pixel.

Accordingly, the correction unit 314 of the video processing circuit 30 may correct a video signal based on the risk boundary of a portion in which a dark pixel is located on the right side and a bright pixel is located on the left side and a portion in which a dark pixel is located on the upper side and a bright pixel is located on lower side out of the applied boundary detected by the movement detecting unit 308.

In a case where the tilt azimuth angle θb is 90 degrees, when the image shown in FIG. 12B satisfies the correction condition, the gray scale level of the black pixel that is brought into contact with the risk boundary shown in FIG. 14B is corrected to the gray scale level c1.

In such a configuration, in a case where the tilt azimuth angle θb is 90 degrees, even in a case where there is a portion that changes from a black pixel to a white pixel as an area formed from black pixels in the image defined by the video signal Vid-in moves to any of the upper side, the upper right side, the right side, the lower right side, or the lower side by one pixel, in the liquid crystal panel 100, liquid crystal molecules are not directly changed from an unstable state to a white pixel but forcibly pass through a state in which the liquid crystal molecules are stable by applying the voltage Vc1 corresponding to the gray scale level c1 and then are changed to a white pixel. Accordingly, the occurrence of the reverse tilt domain can be suppressed.

Second Embodiment

Next, a second embodiment of the invention will be described. Further in this embodiment, the description will be presented on the premise of a normally black mode. This applies the same to each embodiment described below unless otherwise described. In addition, in the description presented below, the same reference numeral is assigned to the same configuration as that of the first embodiment, and the detailed description thereof will be appropriately omitted. In the above-described first embodiment, the video processing circuit 30 corrects only the dark pixels satisfying the correction condition to the gray scale level c1. However, in this embodiment, two or more dark pixels that are consecutive from a dark pixel, which is brought into contact with a risk boundary, to the opposite side of the risk boundary are also set as the correction targets that are corrected to the gray scale level c1.

As above, a difference between a video processing circuit 30 according to this embodiment and the video processing circuit 30 according to the first embodiment is that the number of dark pixels set as correction targets of a correction unit 314 is changed.

A determination section 3142 of the correction unit 314, similarly to the above-described first embodiment, determines that a pixel of interest satisfies the correction condition for a video signal Vid-d of frame n in a case where (I) the pixel represented by the video signal Vid-d is a dark pixel, (II) the boundary information mov_edge output from an OR circuit 312 indicates an applied boundary, and (III) the boundary information rsk_edge output from the risk boundary detecting unit 304 indicates a risk boundary. The conditions (I) to (III) are the same as those of the above-described first embodiment.

In a case where all the determination results are "Yes", the determination section 3142 outputs the flag Q of the output signal as "1". On the other hand, in a case where anyone of the determination results is "No", the determination section 3142 outputs the flag Q as "0". In addition, in a case where "Yes" is determined, (IV) the determination section 3142 treats dark pixels, which are dark pixels, are consecutive in a direction opposite to a risk boundary corresponding to an applied boundary, of which the gray scale levels represented by the video signal Vid-d belong to the gray scale range a, and from which distances to the risk boundary are within (L+1) pixels, as satisfying the correction condition. Then, the determination section 3142 outputs the value of the flag Q as "1" for the dark pixel that satisfies the correction condition. In this embodiment, L=1. In addition, the determination section 3142, for the dark pixel determined to satisfy the correction condition (IV) in frame n, determines that dark pixels that satisfy the condition (IV) in a plurality of frames from frame n to the following k frames satisfy the correction condition.

In a case where the flag Q is "1", when a level that is darker than the gray scale level c1 is designated to the dark pixel, the substitution section 3144 substitutes the gray scale level of the dark pixel with the gray scale level c1.

A specific example of the process of the video processing circuit 30 will be described.

For example, in a case where an image represented by a video signal Vid-in of frame (n−1) is as shown in FIG. 12A, and an image represented by a video signal Vid-in of frame n is as shown in FIG. 12B, when θb=45 degrees, pixels satisfying the correction condition are as shown in FIG. 19A.

In a case where movement is detected in at least one of frame n and frame (n−1), the correction unit 314 sets (L+1) dark pixels that are consecutive on the opposite side of the risk boundary from the dark pixel brought into contact with the risk boundary in the video signal Vid-d of frame n as correction targets. In other words, even in a case where an image is not changed over frame n to frame (n+1), and a pattern formed from dark pixels having gray scales in the above-described gray scale range a stops, as shown in FIG. 20A, the correction unit 314 sets a video signal Vid-d of frame (n+1) to be the same as the content shown in FIG. 19A so as to be corrected to the video signal Vid-out having the gray scale level c1. On the other hand, in a case where an image is not changed over frame (n+1) to (n+2) and frame (n+2) to frame (n+3), and a pattern formed from dark pixels having gray scales in the above-described gray scale range a stops, as shown in FIGS. 20B and 20C, the correction unit 314 directly outputs the video signal Vid-d as the video signal Vid-out without correcting the video signal Vid-d. The reasoning for frame (n+4) and after that is the same as that of the first embodiment.

In addition, with the same reasoning as that of the first embodiment, in a case where θb=90 degrees, pixels that satisfy the correction condition in the image shown in FIG. 12B are as shown in FIG. 19B. In a case where θb=225 degrees, pixels that satisfy the correction condition in the image shown in FIG. 12B are as shown in FIG. 19C.

According to this embodiment, a change in the applied voltage according to the correction of the video signal may be visually unnoticeable. Furthermore, according to this embodiment, in addition to the advantages described above, the advantages that are equivalent to those of the first embodiment are acquired.

Third Embodiment

Next, a third embodiment of the invention will be described.

In this embodiment, in the configuration according to the first embodiment, instead of dark pixels satisfying the correction condition, the video signals of bright pixels satisfying the correction condition are corrected. In this embodiment, correction of dark pixels is not performed. Accordingly, in this embodiment, instead of raising the gray scale levels of dark pixels so as to suppress "(3) the state in which the liquid crystal molecules in the pixels, which are changed to bright pixels in frame n, are unstable in frame (n−1) that is one frame before" described above, the lateral direction electric field is suppressed focusing on the condition that "(1) when frame n is considered, a dark pixel and a bright pixel are adjacent to each other, in other words, a pixel to which a low voltage is applied and a pixel to which a high voltage is applied are adjacent to each other, and the lateral direction electric field is strong". In other words, the video processing circuit 30 corrects the voltages applied to the liquid crystal elements 120 corresponding to bright pixels that are brought into contact with the risk boundary to be low, whereby a lateral direction electric field generated between a bright pixel and a dark pixel that are adjacent to each other with the risk boundary interposed therebetween is suppressed.

The determination section 3142 determines that a pixel of interest satisfies the correction condition for a video signal Vid-d of frame n in a case where (I) the pixel represented by the video signal Vid-d is a bright pixel, (II) the boundary information mov_edge output from the OR circuit 312 indicates an applied boundary, and (III) the boundary information rsk_edge output from the risk boundary detecting unit 304 indicates a risk boundary. In addition, as can be understood by substituting frame "n" with frame "(n+1)" and frame "(n−1)" with frame "n", the condition (II) indicates that, in a case where a pixel satisfying the correction condition in frame n satisfies the conditions (I) and (III) in frame (n+1), the determination section 3142 determines that the pixel also satisfies the correction condition in frame (n+1). This consideration is the same as that of the above-described first embodiment. In a case where all the determination results are "Yes", for example, the determination section 3142 outputs the flag Q of the output signal as "1". On the other hand, in a case where any one of the determination results is "No", the determination section 3142 outputs the flag Q as "0".

In a case where the flag Q supplied from the determination section 3142 is "1", the substitution section 3144 substitutes the bright pixel at a time when the flag Q is "1" with a video signal of a gray scale level c2 of the bright pixel designated by the video signal Vid-d and outputs the video signal as the video signal Vid-out. The gray scale level c2 corresponds to a voltage Vc2 (fourth voltage) applied to the liquid crystal element 120 and can be acquired as one applied voltage that is lower than the threshold value Vth2 and is higher than the threshold value Vth1. However, it is preferable that this applied voltage Vc2 is within a change of 10% from the brightness of a case where correction is not made.

In addition, in a case where the flag Q supplied from the determination section 3142 is "0", or a level darker than the gray scale level c2 is designated to a bright pixel at a time when the flag Q is "1", the substitution section 3144 directly outputs the video signal Vid-d as the video signal Vid-out without the substitution of the gray scale level.

A specific example of the process of the video processing circuit 30 will be described.

For example, in a case where an image represented by a video signal Vid-in of frame (n−1) is as shown in FIG. 12A, and an image represented by a video signal Vid-in of frame n is as shown in FIG. 12B, when θb=45 degrees, pixels satisfying the correction condition are as shown in FIG. 21A.

In a case where movement is detected in at least one of frame n and frame (n−1), when a bright pixel is brought into contact with the risk boundary in the video signal Vid-d of frame n, the correction unit 314 sets the bright pixel as a correction target. In other words, even in a case where an image is not changed over frame n to frame (n+1), and a pattern formed from dark pixels having gray scales in the above-described gray scale range a stops, as shown in FIG. 22A, the correction unit 314 sets a video signal Vid-d of frame (n+1) to be the same as the content shown in FIG. 21A so as to be corrected to the video signal Vid-out having the gray scale level c2. On the other hand, in a case where an image is not changed over frame (n+1) to (n+2) and frame (n+2) to frame (n+3), and a pattern formed from dark pixels having gray scales in the above-described gray scale range a stops, as shown in FIGS. 22B and 22C, the correction unit 314 directly outputs the video signal Vid-d as the video signal Vid-out without correcting the video signal Vid-d. The reasoning for frame (n+4) and after that is the same as that of the first embodiment.

In addition, with the same reasoning as that of the first embodiment, in a case where θb=90 degrees, pixels that satisfy the correction condition in the image shown in FIG. 12B are as shown in FIG. 21B. In a case where θb=225 degrees, pixels that satisfy the correction condition in the image shown in FIG. 12B are as shown in FIG. 21C.

Accordingly, an electric potential difference between a bright pixel and a dark pixel that are adjacent to each other with the risk boundary interposed therebetween is suppressed to be small, and thus the lateral direction electric field decreases. Therefore, the occurrence of the reverse tilt domain due to the lateral direction electric field is suppressed. In addition, the advantages equivalent to those of the above-described configuration according to the first embodiment are acquired.

Fourth Embodiment

Next, a fourth embodiment of the invention will be described.

In the above-described third embodiment, the video processing circuit 30 corrects the gray scales of only the bright pixels satisfying the correction condition to the gray scale level c2. However, in this embodiment, two or more bright pixels that are consecutive from a bright pixel, which is brought into contact with a risk boundary, to the opposite side of the risk boundary are also set as the correction targets that are corrected to the gray scale level c2.

As above, a difference between a video processing circuit 30 according to this embodiment and the video processing circuit 30 according to the third embodiment is that the number of bright pixels set as correction targets of a correction unit 314 is changed.

Further in this embodiment, the dark pixels are not corrected.

A determination section 3142 of the correction unit 314 determines that a pixel of interest satisfies the correction condition for a video signal Vid-d of frame n in a case where (I) the pixel represented by the video signal Vid-d is a bright pixel, (II) the boundary information mov_edge output from an OR circuit 312 indicates an applied boundary, and (III) the boundary information rsk_edge output from the risk boundary detecting unit 304 indicates a risk boundary. The conditions (I) to (III) are the same as those of the above-described third embodiment.

In a case where all the determination results are "Yes", the determination section 3142 outputs the flag Q of the output signal as "1". On the other hand, in a case where anyone of the determination results is "No", the determination section 3142 outputs the flag Q as "0". In addition, in a case where "Yes" is determined, (IV) the determination section 3142 outputs the value of the flag Q as "1" for bright pixels that are bright pixels, which are consecutive in a direction opposite to a risk boundary corresponding to an applied boundary, of which the gray scale levels represented by the video signal Vid-d belong to the gray scale range b, and from which distances to the risk boundary are within (L+1) pixels. In this embodiment, L=1. In addition, the determination section 3142, for the bright pixel determined to satisfy the correction condition (IV) in frame n, determines that bright pixels that satisfy the condition (IV) in a plurality of frames from frame n to the following k frames satisfy the correction condition.

In a case where the flag Q is "1", the substitution section 3144 substitutes the gray scale level of the bright pixel with the gray scale level c2.

A specific example of the process of the video processing circuit 30 will be described.

For example, in a case where an image represented by a video signal Vid-in of frame (n−1) is as shown in FIG. 12A, and an image represented by a video signal Vid-in of frame n is as shown in FIG. 12B, when θb=45 degrees, pixels satisfying the correction condition are as shown in FIG. 23A.

In a case where movement is detected in at least one of frame n and frame (n−1), the correction unit 314 sets (L+1) bright pixels that are consecutive on the opposite side of the risk boundary from the bright pixel brought into contact with the risk boundary in the video signal Vid-d of frame n as correction targets. In other words, in a case where an image is not changed over frame n to frame (n+1), and a pattern formed from dark pixels having gray scales in the above-described gray scale range a stops, as shown in FIG. 24A, the correction unit 314 sets a video signal Vid-d of frame (n+1) to be the same as the content shown in FIG. 23A so as to be corrected to the video signal Vid-out having the gray scale level c2. On the other hand, in a case where an image is not changed over frame (n+1) to (n+2) and frame (n+2) to frame (n+3), and a pattern formed from dark pixels having gray scales in the above-described gray scale range a stops, as shown in FIGS. 24B and 24C, the correction unit 314 directly outputs the video signal Vid-d as the video signal Vid-out without correcting the video signal Vid-d. The reasoning for frame (n+4) and after that is the same as that of the first embodiment.

In addition, with the same reasoning as that of the first embodiment, in a case where θb=90 degrees, pixels that satisfy the correction condition in the image shown in FIG. 12B are as shown in FIG. 23B. In a case where θb=225 degrees, pixels that satisfy the correction condition in the image shown in FIG. 12B are as shown in FIG. 23C.

As above, since bright pixels determined based on the tilt azimuth of the liquid crystal element 120 are set as the correction targets, the occurrence of the reverse tilt domain can be suppressed while suppressing a change from the original image. In addition, from the viewpoint that the change in the applied voltage due to the correction of the video signal is not visually noticeable, the same advantages as those of the second embodiment are acquired.

Fifth Embodiment

Next, a fifth embodiment of the invention will be described.

In addition, in the description presented below, the same reference numerals are assigned to the same configuration as that of the first embodiment, and the detailed description thereof will be appropriately omitted. In this embodiment, both the correction of dark pixels that has been described in the first embodiment and the correction of bright pixels that has been described in the third embodiment are performed.

In other words, the video processing circuit 30 according to this embodiment corrects the video signal so as not to satisfy the conditions (1) and (3) described above.

Figure 25:
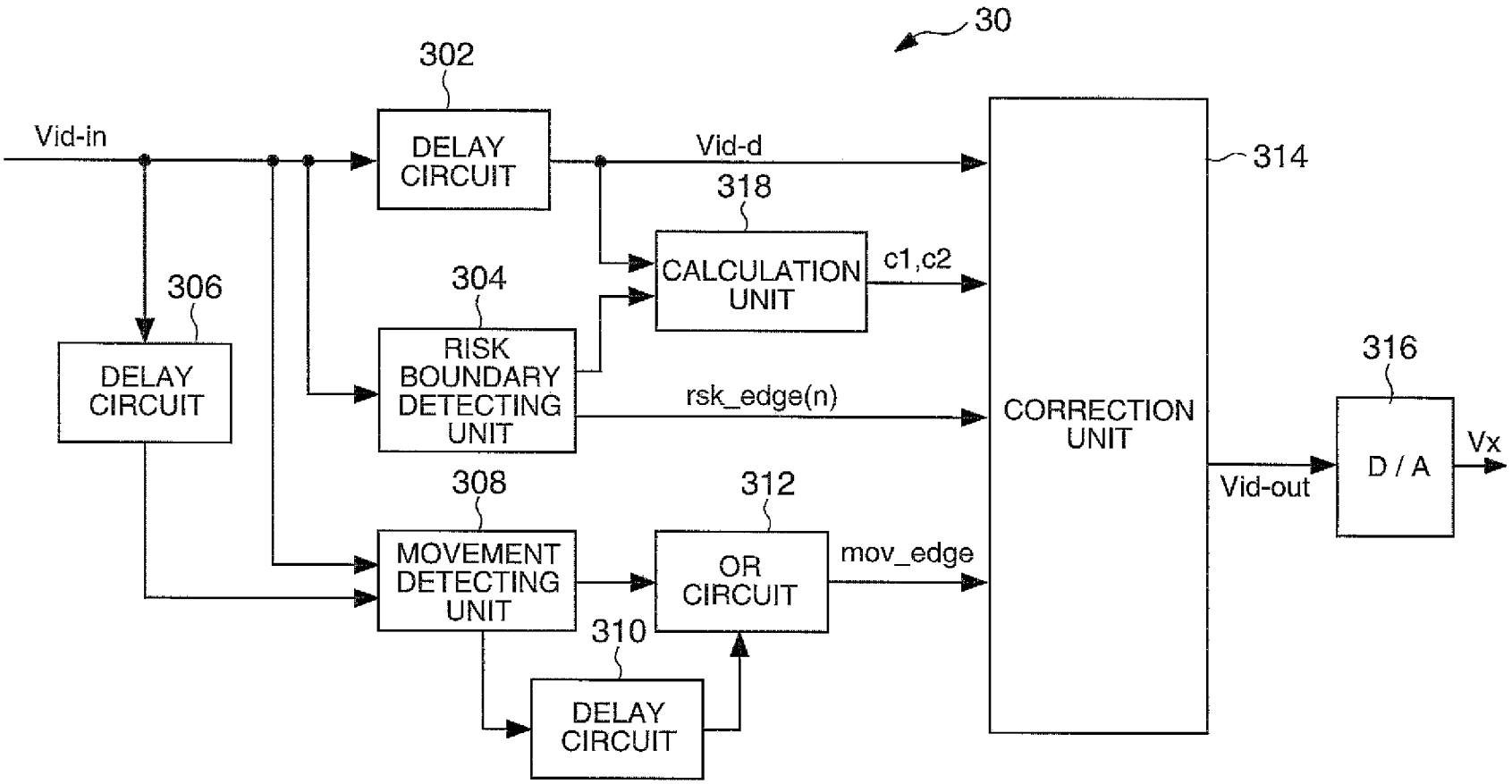
FIG. 25 is a diagram showing the configuration of a video processing circuit according to a fifth embodiment of the invention.

FIG. 25 is a diagram showing the configuration of the video processing circuit 30 according to the fifth embodiment of the invention. Differences between this video processing circuit 30 and the above-described video processing circuit 30 according to the first embodiment are that a calculation unit 318 is added, and the determination content of the determination section 3142 is changed in this embodiment. Described in more detail, in the normally black mode, for example, in a case where the pixel represented by the video signal Vid-d is brought into contact with a risk boundary, first, when the pixel is a dark pixel, the calculation unit 318 calculates and outputs a gray scale level c1 for the dark pixel, and, when the pixel is a bright pixel, the calculation unit 318 calculates and outputs a gray scale level c2 for the bright pixel.

A determination section 3142 of the correction unit 314 determines that a pixel of interest satisfies the correction condition for a video signal Vid-d of frame n in a case where (I) the pixel represented by the video signal Vid-d is a dark pixel or a bright pixel, (II) the boundary information mov_edge output from an OR circuit 312 indicates an applied boundary, and (III) the boundary information rsk_edge output from the risk boundary detecting unit 304 indicates a risk boundary. In addition, as can be understood by substituting frame "n" with frame "(n+1)" and frame "(n−1)" with frame "n", the condition (II) indicates that, in a case where a pixel satisfying the correction condition in frame n satisfies the conditions (I) and (III) in frame (n+1), the determination section 3142 determines that the pixel also satisfies the correction condition in frame (n+1). This consideration is the same as that of the above-described first embodiment. In a case where all the determination results are "Yes", the determination section 3142 outputs the flag Q of the output signal as "1". On the other hand, in a case where any one of the determination results is "No", the determination section 3142 outputs the flag Q as "0".

In a case where the flag Q output from the determination section 3142 is "1", the substitution section 3144 substitutes the gray scale level of the dark pixel or the bright pixel of the video signal Vid-d with a gray scale level that is output from the calculation unit 318 and outputs the video signal as the video signal Vid-out. In other words, in a case where the gray scale level of the dark pixel at a time when the flag Q is "1" lower than c1, the substitution section 3144 corrects the video signal Vid-d to the gray scale level c1 that is output from the calculation unit 318 and outputs the corrected video signal as the video signal Vid-out. In addition, the substitution section 3144 corrects the video signal Vid-d of the bright pixel at a time when the flag Q is "1" to the gray scale level c2 that is output from the calculation unit 318 and outputs the corrected video signal as the video signal Vid-out.

A specific example of the process of the video processing circuit 30 will be described.

For example, in a case where an image represented by a video signal Vid-in of frame (n−1) is as shown in FIG. 12A, and an image represented by a video signal Vid-in of frame n is as shown in FIG. 12B, when θb=45 degrees, pixels satisfying the correction condition are as shown in FIG. 26A.

In a case where movement is detected in at least one of frame n and frame (n−1), the correction unit 314 sets dark pixels or bright pixels that are brought into contact with the risk boundary in the video signal Vid-d of frame n as correction targets. In other words, even in a case where an image is not changed over frame n to frame (n+1), and a pattern formed from dark pixels having gray scales in the above-described gray scale range a stops, as shown in FIG. 27A, the correction unit 314 sets a video signal Vid-d of frame (n+1) to be the same as the content shown in FIG. 26A so as to be corrected to the video signal Vid-out having the gray scale level c1 or c2. On the other hand, in a case where an image is not changed over frame (n+1) to (n+2) and frame (n+2) to frame (n+3), and a pattern formed from dark pixels having gray scales in the above-described gray scale range a stops, as shown in FIGS. 27B and 27C, the correction unit 314 directly outputs the video signal Vid-d as the video signal Vid-out without correcting the video signal. The reasoning for frame (n+4) and after that is the same as that of the first embodiment.

In addition, with the same reasoning as that of the first embodiment, in a case where θb=90 degrees, pixels that satisfy the correction condition in the image shown in FIG. 12B are as shown in FIG. 26B. In a case where θb=225 degrees, pixels that satisfy the correction condition in the image shown in FIG. 12B are as shown in FIG. 26C.

According to this embodiment, the advantages that are equivalent to those of both the first and third embodiments are acquired. In addition, by further suppressing a lateral direction electric field generated between a bright pixel and a dark pixel that are adjacent to each other with the risk boundary interposed therebetween, the occurrence of the reverse tilt domain can be further suppressed.

Sixth Embodiment

Next, a sixth embodiment of the invention will be described.

In the above-described fifth embodiment, the video processing circuit 30 corrects only the dark pixels and the bright pixels that satisfy the correction condition to the gray scale levels c1 and c2. However, in this embodiment, two or more dark pixels and bright pixels corresponding to a defined number that are consecutive from a dark pixel and a bright pixel, which are brought into contact with a risk boundary, to the opposite side of the risk boundary are also set as the correction targets for the video signals.

In the description presented below, the same reference numerals are assigned to the same configuration as that of the fifth embodiment, and the detailed description thereof will be appropriately omitted. Differences between the video processing circuit 30 according to this embodiment and the above-described video processing circuit 30 according to the fifth embodiment are the content calculated by the calculation unit 318 and a change in the determination content of the determination section 3142.

A determination section 3142 of the correction unit 314, determines that a pixel of interest satisfies the correction condition for a video signal Vid-d of frame n in a case where (I) the pixel represented by the video signal Vid-d is a dark pixel or a bright pixel, (II) the boundary information mov_edge output from an OR circuit 312 indicates an applied boundary, and (III) the boundary information rsk_edge output from the risk boundary detecting unit 304 indicates a risk boundary.

The conditions (I) to (III) are the same as those of the above-described fifth embodiment.

In a case where all the determination results are "Yes", the determination section 3142 outputs the flag Q of the output signal as "1". On the other hand, in a case where anyone of the determination results is "No", the determination section 3142 outputs the flag Q as "0". In addition, in a case where "Yes" is determined, the determination section 3142 treats that (IV) dark pixels or bright pixels, which are dark pixels or bright pixels, consecutive in a direction opposite to a risk boundary corresponding to an applied boundary, of which the gray scale levels represented by the video signal Vid-d belong to the gray scale range a or b, and from which distances to the risk boundary are within (L+1) pixels, as satisfying the correction condition. Then, the determination section 3142 outputs the value of the flag Q as "1" for the dark pixel or the bright pixel that satisfies the correction condition. In this embodiment, L=1. In addition, the determination section 3142, for the dark pixel or the bright pixel that has been determined to satisfy the correction condition (IV) in frame n, determines that dark pixels or bright pixels that satisfy the condition (IV) in a plurality of frames from frame n to the following k frames satisfy the correction condition.

In a case where the gray scale level of the dark pixel at a time when the flag Q is "1" is lower than c1, the substitution section 3144 corrects the video signal Vid-d to the gray scale level c1 output from the calculation unit 318 and outputs the corrected video signal as the video signal Vid-out. In addition, the substitution section 3144 corrects the video signal Vid-d of the bright pixel at a time when the flag Q is "1" to the gray scale level c2 output from the calculation unit 318 and outputs the corrected video signal as the video signal Vid-out.

A specific example of the process of the video processing circuit 30 will be described.

For example, in a case where an image represented by a video signal Vid-in of frame (n−1) is as shown in FIG. 12A, and an image represented by a video signal Vid-in of frame n is as shown in FIG. 12B, when θb=45 degrees, pixels satisfying the correction condition are as shown in FIG. 28A.

In a case where movement is detected in at least one of frame n and frame (n−1), the correction unit 314 sets (L+1) dark pixels or bright pixels that are consecutive on the opposite side of the risk boundary from the dark pixel or the bright pixel that is brought into contact with the risk boundary in the video signal Vid-d of frame n as correction targets. In other words, even in a case where an image is not changed over frame n to frame (n+1), and a pattern formed from dark pixels having gray scales in the above-described gray scale range a stops, as shown in FIG. 29A, the correction unit 314 sets a video signal Vid-d of frame (n+1) to be the same as that shown in FIG. 28A so as to be corrected to the video signal Vid-out having the gray scale level c1 or c2. On the other hand, in a case where an image is not changed over frame (n+1) to (n+2) and frame (n+2) to frame (n+3), and a pattern formed from dark pixels having gray scales in the above-described gray scale range a stops, as shown in FIGS. 29B and 29C, the correction unit 314 directly outputs the video signal Vid-d as the video signal Vid-out without correcting the video signal Vid-d. The reasoning for frame (n+4) and after that is the same as that of the fifth embodiment.

In addition, with the same reasoning as that of the first embodiment, in a case where θb=90 degrees, pixels that satisfy the correction condition in the image shown in FIG. 12B are as shown in FIG. 28B. In a case where θb=225 degrees, pixels that satisfy the correction condition in the image shown in FIG. 12B are as shown in FIG. 28C. As above, since the pixels that are determined based on the tilt azimuth of the liquid crystal element 120 are set as the correction target, the occurrence of the reverse tilt domain can be suppressed while suppressing a change from the original image.

According to the configuration of this embodiment, advantages that are equivalent to those of the fifth embodiment are acquired. In addition, for the same reason as that of the second and fourth embodiments, the change in the applied voltage may be visually unnoticeable based on the correction of the video signal.

Seventh Embodiment

Next, a seventh embodiment of the invention will be described.

In the description presented below, the same reference numerals are assigned to the same configuration as that of the sixth embodiment, and the detailed description thereof will be appropriately omitted.

In the above-described sixth embodiment, video signals are corrected for a plurality of bright pixels and a plurality of dark pixels that are adjacent to each other with a risk boundary interposed therebetween. In contrast to this, according to this embodiment, a video processing circuit 30 detects a boundary between a dark pixel and a bright pixel in the current frame, and pixels that are brought into contact with the risk boundary that moves by one pixel over the previous frame (frame (n−1)) to the current frame (frame n) out of the detected boundary are set as correction targets. As described above with reference to FIG. 36, in a case where an area of dark pixels on the background of bright pixels moves by two or more pixels for each frame, such a trail phenomenon is not actualized (or it is difficult for the trail phenomenon to be visually noticeable). Accordingly, the video processing circuit 30 sets pixels adjacent to the risk boundary that have moved by one pixel as correction targets.

Figure 30:
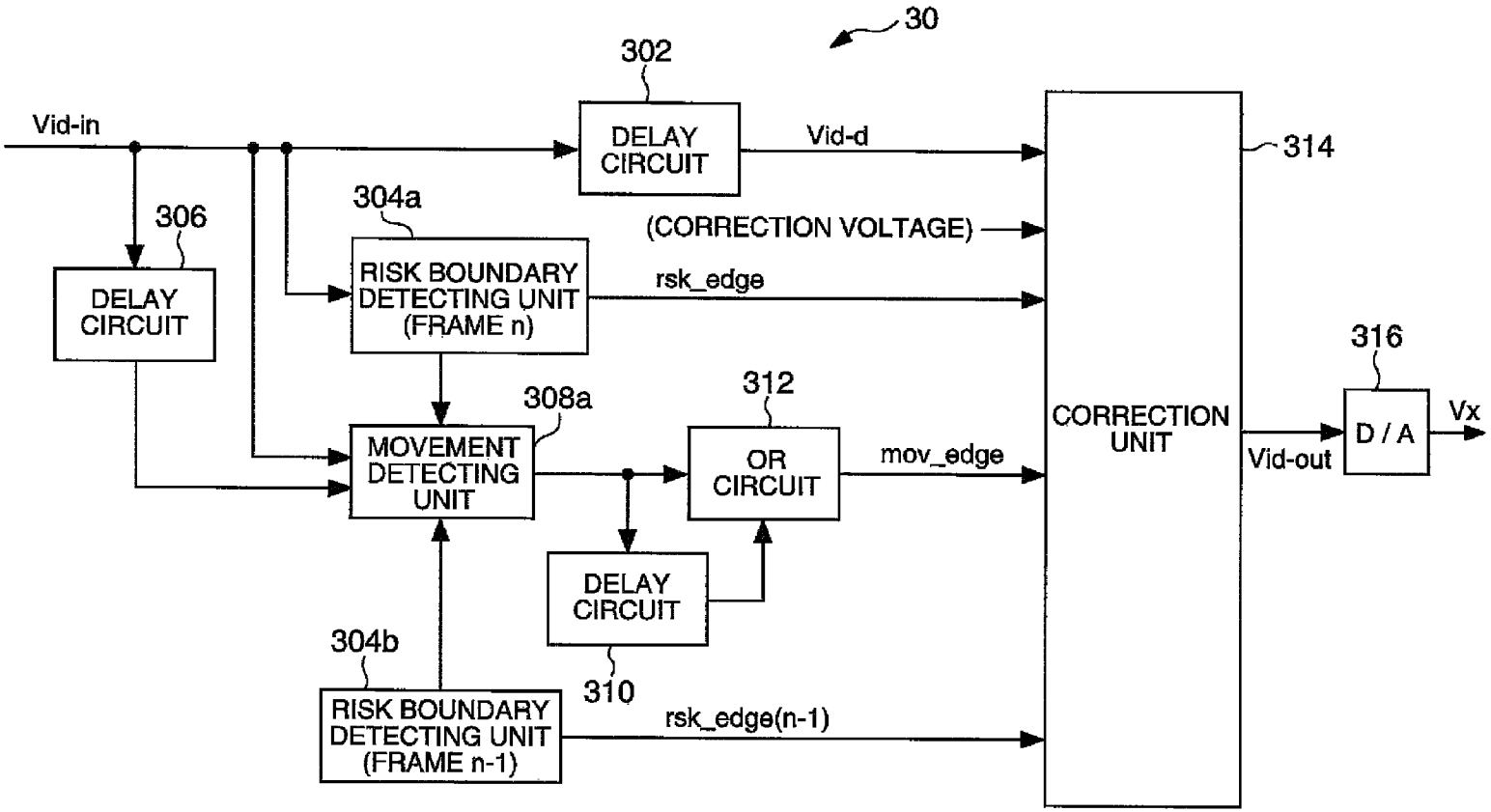
FIG. 30 is a diagram showing the configuration of a video processing circuit according to a seventh embodiment of the invention.

FIG. 30 is a block diagram showing the configuration of the video processing circuit 30 according to the seventh embodiment of the invention. A difference between the video processing circuit 30 according to this embodiment and the above-described video processing circuit 30 according to the sixth embodiment is that risk boundary detecting units 304*a* and 304*b* and a movement detecting unit 308*a* are disposed in this embodiment. In addition, a "correction voltage" shown in FIG. 30 is the simplification of the correction voltage output by the above-described calculation unit 318 according to the sixth embodiment.

The risk boundary detecting units 304*a* and 304*b* respectively have a configuration that is equivalent to that of the sixth embodiment. However, the risk boundary detecting unit 304*a* detects a risk boundary based on the video signal Vid-in of frame n and outputs boundary information rsk_edge that represents the position of the risk boundary. The risk boundary detecting unit 304*b* detects a risk boundary based on the video signal Vid-in of frame (n−1) read out from the delay circuit 306 and outputs boundary information rsk_edge(n−1).

The movement detecting unit 308*a* detects the movement of an image based on the risk boundaries detected from images represented by the video signals Vid-in of frame n and frame (n−1) by the risk boundary detecting units 304*a* and 304*b*. In a case where the boundary information rsk_edge(n) and rsk_edge(n−1) output from the risk boundary detecting units 304*a* and 304*b* indicates that there is movement in the risk boundary, the movement detecting unit 308*a* outputs boundary information that represents the position of the risk boundary that has moved.

The detailed configuration of the correction unit 314 will be described with reference to FIG. 31.

The correction unit 314 includes a determination section 3142 and a substitution section 3144.

The determination section 3142 determines whether or not a pixel represented by the video signal Vid-d that is output from the delay circuit 302 satisfies the correction condition. In a case where the determination result is "Yes", the determination section 3142 sets the flag Q of the output signal to "1". On the other hand, in a case where the determination result is "No", the determination section 3142 outputs the flag Q as "0". More specifically, the determination section 3142 determines that a pixel of interest satisfies the correction condition for a video signal Vid-d of frame n in a case where (I) the pixel represented by the video signal Vid-d is a dark pixel or a bright pixel, (II) the boundary information mov_edge output from the OR circuit 312 indicates a moved risk boundary, and (III) results of the boundary information rsk_edge(n) and rsk_edge(n−1) indicate risk boundaries moved by one pixel. In (III), the determination section 3142 does not detect a risk boundary that has not moved from the previous frame and a risk boundary that has moved by two or more pixels.

In a case where all the determination results are "Yes", the determination section 3142 outputs the flag Q of the output signal as "1". On the other hand, in a case where anyone of the determination results is "No", the determination section 3142 outputs the flag Q as "0". In addition, in a case where "Yes" is determined, the determination section 3142, similarly to the sixth embodiment, determines pixels that satisfy the correction condition of each frame based on the condition (IV). In other words, as shown in FIG. 36, in a case where the image moves, the correction unit 314 performs correction for suppressing the reverse tilt domain.

As above, aspects other than the changed correction condition are the same as those of the above-described sixth embodiment. Accordingly, a portion in which the reverse tilt domain can more easily occur can be narrowed and corrected by the correction unit 314. Accordingly, the occurrence of the reverse tilt domain can be effectively suppressed while further suppressing the change in the video signal.

According to the configuration of this embodiment, the advantages that are equivalent to those of the above-described sixth embodiment can be acquired. In addition, the configuration in which pixels as correction targets are determined based on the risk boundary that has moved by one pixel may be applied to the above-described configurations according to the first to fifth embodiments. In this case, the configuration of the portion denoted by the "correction voltages" is applied to each embodiment, and the correction process of the correction unit 314 corresponds to each embodiment.

MODIFIED EXAMPLES

Modified Example 1

TN Type

In the above-described embodiments, an example has been described in which the VA type is used in the liquid crystal 105. Thus, next, an example will be described in which the TN type is used in the liquid crystal 105.

FIG. 32A is a diagram showing 2×2 pixels of the liquid crystal panel 100, and FIG. 32B is a simplified cross-sectional view taken along a vertical plane that includes a line p-q shown in FIG. 32A.

As shown in the figures, the initial alignment of liquid crystal molecules in the TN type is assumed to be at a tilt angle θa and a tilt azimuth angle θb (=45 degrees) in a state in which an electric potential difference between the pixel electrode 118 and the common electrode 108 is zero. In contrast to the VA type, in the TN type, since the liquid crystal molecules tilt in the substrate horizontal direction, the tilt angle θa of the TN type is larger than that of the VA type.

In the example in which the TN type is used in the liquid crystal 105, owing to the acquisition of a high contrast ratio and the like, a normally white mode is frequently used in which the liquid crystal element 120 is a white pixel when no voltage is applied thereto.

Figure 5B:
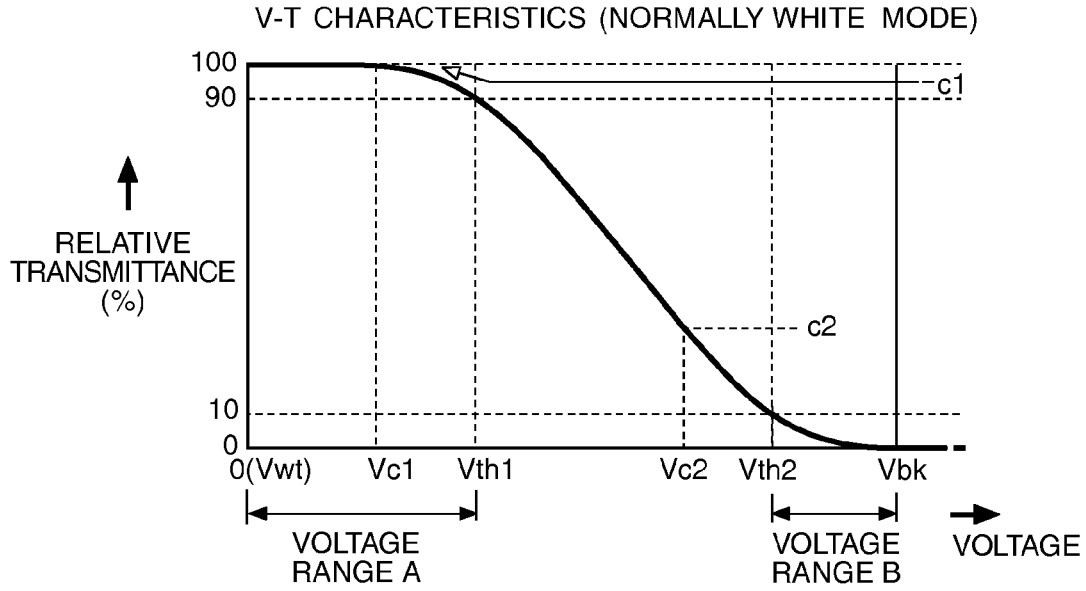

Accordingly, when the TN type is used in the liquid crystal 105, and the normally white mode is used, the relationship between the application voltage and the transmittance of the liquid crystal element 120, as shown in FIG. 5B, is represented as the V-T characteristics. Thus, as the application voltage increases, the transmittance decreases. However, when the application voltage of the liquid crystal element 120 is lower than a voltage Vc1, the liquid crystal molecules are in an unstable state, which is the same as those of the normally black mode.

Figure 33A:
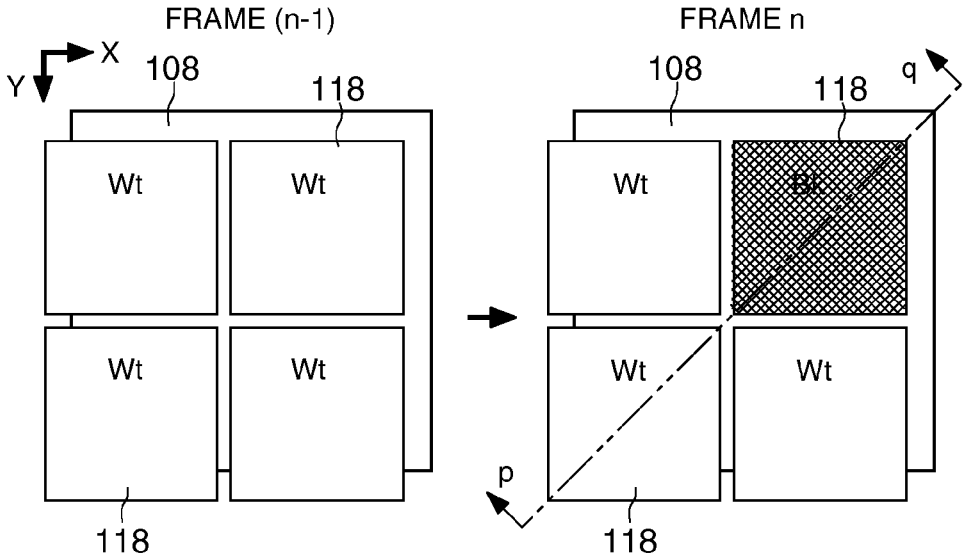
FIGS. 33A to 33C are diagrams illustrating a reverse tilt that is generated in the liquid crystal panel.
Figure 33B:
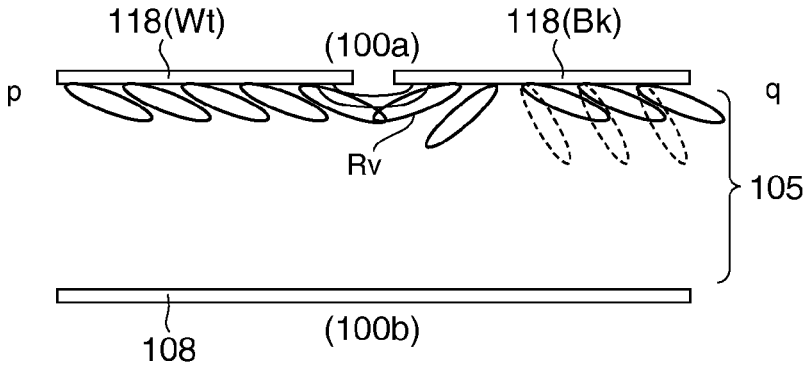

In the normally white mode of the TN type, as shown in FIG. 33A, a time when only one pixel located on the upper right side is changed to a black pixel in frame n from a white pixel state in which the liquid crystal molecules of all the four pixels of 2×2 are unstable in frame (n−1) will be considered. As described above, in the normally white mode, the electric potential difference between the pixel electrode 118 and the common electrode 108 of a back pixel is larger than that of a white pixel, in contrast to the normally black mode. Accordingly, in the pixel, which is located on the upper right side, changed from white to black, as shown in FIG. 33B, the liquid crystal molecules attempt to erect from a state denoted by solid lines to a state denoted by broken lines in a direction (the vertical direction of the substrate face) following the electric field direction.

However, an electric potential difference generated between the pixel electrode 118 (Wt) of the white pixel and the pixel electrode 118 (Bk) of the black pixel is at the same level as that of an electric potential difference generated between the pixel electrode 118 (Bk) of the black pixel and the common electrode 108, and a gap between the pixel electrodes is smaller than the gap between the pixel electrode 118 and the common electrode 108. Accordingly, in terms of the intensity of the electric field, a lateral direction electric field generated between the pixel electrode 118 (Wt) and the pixel electrode 118 (Bk) is stronger than the vertical electric field generated between the pixel electrode 118 (Bk) and the common electrode 108.

Since the pixel located on the upper right side is a white pixel in which the liquid crystal molecules are unstable in frame (n−1), it takes time for the liquid crystal molecules to tilt in accordance with the intensity of the vertical electric field.

On the other hand, since the lateral direction electric field generated from the adjacent pixel electrodes 118 (Wt) is stronger than the vertical electric field generated in accordance with the application of a voltage of a black level to the pixel electrode 118 (Bk), in the pixel set to be black, as shown in FIG. 31B, a liquid crystal molecule Rv located on a side adjacent to the white pixel is in the reverse tilt state before the other liquid crystal molecules set to tilt in accordance with the vertical electric field.

The liquid crystal molecule Rv that is in the reverse tilt state first has an adverse influence on the movement of the other liquid crystal molecules so as to erect in the substrate horizontal direction as denoted by dotted lines in accordance with the vertical electric field.

Figure 33C:
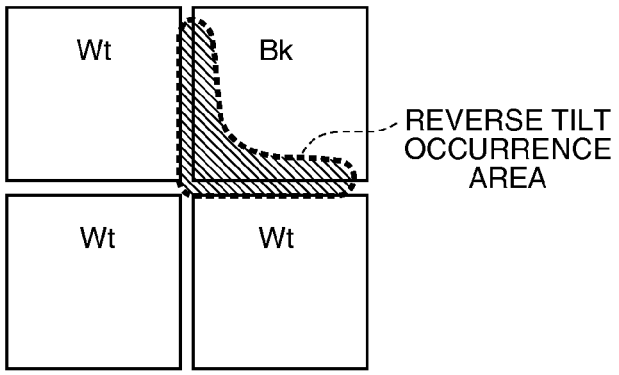

Accordingly, an area in which the reverse tilt occurs in the pixel to be changed to black, as shown in FIG. 33C, does not stay in a gap (interval) between the pixel to be changed to black and the white pixels but broadly spreads in a form eroding the pixel to be changed to black in the gap.

Accordingly, based on the content illustrated in FIGS. 33A to 33C, in a case where the periphery of a pixel of interest, which will be changed to black, corresponds to white pixels, when the white pixels are adjacent to the lower left side, the left side, and the lower side of the pixel of interest, the reverse tilt occurs in the inner peripheral area along the left side and the lower side in the pixel of interest.

Figure 34A:
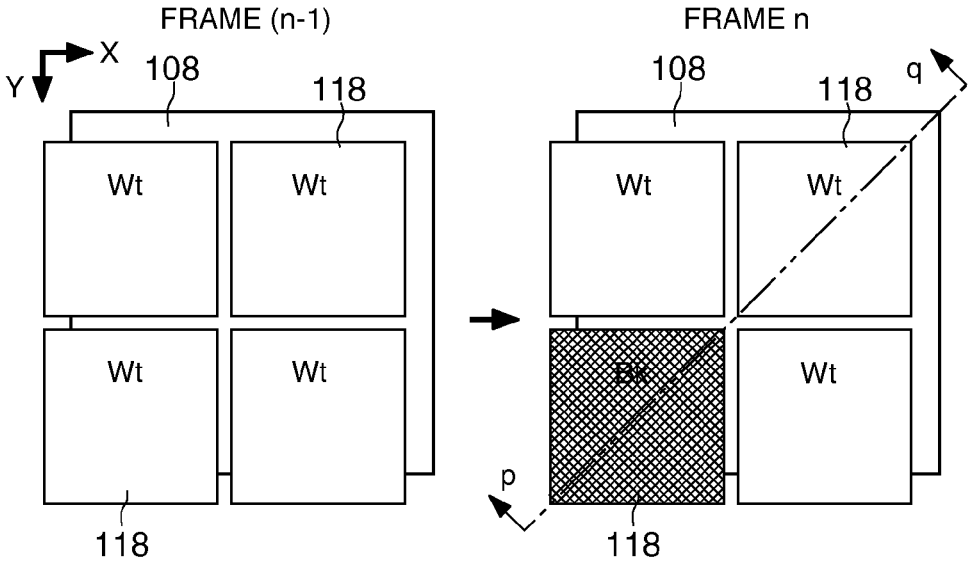
FIGS. 34A to 34C are diagrams illustrating a reverse tilt that is generated in the liquid crystal panel.
Figure 34B:
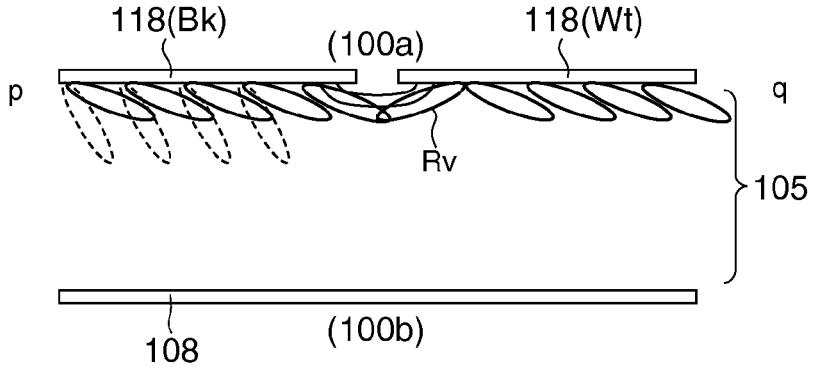
Figure 34C:
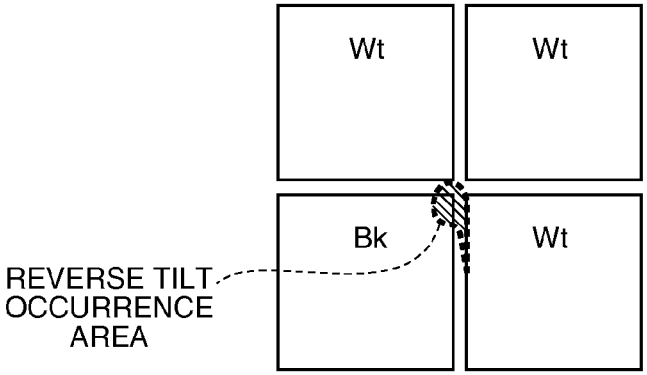

On the other hand, as shown in FIG. 34A, a time when only one pixel located on the lower left side is changed to a black pixel in frame n from a white pixel state in which the liquid crystal molecules of all the four pixels of 2×2 are unstable in frame (n−1) will be considered. In accordance with this change, the lateral direction electric field is generated in the gap between the pixel electrode 118 (Bk) of the black pixel and the pixel electrode 118 (Wt) of the white pixel that is stronger than the vertical electric field in the gap between the pixel electrode 118 (Bk) and the common electrode 108. In accordance with the lateral direction electric field, as shown in FIG. 34B, the alignment of a liquid crystal molecule Rv in the white pixel that is located on a side adjacent to the black pixel changes before the other liquid crystal molecule set to tilt in accordance with the vertical electric field so as to be in the reverse tilt state. However, there is no change in the intensity of the vertical electric field from frame (n−1) in the white pixel, and accordingly, the liquid crystal molecule scarcely has an adverse influence on the other liquid crystal molecules. Accordingly, an area in which the reverse tilt occurs in the pixel that is not changed from the white pixel, as shown in FIG. 34C, is narrow so as to be negligible in comparison with the example shown in FIG. 33C.

On the other hand, among four pixels of 2×2, which is changed from white to black, located on the lower left side, the initial alignment direction of the liquid crystal molecules is a direction for which the influence of the lateral direction electric field cannot be easily received. Accordingly, even when the vertical electric field is added, there is scarcely any liquid crystal molecule that is in the reverse tilt state. Accordingly, in the lower left pixel, as the intensity of the vertical electric field increases, the liquid crystal molecules correctly erect as denoted by broken lines in FIG. 32B in the vertical direction of the substrate face, and as a result, the pixel is changed to a targeted black pixel, whereby the deterioration of the display quality does not occur.

Accordingly, in the case of the normally white mode with a tilt azimuth angle θb of 45 degrees in the TN type, condition (1) is not changed at all, (2) in a case where the dark pixel (a voltage applied thereto is high) is located to the upper right side, the right side, or the upper side of an adjacent bright pixel (a voltage applied thereto is low) in frame n, and (3) in a case where in the pixel that is changed to a black pixel in frame n, the liquid crystal molecules are in an unstable state in frame (n−1) that is one frame before, the reverse tilt occurs in the dark pixel in frame n.

Accordingly, in a case where this state of the occurrence is reconsidered with frame (n+1) used as a reference, even when the dark pixel satisfies the above-described positional relationship in frame (n+1) in accordance with the movement of an image, a countermeasure for preventing the liquid crystal molecules of the pixel from being in an unstable state in frame n before the change may be taken.

In the normally white mode, contrary to the normally black mode, as the gray scale level becomes higher (brighter), the voltage applied to the liquid crystal element is lowered. Accordingly, by taking such a point into consideration, the configuration of the video processing circuit 30 may be changed as follows.

In frame n, the risk boundary detecting unit 304 of the video processing circuit 30 may configured so as to extract a portion in which a dark pixel is located on the lower side and a bright pixel is located on the upper side and a portion in which a dark pixel is located on the left side and the bright pixel is located on the right side so as to detected as a risk boundary. The pixels of which the video signals are corrected based on the risk boundary by the correction unit 314 are the same as that described in the first to seventh embodiments as above.

In this embodiment, an example has been described in which the tilt azimuth angle θb is set to 45 degrees in the TN type. However, by considering that the direction of the occurrence of the reverse tilt domain is opposite to that of the VA type, a countermeasure for a case where the tilt azimuth angle θb is other than 45 degrees and a configuration for such a case can be easily inferred from the description presented up to now.

As above, in a case where only the horizontal direction is considered as the movement direction of the image pattern, compared to a configuration in which the vertical direction and an inclined direction are also considered as the movement direction, the configuration can be relatively simplified.

Here, although a case has been described as an example in which the tilt azimuth angle θb is set to 45 degrees in the VA type, a case where the tilt azimuth angle θb is set to 225 degrees in the VA type is similar to the above-described example.

Modified Example 2

Number of Frames as Correction Targets

In each embodiment described above, k=1, and the video processing circuit 30 corrects the video signals of frame n and frame (n+1). However, k may be set to a value that is equal to or greater than "2", and the video signals of more following frames may be corrected. For example, in a case where the response time of the liquid crystal 105 is T, and the time interval for updating the display of the liquid crystal panel 100 configured by the liquid crystal elements 120 is S, when the relationship of T≤S×k is satisfied, the correction corresponding to the response time of the liquid crystal 105 is made, and the advantage of suppressing the reverse tilt domain can be sufficiently acquired. Accordingly, in the case of double-speed driving, at least two frames may be corrected. Furthermore, in the case of quadruple-speed driving, the frame frequency is 240 Hz (4.15 ms), and at least k=3, and the video signals may be corrected over four frames. As above, even in a case where k is equal to or greater than "2", the configuration of the delay circuit 310 may be changed so as to serve as a history storage unit that stores the history of the movement corresponding to a plurality of frames.

In addition, in a case where the liquid crystal panel 100 is driven at the same speed as that of supplying the video signal Vid-in, the video processing circuit 30 may correct the video signals Vid-d over a plurality of frames. In addition, in the embodiment of the invention, when there is an advantage of suppressing the reverse tilt domain even in a case where the relationship of T>S×k is satisfied, such a configuration may be employed.

Modified Example 3

Variation of Double-Speed Driving

Recently, the driving speed of the liquid crystal panel 100 has tended to increase to double speed, quadruple-speed, or the like. Even in the case of such high-speed driving, the video signal Vid-in supplied from a higher-level device may correspond to one frame for each frame, which is the same as the case of the same speed driving. At this time, between frame n and frame (n+1), in order to improve the visual recognition characteristics of the display of a moving image or the like, an intermediate image of two frames may be generated using an interpolation technique or the like and be displayed on the liquid crystal panel 100. For example, in the case of the double-speed driving, it may be configured such that, for example, an image of one frame is displayed and updated in the first frame, and, in the following second frame, an interpolated image corresponding to an image of the frame and an image of the next frame is displayed and updated. In such a case, differently from the above-described embodiments, images of frame n and frame (n+1) may be different from each other. Even in such a case, pixels satisfying the conditions described in each embodiment may be set as the correction targets in frame (n+1). At this time, there are many cases where the number of pixels as the correction targets of the next frame is less than that of the current frame, although it depends on the content of the interpolated image.

Modified Example 4

Other Modified Examples

In each embodiment described above, although the video signal Vid-in designates the gray scale level of the pixel, the video signal may directly designate a voltage to be applied to the liquid crystal element.

In a case where the video signal Vid-in designates a voltage to be applied to the liquid crystal element, it may be configured such that a boundary is determined based on a designated application voltage, and the voltage is corrected.

In each one of the above-described second, fourth, sixth, and seventh embodiments, the gray scale levels of the bright pixel and the dark pixels as correction targets may not be the same. In addition, in the above-described sixth and seventh embodiments, the number of bright pixels and the number of dark pixels (the value of L) as correction targets may be different from each other.

Furthermore, in each embodiment, the liquid crystal element 120 may not be a transmissive type but be a reflective type.

Modified Example 5

Electronic Apparatus

Figure 35:
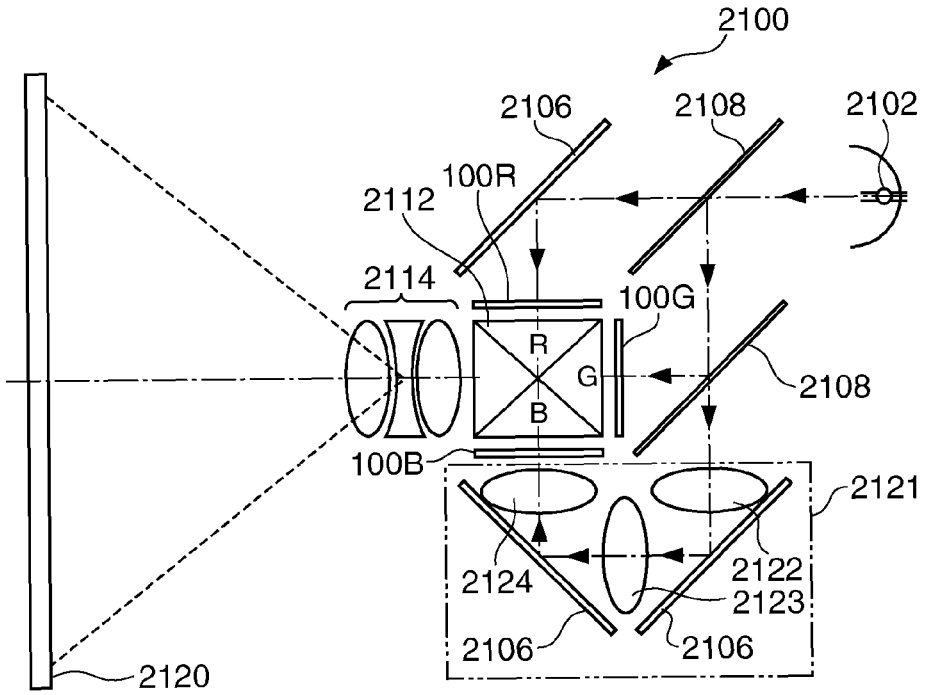
FIG. 35 is a diagram showing a projector to which the liquid crystal display device is applied.

Next, as an example of an electronic apparatus using the liquid crystal display device according to the above-described embodiment, a projection display apparatus (projector) using the liquid crystal panel 100 as a light valve will be described. FIG. 35 is a plan view illustrating the configuration of the projector.

As shown in the figure, inside the projector 2100, a lamp unit 2102 formed by a white light source such as a halogen lamp is installed. A projection light emitted from the lamp unit 2102 is divided into the three primary colors R (red), G (green) and B (blue) by three mirrors 2106 and two dichroic mirrors 2108, which are disposed therein, and are guided to light valves 100R, 100G and 100B corresponding to the respective primary colors. Since light of color B has a relatively long optical path, compared to light of the other colors R and G, in order to prevent the loss, the light of color B is guided through a relay lens system 2121 including an incident lens 2122, a relay lens 2123 and an exit lens 2124.

In the projector 2100, three sets of the liquid crystal display devices including the liquid crystal panels 100 are installed in correspondence with the colors R, G, and B. The configurations of the light valves 100R, 100G and 100B are the same as that of the above-described liquid crystal panel 100. In order to respectively designate gray scale levels of primary color components of colors R, G and B, video signals are supplied from an external higher-level circuit, and the light valves 100R, 100G and 100B are driven, respectively.

Light respectively modulated by the light valves 100R, 100G, and 100B is incident to a dichroic prism 2112 in three directions. Further, in the dichroic prism 2112, while the light of color R and the light of color B are refracted at 90 degrees, the light of color G travels straight. Accordingly, after images of the primary colors are composed, a color image is projected onto a screen 2120 by a projection lens 2114.

Since light corresponding to the primary colors R, G and B is incident to the light valves 100R, 100G and 100B by the dichroic mirror 2108, it is not necessary to install a color filter. In addition, while transmission images of the light valves 100R and 100B are projected after being reflected by the dichroic prism 2112, a transmission image of the light valve 100G is directly projected. Thus, the horizontal scanning direction that is based on the light valves 100R and 100B is opposite to the horizontal scanning direction that is based on the light valve 100G, whereby an image of which the left and right sides are reversed is displayed.

As examples of the electronic apparatus, in addition to the projector described with reference to FIG. 35, there are a television set, a viewfinder-type or monitor-direct-viewing type video cassette recorder, a car navigation apparatus, a pager, an electronic organizer, a calculator, a word processor, a workstation, a video phone, a POS terminal, a digital still camera, a cellular phone, an apparatus having a touch panel, and the like. It is apparent that the above-described liquid crystal display device can be applied to these various electronic apparatuses.

The entire disclosure of Japanese Patent Application No. 2010-276676, filed Dec. 13, 2010 is expressly incorporated by reference herein.

What is claimed is:

1. A method of processing a video in which an input video signal designating an application voltage of a liquid crystal element for each pixel is corrected, and the application voltage of the liquid crystal element is defined based on the corrected video signal, the method comprising:

detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage;

detecting a risk boundary that is a part of the boundaries between the first pixel and the second pixel designated by the input video signal and is determined based on a tilt azimuth of the liquid crystal for each of a plurality of frames including the current frame to k frames (here, k is a natural number) following the current frame; and correcting the video signal designating the application voltage of the liquid crystal element corresponding to the pixel of a frame that is brought into contact with the risk boundary detected in the detecting of the risk boundary out of a plurality of frames such that a lateral direction electric field generated by the first pixel and the second pixel decreases for at least one of the first pixel and the second pixel that are brought into contact with the risk boundary detected in accordance with the video signal of the current frame in the detecting of a risk boundary out of the boundaries detected in the detecting of the boundary, wherein, in the correcting of the video signal, in a case where the application voltage of the liquid crystal element corresponding to the first pixel brought into contact with the risk boundary detected in accordance with the video signal of the frame that is brought into contact with the risk boundary is lower than a third voltage which is lower than the first voltage, the application voltage is corrected to be equal to or higher than the third voltage.

2. The method according to claim 1, wherein in a case where a response time of the liquid crystal is T, and a time interval for updating a display of the liquid crystal panel including the liquid crystal element is S, a relationship of $T \leq S \times k$ is satisfied.

3. The method according to claim 1, wherein, in the correcting of the video signal, out of the boundary detected in the detecting of a boundary, the pixel that is brought into contact with the risk boundary that moves by one pixel over a frame that is one frame before the current frame to the current frame is set as a correction target for decreasing a lateral direction electric field.

4. A method of processing a video in which an input video signal designating an application voltage of a liquid crystal element for each pixel is corrected, and the application voltage of the liquid crystal element is defined based on the corrected video signal, the method comprising:

detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage;

detecting a risk boundary that is a part of the boundaries between the first pixel and the second pixel designated by the input video signal and is determined based on a tilt azimuth of the liquid crystal for each of a plurality of frames including the current frame to k frames (here, k is a natural number) following the current frame; and correcting the video signal designating the application voltage of the liquid crystal element corresponding to the pixel of a frame that is brought into contact with the risk boundary detected in the detecting of the risk boundary out of a plurality of frames such that a lateral direction electric field generated by the first pixel and the second pixel decreases for at least one of the first pixel and the second pixel that are brought into contact with the risk boundary detected in accordance with the video signal of the current frame in the detecting of a risk boundary out of the boundaries detected in the detecting of the boundary, wherein, in the correcting of the video signal, out of two or more of the first pixels corresponding to a number defined in advance that are consecutive on a side opposite to the risk boundary from the first pixel that is brought into contact with the risk boundary detected in accordance with the video signal of the frame brought into contact with the risk boundary, the first pixel of which the application voltage is lower than a third voltage which is lower than the first voltage is corrected such that the application voltage is equal to or higher than the third voltage.

5. A method of processing a video in which an input video signal designating an application voltage of a liquid crystal element for each pixel is corrected, and the application voltage of the liquid crystal element is defined based on the corrected video signal, the method comprising:

detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage;

detecting a risk boundary that is a part of the boundaries between the first pixel and the second pixel designated by the input video signal and is determined based on a tilt azimuth of the liquid crystal for each of a plurality of frames including the current frame to k frames (here, k is a natural number) following the current frame; and correcting the video signal designating the application voltage of the liquid crystal element corresponding to the pixel of a frame that is brought into contact with the risk boundary detected in the detecting of the risk boundary out of a plurality of frames such that a lateral direction electric field generated by the first pixel and the second pixel decreases for at least one of the first pixel and the second pixel that are brought into contact with the risk boundary detected in accordance with the video signal of the current frame in the detecting of a risk boundary out of the boundaries detected in the detecting of the boundary, wherein, in the correcting of the video signal, the application voltage of the liquid crystal element corresponding to the second pixel that is brought into contact with the risk boundary detected in accordance with the video signal of the frame brought into contact with the risk boundary is corrected to a fourth voltage that is higher than the first voltage and is lower than the second voltage.

6. A method of processing a video in which an input video signal designating an application voltage of a liquid crystal element for each pixel is corrected, and the application voltage of the liquid crystal element is defined based on the corrected video signal, the method comprising:

detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage;

detecting a risk boundary that is a part of the boundaries between the first pixel and the second pixel designated by the input video signal and is determined based on a tilt azimuth of the liquid crystal for each of a plurality of frames including the current frame to k frames (here, k is a natural number) following the current frame; and correcting the video signal designating the application voltage of the liquid crystal element corresponding to the pixel of a frame that is brought into contact with the risk boundary detected in the detecting of the risk boundary out of a plurality of frames such that a lateral direction electric field generated by the first pixel and the second pixel decreases for at least one of the first pixel and the second pixel that are brought into contact with the risk boundary detected in accordance with the video signal of the current frame in the detecting of a risk boundary out of the boundaries detected in the detecting of the boundary, wherein, in the correcting of the video signal, the application voltages of the liquid crystal elements corresponding to two or more of the second pixels corresponding to a number defined in advance that are consecutive on a side opposite to the risk boundary from the second pixel that is brought into contact with the risk boundary detected in accordance with the video signal of the frame brought into contact with the risk boundary are corrected to a fourth voltage that is higher than the first voltage and is lower than the second voltage.

7. A video processing circuit that corrects an input video signal designating an application voltage of a liquid crystal element for each pixel and defines the application voltage of the liquid crystal element based on the corrected video signal, the video processing circuit comprising:

a first boundary detecting unit detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage;

a second boundary detecting unit detecting a risk boundary that is a part of the boundary between the first pixel and the second pixel designated by the input video signal and is determined based on a tilt azimuth of the liquid crystal for each of a plurality of frames including the current frame to k frames (here, k is a natural number) following the current frame; and a correction unit correcting the video signal designating the application voltage of the liquid crystal element corresponding to the pixel of a frame that is brought into contact with the risk boundary detected by the second boundary detecting unit out of a plurality of frames such that a lateral direction electric field generated by the first pixel and the second pixel decreases for at least one of the first pixel and the second pixel that are brought into contact with the risk boundary detected in accordance with the video signal of the current frame detected by the second boundary detecting unit out of the boundary detected by the first boundary detecting unit, wherein, in the correcting of the video signal, in a case where the application voltage of the liquid crystal element corresponding to the first pixel brought into contact with the risk boundary detected in accordance with the video signal of the frame that is brought into contact with the risk boundary is lower than a third voltage which is lower than the first voltage, the application voltage is corrected to be equal to or higher than the third voltage.

8. A liquid crystal display apparatus comprising:

a liquid crystal panel that includes a liquid crystal element in which a liquid crystal is interposed between pixel electrodes disposed in correspondence with a plurality of pixels on a first substrate and a common electrode disposed on a second substrate; and a video processing circuit that corrects an input video signal designating an application voltage of a liquid crystal element for each pixel and defines the application voltage of the liquid crystal element based on the corrected video signal, wherein the video processing circuit includes:

a first boundary detecting unit detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage;

a second boundary detecting unit detecting a risk boundary that is a part of the boundary between the first pixel and the second pixel designated by the input video signal and is determined based on a tilt azimuth of the liquid crystal for each of a plurality of frames including the current frame to k frames (here, k is a natural number) following the current frame; and a correction unit correcting the video signal designating the application voltage of the liquid crystal element corresponding to the pixel of a frame that is brought into contact with the risk boundary detected by the second boundary detecting unit out of a plurality of frames such that a lateral direction electric field generated by the first pixel and the second pixel decreases for at least one of the first pixel and the second pixel that are brought into contact with the risk boundary detected in accordance with the video signal of the current frame detected by the second boundary detecting unit out of the boundary detected by the first boundary detecting unit, wherein, in the correcting of the video signal, in a case where the application voltage of the liquid crystal element corresponding to the first pixel brought into contact with the risk boundary detected in accordance with the video signal of the frame that is brought into contact with the risk boundary is lower than a third voltage which is lower than the first voltage, the application voltage is corrected to be equal to or higher than the third voltage.

9. An electronic apparatus comprising the liquid crystal display device according to claim 8.

10. A video processing circuit that corrects an input video signal designating an application voltage of a liquid crystal element for each pixel and defines the application voltage of the liquid crystal element based on the corrected video signal, the video processing circuit comprising:

a first boundary detecting unit detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage;

a second boundary detecting unit detecting a risk boundary that is a part of the boundary between the first pixel and the second pixel designated by the input video signal and is determined based on a tilt azimuth of the liquid crystal for each of a plurality of frames including the current frame to k frames (here, k is a natural number) following the current frame; and a correction unit correcting the video signal designating the application voltage of the liquid crystal element corresponding to the pixel of a frame that is brought into contact with the risk boundary detected by the second boundary detecting unit out of a plurality of frames such that a lateral direction electric field generated by the first pixel and the second pixel decreases for at least one of the first pixel and the second pixel that are brought into contact with the risk boundary detected in accordance with the video signal of the current frame detected by the second boundary detecting unit out of the boundary detected by the first boundary detecting unit, wherein, in the correcting of the video signal, out of two or more of the first pixels corresponding to a number defined in advance that are consecutive on a side opposite to the risk boundary from the first pixel that is brought into contact with the risk boundary detected in accordance with the video signal of the frame brought into contact with the risk boundary, the first pixel of which the application voltage is lower than a third voltage which is lower than the first voltage is corrected such that the application voltage is equal to or higher than the third voltage.

11. A video processing circuit that corrects an input video signal designating an application voltage of a liquid crystal element for each pixel and defines the application voltage of the liquid crystal element based on the corrected video signal, the video processing circuit comprising:

a first boundary detecting unit detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage;

a second boundary detecting unit detecting a risk boundary that is a part of the boundary between the first pixel and the second pixel designated by the input video signal and is determined based on a tilt azimuth of the liquid crystal for each of a plurality of frames including the current frame to k frames (here, k is a natural number) following the current frame; and a correction unit correcting the video signal designating the application voltage of the liquid crystal element corresponding to the pixel of a frame that is brought into contact with the risk boundary detected by the second boundary detecting unit out of a plurality of frames such that a lateral direction electric field generated by the first pixel and the second pixel decreases for at least one of the first pixel and the second pixel that are brought into contact with the risk boundary detected in accordance with the video signal of the current frame detected by the second boundary detecting unit out of the boundary detected by the first boundary detecting unit, wherein, in the correcting of the video signal, the application voltage of the liquid crystal element corresponding to the second pixel that is brought into contact with the risk boundary detected in accordance with the video signal of the frame brought into contact with the risk boundary is corrected to a fourth voltage that is higher than the first voltage and is lower than the second voltage.

12. A liquid crystal display apparatus comprising:

a liquid crystal panel that includes a liquid crystal element in which a liquid crystal is interposed between pixel electrodes disposed in correspondence with a plurality of pixels on a first substrate and a common electrode disposed on a second substrate; and a video processing circuit that corrects an input video signal designating an application voltage of a liquid crystal element for each pixel and defines the application voltage of the liquid crystal element based on the corrected video signal, wherein the video processing circuit includes:

a first boundary detecting unit detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage;

a second boundary detecting unit detecting a risk boundary that is a part of the boundary between the first pixel and the second pixel designated by the input video signal and is determined based on a tilt azimuth of the liquid crystal for each of a plurality of frames including the current frame to k frames (here, k is a natural number) following the current frame; and a correction unit correcting the video signal designating the application voltage of the liquid crystal element corresponding to the pixel of a frame that is brought into contact with the risk boundary detected by the second boundary detecting unit out of a plurality of frames such that a lateral direction electric field generated by the first pixel and the second pixel decreases for at least one of the first pixel and the second pixel that are brought into contact with the risk boundary detected in accordance with the video signal of the current frame detected by the second boundary detecting unit out of the boundary detected by the first boundary detecting unit, wherein, in the correcting of the video signal, the application voltages of the liquid crystal elements corresponding to two or more of the second pixels corresponding to a number defined in advance that are consecutive on a side opposite to the risk boundary from the second pixel that is brought into contact with the risk boundary detected in accordance with the video signal of the frame brought into contact with the risk boundary are corrected to a fourth voltage that is higher than the first voltage and is lower than the second voltage.

13. A liquid crystal display apparatus comprising:

a liquid crystal panel that includes a liquid crystal element in which a liquid crystal is interposed between pixel electrodes disposed in correspondence with a plurality of pixels on a first substrate and a common electrode disposed on a second substrate; and a video processing circuit that corrects an input video signal designating an application voltage of a liquid crystal element for each pixel and defines the application voltage of the liquid crystal element based on the corrected video signal, wherein the video processing circuit includes:

a first boundary detecting unit detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage;

a second boundary detecting unit detecting a risk boundary that is a part of the boundary between the first pixel and the second pixel designated by the input video signal and is determined based on a tilt azimuth of the liquid crystal for each of a plurality of frames including the current frame to k frames (here, k is a natural number) following the current frame; and a correction unit correcting the video signal designating the application voltage of the liquid crystal element corresponding to the pixel of a frame that is brought into contact with the risk boundary detected by the second boundary detecting unit out of a plurality of frames such that a lateral direction electric field generated by the first pixel and the second pixel decreases for at least one of the first pixel and the second pixel that are brought into contact with the risk boundary detected in accordance with the video signal of the current frame detected by the second boundary detecting unit out of the boundary detected by the first boundary detecting unit, wherein, in the correcting of the video signal, out of two or more of the first pixels corresponding to a number defined in advance that are consecutive on a side opposite to the risk boundary from the first pixel that is brought into contact with the risk boundary detected in accordance with the video signal of the frame brought into contact with the risk boundary, the first pixel of which the application voltage is lower than a third voltage which is lower than the first voltage is corrected such that the application voltage is equal to or higher than the third voltage.

14. A liquid crystal display apparatus comprising:

a liquid crystal panel that includes a liquid crystal element in which a liquid crystal is interposed between pixel electrodes disposed in correspondence with a plurality of pixels on a first substrate and a common electrode disposed on a second substrate; and a video processing circuit that corrects an input video signal designating an application voltage of a liquid crystal element for each pixel and defines the application voltage of the liquid crystal element based on the corrected video signal, wherein the video processing circuit includes:

a first boundary detecting unit detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage;

a second boundary detecting unit detecting a risk boundary that is a part of the boundary between the first pixel and the second pixel designated by the input video signal and is determined based on a tilt azimuth of the liquid crystal for each of a plurality of frames including the current frame to k frames (here, k is a natural number) following the current frame; and a correction unit correcting the video signal designating the application voltage of the liquid crystal element corresponding to the pixel of a frame that is brought into contact with the risk boundary detected by the second boundary detecting unit out of a plurality of frames such that a lateral direction electric field generated by the first pixel and the second pixel decreases for at least one of the first pixel and the second pixel that are brought into contact with the risk boundary detected in accordance with the video signal of the current frame detected by the second boundary detecting unit out of the boundary detected by the first boundary detecting unit, wherein, in the correcting of the video signal, the application voltage of the liquid crystal element corresponding to the second pixel that is brought into contact with the risk boundary detected in accordance with the video signal of the frame brought into contact with the risk boundary is corrected to a fourth voltage that is higher than the first voltage and is lower than the second voltage.

15. A liquid crystal display apparatus comprising:

a liquid crystal panel that includes a liquid crystal element in which a liquid crystal is interposed between pixel electrodes disposed in correspondence with a plurality of pixels on a first substrate and a common electrode disposed on a second substrate; and a video processing circuit that corrects an input video signal designating an application voltage of a liquid crystal element for each pixel and defines the application voltage of the liquid crystal element based on the corrected video signal, wherein the video processing circuit includes:

a first boundary detecting unit detecting a boundary that changes over a frame that is one frame before a current frame to the current frame out of boundaries between a first pixel in which the application voltage is lower than a first voltage in the input video signal and a second pixel in which the application voltage is equal to or higher than a second voltage that is higher than the first voltage;

a second boundary detecting unit detecting a risk boundary that is a part of the boundary between the first pixel and the second pixel designated by the input video signal and is determined based on a tilt azimuth of the liquid crystal for each of a plurality of frames including the current frame to k frames (here, k is a natural number) following the current frame; and a correction unit correcting the video signal designating the application voltage of the liquid crystal element corresponding to the pixel of a frame that is brought into contact with the risk boundary detected by the second boundary detecting unit out of a plurality of frames such that a lateral direction electric field generated by the first pixel and the second pixel decreases for at least one of the first pixel and the second pixel that are brought into contact with the risk boundary detected in accordance with the video signal of the current frame detected by the second boundary detecting unit out of the boundary detected by the first boundary detecting unit, wherein, in the correcting of the video signal, the application voltages of the liquid crystal elements corresponding to two or more of the second pixels corresponding to a number defined in advance that are consecutive on a side opposite to the risk boundary from the second pixel that is brought into contact with the risk boundary detected in accordance with the video signal of the frame brought into contact with the risk boundary are corrected to a fourth voltage that is higher than the first voltage and is lower than the second voltage.

* * * * *